US011540688B2

(12) United States Patent
Kim et al.

(10) Patent No.: US 11,540,688 B2
(45) **Date of Patent: *Jan. 3, 2023**

(54) HANDY-STICK TYPE VACUUM CLEANER

(71) Applicant: SAMSUNG ELECTRONICS CO., LTD., Suwon-si (KR)

(72) Inventors: Hyoun-soo Kim, Suwon-si (KR); Tae-woon Lim, Suwon-si (KR); Jin-ho Lee, Hwaseong-si (KR); Yun-won Jung, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 0 days.

This patent is subject to a terminal disclaimer.

(21) Appl. No.: 16/475,929

(22) PCT Filed: Jan. 3, 2018

(86) PCT No.: PCT/KR2018/000094

§ 371 (c)(1),
(2) Date: Jul. 3, 2019

(87) PCT Pub. No.: WO2018/128371

PCT Pub. Date: Jul. 12, 2018

(65) Prior Publication Data

US 2019/0343356 A1 Nov. 14, 2019

(30) Foreign Application Priority Data

Jan. 3, 2017 (KR) ..... 10-2017-0000764
Aug. 9, 2017 (KR) ..... 10-2017-0100834

(51) Int. Cl.

| | |
|---|---|
| ***A47L 9/32*** | (2006.01) |
| ***A47L 5/24*** | (2006.01) |
| ***A47L 9/16*** | (2006.01) |

(52) U.S. Cl.
CPC ..... *A47L 9/322* (2013.01); *A47L 5/24* (2013.01); *A47L 9/165* (2013.01); *A47L 9/1666* (2013.01); *A47L 9/1683* (2013.01)

(58) Field of Classification Search
CPC ..... A47L 9/322; A47L 9/2884; A47L 9/22; A47L 9/12; A47L 9/242; A47L 9/24;
(Continued)

(56) References Cited

U.S. PATENT DOCUMENTS 1,800,349 A * 4/1931 Hurason ..... B25G 3/38 403/57
6,478,342 B1 * 11/2002 Berfield ..... A47L 9/242 285/275

(Continued)

FOREIGN PATENT DOCUMENTS

CN 1911151 2/2007
CN 201398934 2/2010

(Continued)

OTHER PUBLICATIONS

Written Opinion of the International Searching Authority dated Apr. 13, 2018 in corresponding International Application No. PCT/KR2018/000084.

(Continued)

*Primary Examiner* — Monica S Carter
*Assistant Examiner* — Michael A Gump
(74) *Attorney, Agent, or Firm* — Staas & Halsey LLP

(57) ABSTRACT

A handy-stick type vacuum cleaner is disclosed. The disclosed vacuum cleaner comprises: a first part for collecting dust included in air suctioned to the inside through a suction hole; and a second part including a suction motor and a handle, wherein the first and second parts are hinge-connected so as to communicate with each other.

19 Claims, 50 Drawing Sheets

(58) Field of Classification Search
CPC ... A47L 9/20; A47L 9/32; A47L 9/327; A47L 9/16–1691; A47L 5/24; A47L 5/22; A47L 5/225; A47L 11/40
USPC ..... 15/344, 143.1, 300.1, 345
See application file for complete search history.

(56) References Cited

U.S. PATENT DOCUMENTS

| | | | | |
|---|---|---|---|---|
| 6,766,558 | B1 * | 7/2004 | Matsumoto | A47L 9/2821 15/353 |
| 7,074,248 | B2 | 7/2006 | Jin et al. | |
| 7,186,283 | B2 | 3/2007 | Vuijk | |
| 7,370,387 | B2 | 5/2008 | Walker et al. | |
| RE42,873 | E | 11/2011 | Walker et al. | |
| 8,100,999 | B2 | 1/2012 | Ashbee et al. | |
| RE43,804 | E | 11/2012 | Walker et al. | |
| 8,945,258 | B2 | 2/2015 | Smith | |
| 9,247,690 | B1 | 2/2016 | Awad | |
| 10,660,494 | B1 * | 5/2020 | Alton | A47L 9/0081 |
| 2001/0025395 | A1 * | 10/2001 | Matsumoto | A47L 9/20 15/353 |
| 2004/0187253 | A1 * | 9/2004 | Jin | A47L 9/20 15/352 |
| 2007/0033765 | A1 * | 2/2007 | Walker | A47L 9/2873 15/344 |
| 2012/0079671 | A1 | 4/2012 | Stickney et al. | |
| 2013/0091658 | A1 | 4/2013 | Smith | |
| 2014/0082882 | A1 | 3/2014 | Kawamata et al. | |
| 2014/0237757 | A1 | 8/2014 | Conrad | |
| 2016/0150924 | A1 | 6/2016 | Conrad | |
| 2016/0174789 | A1 | 6/2016 | Han et al. | |
| 2016/0287042 | A1 * | 10/2016 | Han | A47L 9/1683 |
| 2017/0319025 | A1 * | 11/2017 | Hu | A47L 9/009 |
| 2018/0310788 | A1 * | 11/2018 | Han | A47L 9/1675 |
| 2019/0059672 | A1 * | 2/2019 | Zhang | A47L 5/225 |
| 2019/0328188 | A1 * | 10/2019 | Conrad | A47L 9/1608 |

FOREIGN PATENT DOCUMENTS

| | | | |
|---|---|---|---|
| CN | 103040403 | A | 4/2013 |
| CN | 203468509 | | 3/2014 |
| CN | 105395134 | | 3/2016 |
| CN | 105816104 | | 8/2016 |
| JP | 3530116 | | 5/2004 |
| JP | 2005-137684 | | 6/2005 |
| JP | 3813882 | | 8/2006 |
| JP | 2009-82266 | A | 4/2009 |
| JP | 2014-61451 | | 4/2014 |
| JP | 2014-68673 | | 4/2014 |
| JP | 2015-173673 | | 10/2015 |
| KR | 1995-0005262 | | 3/1995 |
| KR | 2000-0011948 | | 2/2000 |
| KR | 10-0518804 | | 10/2005 |
| KR | 10-0607974 | | 8/2006 |
| KR | 10-0640927 | | 11/2006 |
| KR | 10-2006-0128415 | | 12/2006 |
| KR | 100730948 | B1 * | 6/2007 |
| KR | 10-0762323 | | 10/2007 |
| KR | 20-0448183 | | 3/2010 |
| KR | 10-1193779 | | 10/2012 |
| KR | 10-1213369 | | 12/2012 |
| KR | 10-2016-0074258 | | 6/2016 |
| WO | WO 2008/009887 | A1 | 1/2008 |

OTHER PUBLICATIONS

International Search Report dated Apr. 13, 2018 in corresponding International Application No. PCT/KR2018/000084.
Chinese Office Action dated Sep. 28, 2020 from Chinese Patent Application No. 201880005823.X, 21 pages.
Indian Office Action dated Jul. 23, 2020 from Indian Patent Application No. 201917027598, 7 pages.
Extended European Search Report dated Dec. 2, 2019 in corresponding European Patent Application No. 18736314.8.
Chinese Office Action dated May 27, 2021 from Chinese Application No. 201880005823.X.
Chinese Office Action dated Sep. 28, 2021 in Chinese Patent Application No. 201880005823.X; 6 pages, 12 pages English translation.
Korean Office Action dated Sep. 27, 2021 in Korean Patent Application No. 10-2017-0100834; 5 pages, 4 pages English translation.
Korean Office Action dated Mar. 17, 2022 from Korean Patent Application No. 10-2017-0100834.
Decision of Rejection dated Feb. 11, 2022 from Chinese Patent Application No. 201880005823.X.
Examination Report dated Nov. 3, 2022 for Australian Patent Application No. 2018206189.

* cited by examiner

HANDY-STICK TYPE VACUUM CLEANER

CROSS-REFERENCE TO RELATED APPLICATIONS

This application is a U.S. National Stage Application which claims the benefit under 35 U.S.C. § 371 of International Patent Application No. PCT/KR2018/000094 on Jan. 3, 2018, which claims foreign priority benefit under 35 U.S.C. § 119 of Korean Patent Application Nos. 10-2017-0000764 and 10-2017-0100834 filed on Jan. 3, 2017 and Aug. 9, 2017, respectively, in the Korean Intellectual Property Office, the contents of which are incorporated herein by reference.

TECHNICAL FIELD

The present disclosure relates to a cleaner, and more particularly, to a handy-stick type vacuum cleaner which may be used as a stick type by combining an extension pipe and a brush or as a stick type by separating an accessory.

BACKGROUND ART

Generally, handheld type, stick type, and handy-stick type vacuum cleaners are smaller than canister type and upright type vacuum cleaners, so that they are light and easy to handle. In addition, these vacuum cleaners are equipped with a rechargeable battery for self-power supply, and are often wireless.

In the case of such a wireless vacuum cleaner, it may clean the widow frame, the bookcase, the sofa, and the like as well as the bottom surface (for example, the floor) more easily than a vacuum cleaner used by a wire.

In this case, the position and orientation of a user's hand, wrist, and arm using the vacuum cleaner may be changed depending on the place and position where dust is sucked.

In other words, because the handle is fixed to the main body, it is often necessary to twist the wrist or arm in order to perform cleaning in a direction desired by the user. As a result, a large load is applied to the wrist or arm during cleaning, which causes the user to feel fatigue easily.

DISCLOSURE OF INVENTION

In order to overcome the above problems, it is an object of the present disclosure to provide a handy-stick type vacuum cleaner capable of selectively adjusting an angle of a handle so that a user can perform cleaning in a comfortable posture without twisting the wrist or arm.

Another object of the present disclosure is to provide a handy-stick type vacuum cleaner capable of easily discharging human hairs or pet hairs collected in a dust collecting member from the dust collecting member.

In order to achieve the above objects, the present disclosure may provide a handy-stick type vacuum cleaner including a first part including a dust collecting member; a second part including a suction motor and a handle; and a third part positioned between the first part and the second part such that the first part is rotatable with respect to the second part.

The first part and the second part may be in communication with each other through a flexible tube.

The flexible tube may include one end connected to an air discharge port of the first part and another end connected to an air inlet hole of the second part.

The flexible tube may be disposed inside the third part.

The third part may be disposed behind the air discharge port of the first part and in front of the air inlet hole of the second part.

The flexible tube may be provided with a helical protrusion formed on its outer circumferential surface. A first engaging member and a second engaging member screwed to both ends of the flexible tube may be provided at the air discharge port of the first part and the air inlet hole of the second part.

The third part may be configured to set a rotation mode in which the first part and the second part are rotatable with respect to each other or a fixed mode in which the first part and the second part are rotated with respect to each other.

In the fixed mode, a longitudinal axis of the first part and a longitudinal axis of the second part may be parallel to each other, and in the rotation mode, the longitudinal axis of the first part and the longitudinal axis of the second part may form an obtuse angle.

In the fixed mode, an center axis of a cyclone of the dust collecting member may be arranged parallel or concentrically with a center axis of the suction motor, and in the rotation mode, the center axis of the cyclone of the dust collecting member and the center axis of the suction motor may form an obtuse angle.

The third part may include a locking portion configured to maintain a setting angle between the first part and the second part.

An angle formed between the longitudinal axis of the first part and a longitudinal axis of the handle may be smaller in the rotation mode than in the fixed mode.

An angle at which the first part is rotatable with respect to the second part may be an acute angle.

The first part may include a dust collecting member detachably disposed in a mounting space, and the dust collecting member may be divided into a cyclone and a dust collecting chamber.

The first portion may be provided with a filter disposed in a chamber formed between the mounting space and the flexible tube.

The dust collecting member may include a container including the cyclone and the dust collecting chamber; and a cover configured to open and close an open rear surface of the container and to guide air discharged from the cyclone to the second part.

The cyclone may include a grill filter member disposed inside the cyclone to reciprocate linearly along an axial direction of the cyclone; and a plurality of catching protrusions inclined to contact an outer surface of a grill portion of the grill filter member.

The cyclone may include a guide pipe configured to receive the grill portion when the grill filter member is retracted; and a helical guide disposed between the guide pipe and an inner circumferential surface of the cyclone and configured to guide dust and air flowing into the cyclone in a helical direction, wherein the plurality of catching protrusions may be disposed at a tip end of the guide pipe at intervals.

The plurality of catching protrusions may be inclined so as to further enter a center of the guide pipe from a lower end toward a tip end.

The plurality of catching protrusions may gradually become narrower from the lower end toward the tip end.

The grill portion may be provided with a plurality of grooves on an outer surface of the grill portion so that the plurality of catching protrusions are slidably inserted into the plurality of grooves along a longitudinal direction of the grill portion.

The tip end of the grill portion may be pressed to and inserted into a gasket coupled to an inflow hole of the cover, and the gasket may be provided with a plurality of sealing protrusions corresponding to the plurality of grooves of the grill portion.

The grill filter member may be provided with an engaging groove to snap-engage with an engaging protrusion formed in a portion of the container. The grill filter member may have a length that allows the tip end of the grill portion to be pressed and inserted into the gasket when the engaging protrusion is engaged with the engaging groove.

The grill filter member may include a handle on which the engaging groove is formed and the handle may be partially exposed on the front surface of the container.

The grill filter member may be elastically supported by an elastic member so as to be elastically advanced and retracted with respect to the container.

An inlet of the suction motor of the second part may be in communication with the flexible tube.

The second part may be provided with an exhaust filter in an exhaust chamber formed behind the suction motor.

The second part may include a battery mounting groove formed in a portion adjacent to the handle and a battery detachably disposed in the battery mounting groove.

The first part may include an extension pipe detachably disposed at the tip end and a suction nozzle connected to the extension pipe.

Further, in order to achieve the above objects, the present disclosure may provide a handy-stick type vacuum cleaner including a first part including a suction hole formed at a tip end thereof and a dust collecting member detachably disposed in a mounting space communicating with the suction hole; a second part provided with a suction motor therein-side and a handle extended from one side thereof; a third part configured to rotatably connect a rear end of the first part and a leading end of the second part; and a flexible tube configured to connect a cyclone formed in the dust collecting member and the suction motor to be in communication with each other.

Further, in order to achieve the above objects, the present disclosure may provide a handy-stick type vacuum cleaner including a dust collecting member configured to separate dust from an introduced air; a main body configured to generate a suction force; and a connecting portion configured to connect the dust collecting member and the main body, wherein the main body and the dust collecting member may be mutually rotatable about the connecting portion.

The dust collecting member may be movable between a first position and a second position, wherein the first position is a position where an center axis of the dust collecting member and an center axis of the suction motor are parallel or concentric with each other, and the second position is a position where the center axis of the dust collecting member and the center axis of the suction motor form an obtuse angle.

BEST MODE FOR CARRYING OUT THE INVENTION

In order to fully understand the structure and effects of the present disclosure, preferred embodiments of the present disclosure will be described with reference to the accompanying drawings. However, the present disclosure is not limited to the embodiments described below, but may be implemented in various forms and various modifications may be made. It should be understood, however, that the description of the present embodiments is provided to enable the present disclosure to be complete and to fully convey the scope of the present disclosure to those skilled in the art. In the accompanying drawings, the components are enlarged for the sake of convenience of explanation, and the proportions of the components may be exaggerated or reduced.

The terms of first, second, and the like may be used to describe various components, but the components should not be limited by the terms. The terms may only be used for the purpose of distinguishing one component from another. For example, without departing from the scope of the present disclosure, the first component may be referred to as a second component, and similarly, the second component may be referred to as a first component.

The terms used in the embodiments of the present disclosure may be construed as commonly known to those skilled in the art unless otherwise defined.

Hereinafter, a structure of a handy-stick type vacuum cleaner according to an embodiment of the present disclosure will be described in detail with reference to the drawings.

Figure 1:
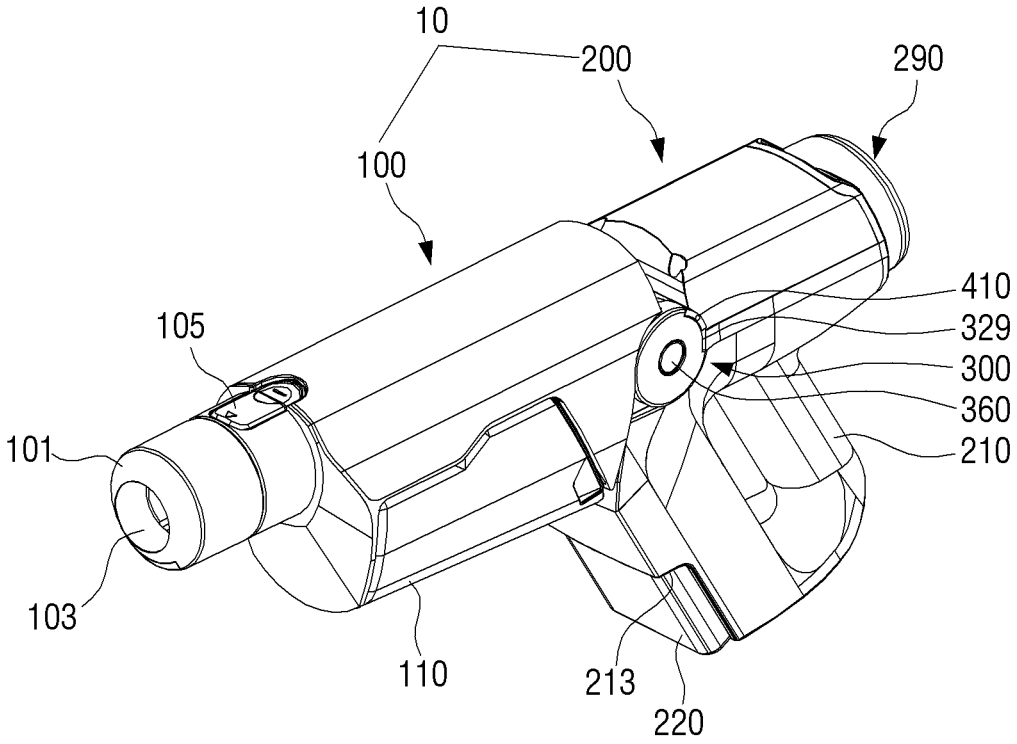
FIG. 1 is a perspective view illustrating a handy-stick type vacuum cleaner according to an embodiment of the present disclosure.
Figure 2:
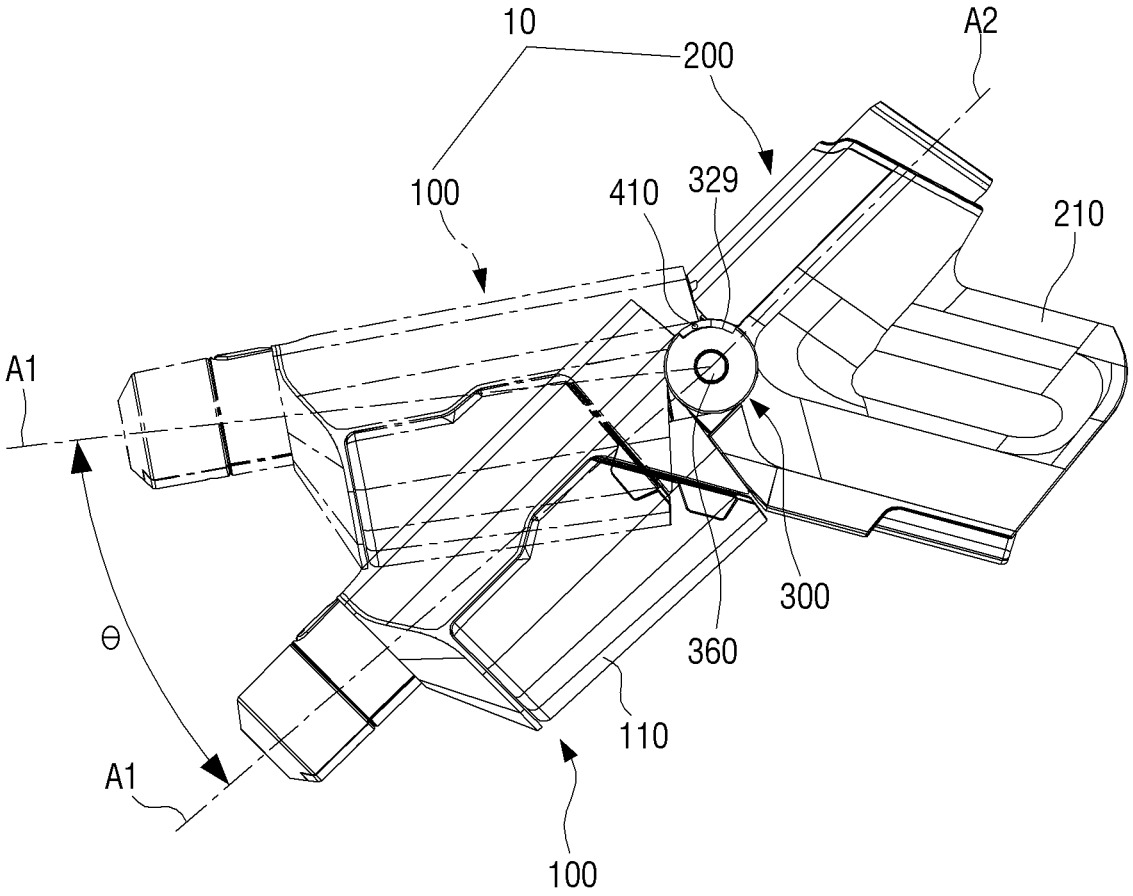
FIG. 2 is a view illustrating a state in which a first part rotates with respect to a second part in a handy-stick type vacuum cleaner according to an embodiment of the present disclosure.

FIG. 1 is a perspective view illustrating a handy-stick type vacuum cleaner according to an embodiment of the present disclosure, and FIG. 2 is a view illustrating a state in which a first part rotates with respect to a second part in a handy-stick type vacuum cleaner according to an embodiment of the present disclosure.

Referring to FIG. 1, a handy-stick type vacuum cleaner 10 according to an embodiment of the present disclosure may include a first part 100 in which a dust collecting member 110 is disposed and a second part 200 in which a handle 210 is formed.

Referring to FIG. 2, the first and second parts 100 and 200 are rotatably connected to each other through a third part 300. In this case, the first part 100 may rotate about the rotation axis 360 of the third part 300 by a predetermined angle θ with respect to the second part 200. In FIG. 2, the angle θ by which the first part 100 is rotatable with respect to the second part 200 is shown as being approximately acute. However, the present disclosure is not limited thereto. The handy-stick type vacuum cleaner 10 may be manufactured such that the angle θ by which the first part 100 can rotate with respect to the second part 200 is an obtuse angle.

On the other hand, the third part 300 may be provided with a mode setting member 410 capable of setting the first and second parts 100 and 200 to a rotation mode in which they are rotatable with respect to each other and a fixed mode in which they are fixed with respect to each other.

In the present embodiment, the mode setting member 410 exposed to the outside of the third part 300 may be operated to fix the first and second parts 100 and 200 to each other or keep them in a rotatable state with respect to each other. Further, in this embodiment, when the mode setting member 410 is set to the rotation mode, the first and second parts 100 and 200 are arranged at a desired angle with respect to each other. After that, when the mode setting member 410 is set to fixed mode, the first and second parts 100 and 200 may maintain the above-arranged angle.

Figure 5:
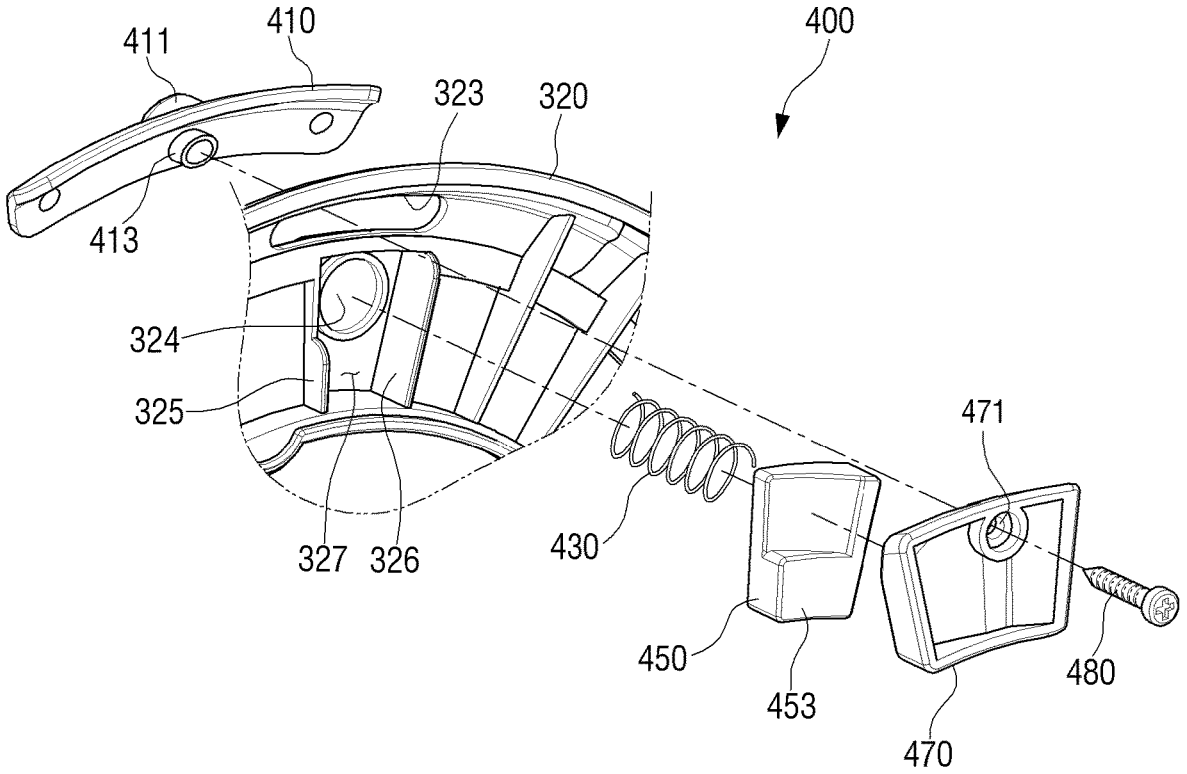
FIG. 5 is an exploded perspective view illustrating a locking portion configured to set first and second parts to a rotation mode or a fixed mode.

The mode setting member 410 is a component constituting a locking portion 400 (see FIG. 5). The structure and operation of the locking portion 400 will be described later.

Hereinafter, the third part 300 configured to rotatably connect the first and second parts 100 and 200 with respect to each other will be described with reference to FIGS. 3 and 4.

Figure 3:
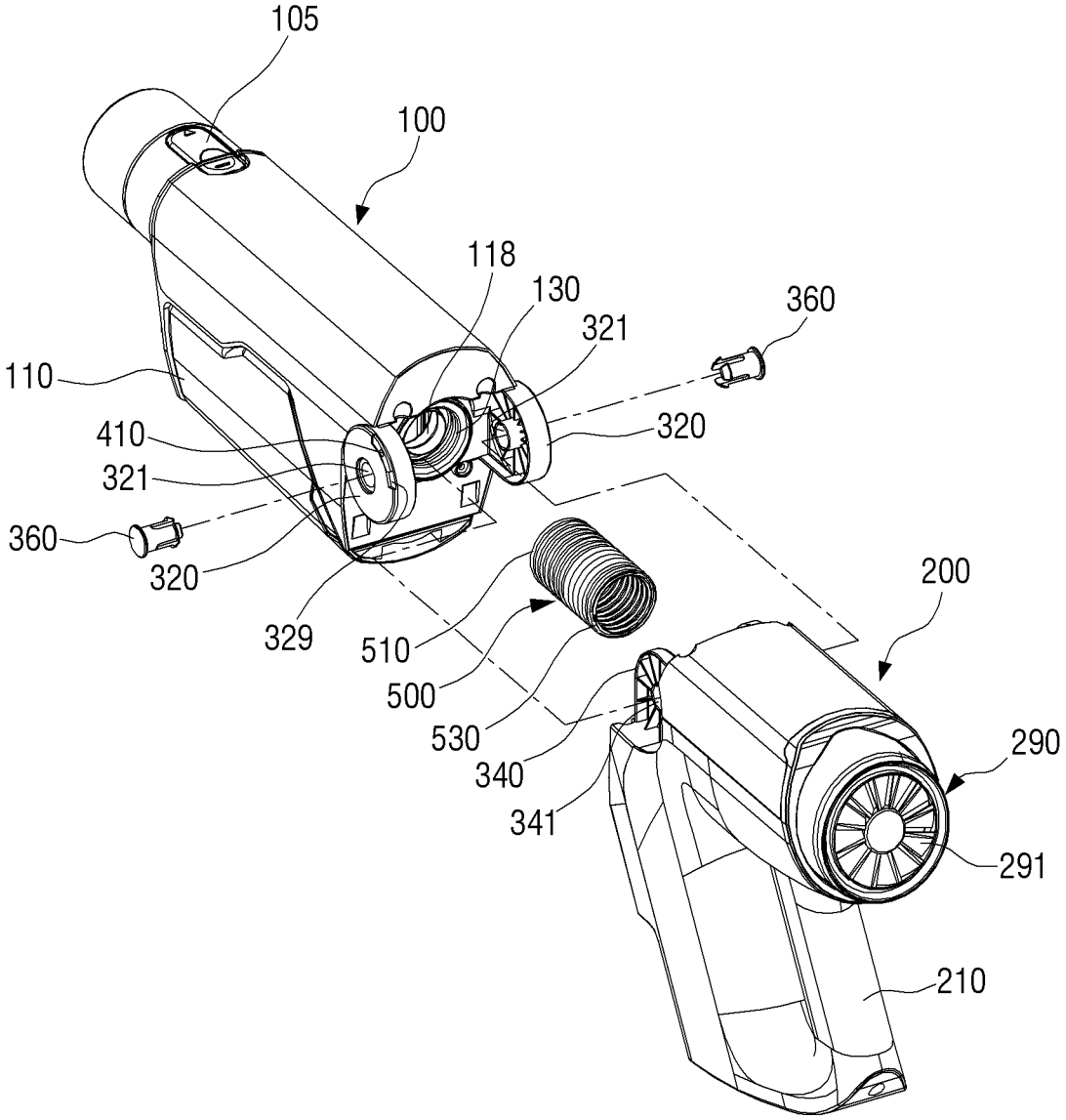
FIGS. 3 and 4 are exploded perspective views illustrating a handy-stick type vacuum cleaner according to an embodiment of the present disclosure, which is divided into a first part and a second part, together with a flexible tube communicating the first and second parts.
Figure 4:
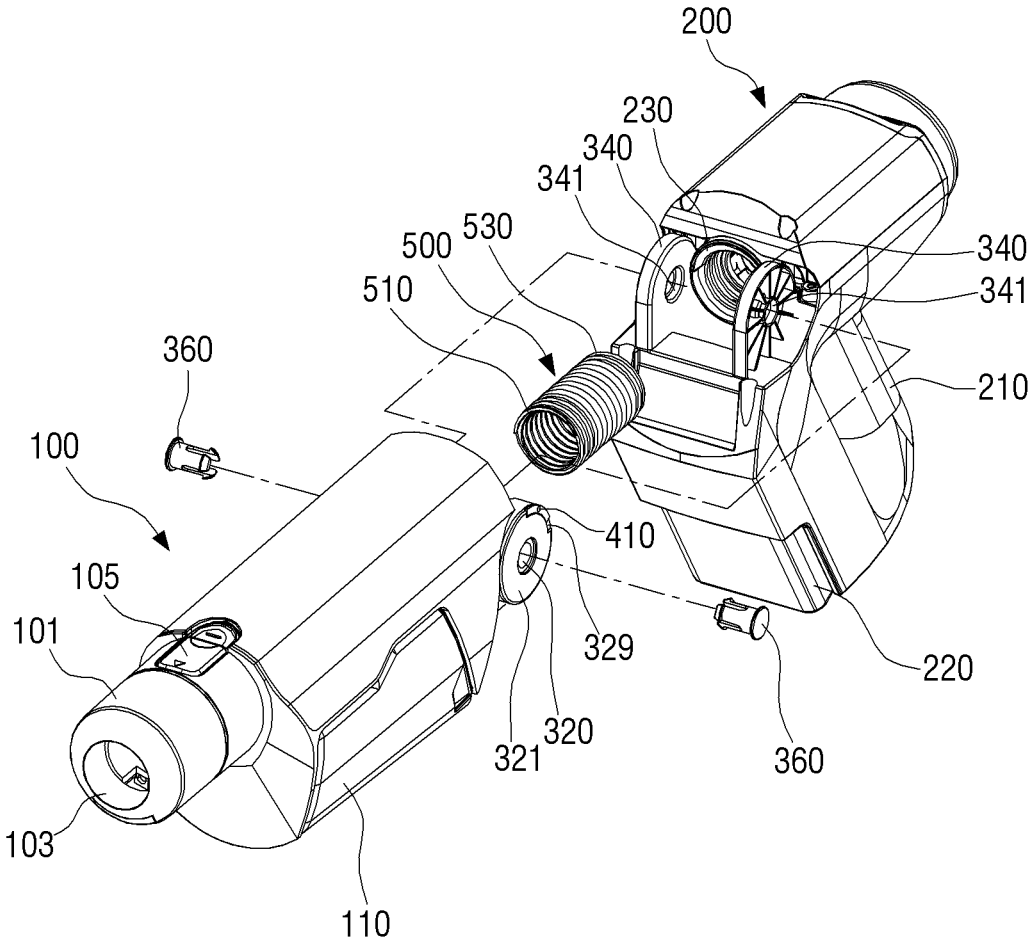

FIGS. 3 and 4 are exploded perspective views illustrating a handy-stick type vacuum cleaner according to an embodiment of the present disclosure, which is divided into a first part and a second part, together with a flexible tube communicating the first and second parts.

Referring to FIGS. 3 and 4, the third part 300 connecting the first and second parts 100 and 200 may include a pair of first supporting portions 320, a pair of second supporting portions 340 corresponding to the pair of first supporting portions 320, and a pair of rotation shafts 360 connecting the pair of first and second supporting portions 320 and 340.

The pair of first supporting portions 320 are formed to protrude along the longitudinal direction of the first part 100 from both sides of the rear end of the first part 100. The pair of first supporting portions 320 are provided with through holes 321 formed on the same axis. The rotation shafts 360 are coupled to the through holes 321, respectively.

The pair of second supporting portions 340 are formed to protrude from both sides of the front end of the second part 200 along the longitudinal direction of the second part 200. The pair of second supporting portions 340 are formed to be smaller in width than the pair of first supporting portions 320 and positioned inside the pair of first supporting portions 320. The pair of second supporting portions 340 are provided with through holes 341 which are formed on the same axis and into which the rotation shafts 360 are inserted.

The pair of rotation shafts 360 are respectively coupled to the through holes 321 and 341 of the first and second supporting portions 320 and 340 to rotatably connect the first and second supporting portions 320 and 340 facing each other.

Through the third part 300 constructed as described above, a first axis A1 (see FIG. 2) perpendicular to the rotation shafts 360 and along the longitudinal direction of the first part 100 and a second axis A2 (see FIG. 2) perpendicular to the rotation shafts 360 and along the longitudinal direction of the second part 200 may be rotated to form a certain angle with respect to each other.

Accordingly, when cleaning is performed using the handy-stick type vacuum cleaner 10 according to the present embodiment, because the first part 100 may be rotated at a certain angle with respect to the second part 200 about the rotation shafts 360, the operation of bending or twisting the wrist of the hand holding the handle 210 of the second part 200 may be minimized so that the load applied to the wrist may be greatly reduced.

Hereinafter, the structure of the locking portion 400 capable of setting the first and second parts 100 and 200 to the fixed mode or the rotation mode by locking or unlocking the third part 300 will be described with reference to FIGS. 5 to 9.

Figure 6:
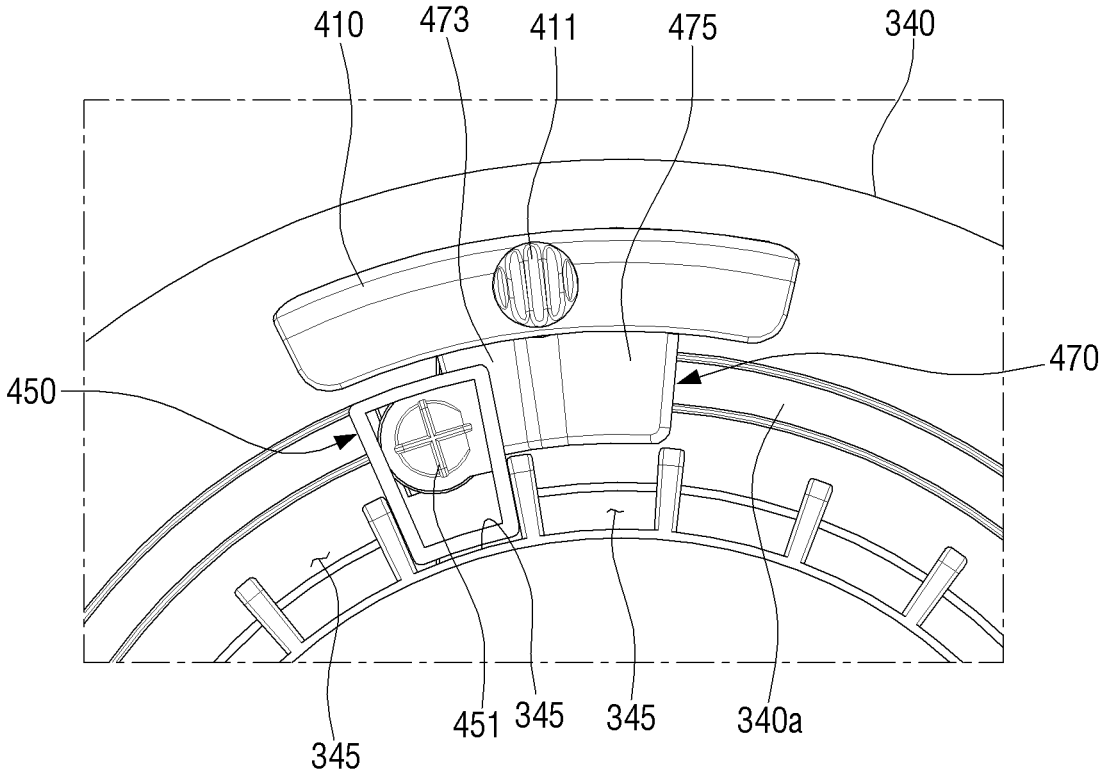
FIG. 6 is a view illustrating a locking portion in which first and second parts are set to a fixed mode in which they are not mutually rotatable.
Figure 7:
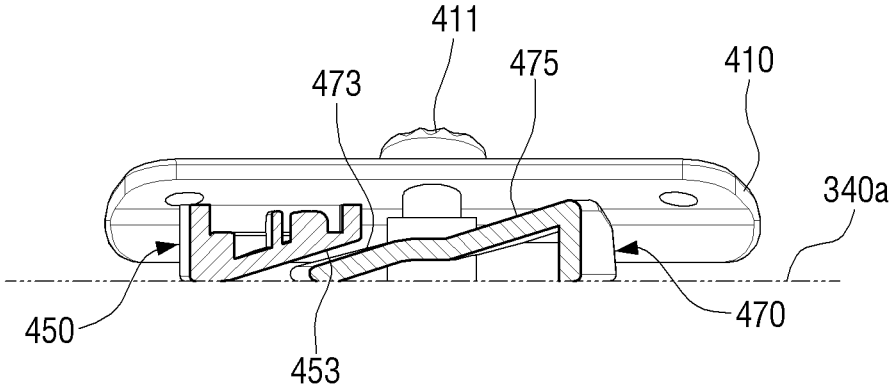
FIG. 7 is a cross-sectional view illustrating the locking portion taken along line A-A illustrated in FIG. 6.
Figure 8:
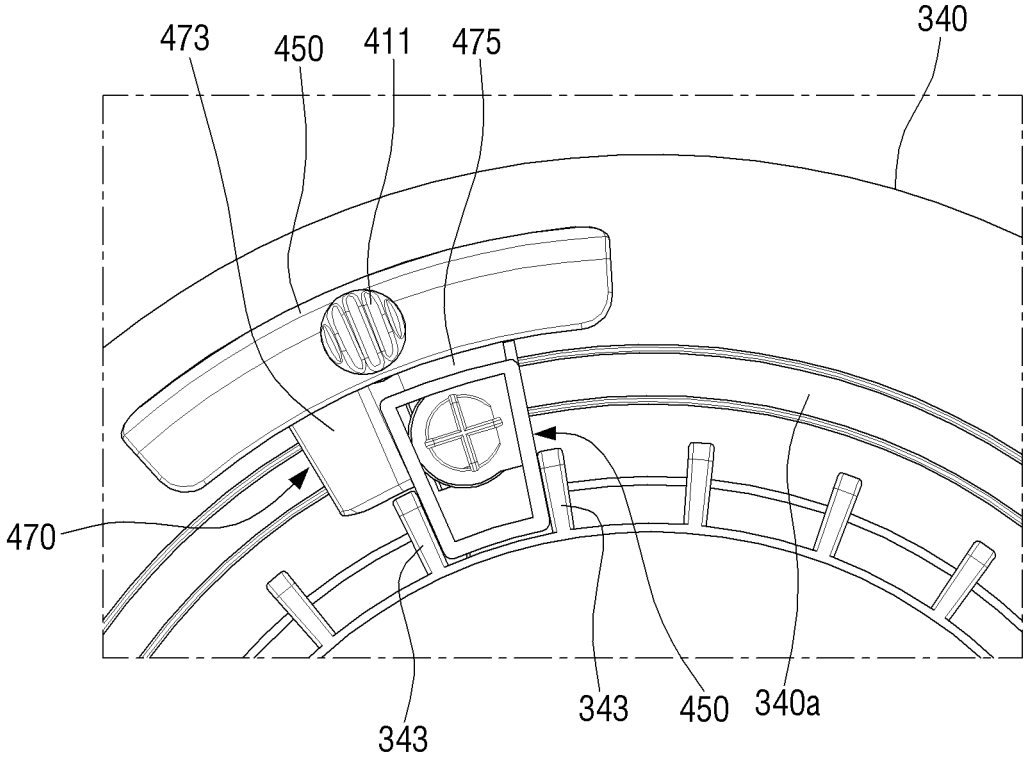
FIG. 8 is a view illustrating a locking portion in which first and second parts are set in a rotation mode in which they can rotate with respect to each other.
Figure 9:
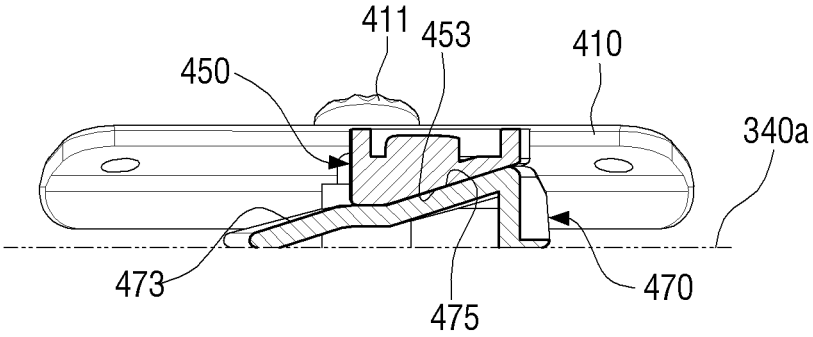
FIG. 9 is a cross-sectional view illustrating the locking portion taken along line B-B illustrated in FIG. 8.

FIG. 5 is an exploded perspective view illustrating a locking portion configured to set first and second parts to a rotation mode or a fixed mode. FIG. 6 is a view illustrating a locking portion in which first and second parts are set to a fixed mode in which they are not mutually rotatable. FIG. 7 is a cross-sectional view of the locking portion taken along line A-A illustrated in FIG. 6. FIG. 8 is a view illustrating a locking portion in which first and second parts are set to a rotation mode in which they can rotate with each other. FIG. 9 is a cross-sectional view of the locking portion taken along line B-B illustrated in FIG. 8.

Referring to FIG. 5, the locking portion 400 may be disposed in the third part 300. In detail, the mode setting member 410 of the locking portion 400 may be disposed at the outside of the third part 300 and the remaining components constituting the locking portion 400 may be disposed at the inside of the third part 300 (between the first and second supporting portions 320 and 340).

The locking portion 400 may include the mode setting member 410, an elastic member 430, a latch 450, and a slider 470.

The mode setting member 410 is slidably disposed in a groove 329 (see FIG. 3) formed on the outer surface of the first supporting portion 320 of the third part 300. The groove 329 is formed longer than the length of the mode setting member 410. In addition, the groove 329 is formed along the circumferential direction of the first supporting portion 320. Therefore, the mode setting member 410 may be moved to a first position corresponding to the fixed mode and a second position corresponding to the rotation mode in the groove 329.

The mode setting member 410 may be integrally provided with a non-slip protrusion 411 on the outer surface thereof for the convenience of the user's operation.

The mode setting member 410 may be fastened to the slider 470 through a screw 480. In this case, the mode setting member 410 is provided with a fastening hole 413, to which the screw 480 is fastened, in the inner surface thereof.

The elastic member 430 elastically presses the latch 450 toward the slider 470. The elastic member 430 may be a coil spring, and has one end inserted into a fixing groove 324 formed in the inner surface of the first supporting portion 320 and the other end inserted into a fixing protrusion 451 (see FIG. 6) formed on the surface of the latch 450.

The latch 450 is slidably disposed in a retraction space 327 between the guide ribs 325 and 326 formed on the inner surface of the first supporting portion 320.

Because the latch 450 is elastically pressed toward the slider 470 by the elastic member 430, the latch 450 may be slid toward the first supporting portion 320 or the second supporting portion 340 in conjunction with the movement of the slider 470.

The latch 450 has a contact surface 453 formed on the surface facing the slider 470. The contact surface 453 may slide in contact with a first inclined surface 473 (see FIG. 6) and a second inclined surface 475 (see FIG. 6) of the slider 470 described later.

When the latch 450 is inserted into the retraction space 327 of the first supporting portion 320, the first and second parts 100 and 200 are rotatable with respect to each other. Accordingly, the first and second parts 100 and 200 may be set to the rotation mode.

On the other hand, when the latch 450 is fully released from the retraction space 327 and inserted into any one of a plurality of fixing grooves 345 formed in the second supporting portion 340 as illustrated in FIG. 6, the first and second parts 100 and 200 may not rotate with respect to each other. Accordingly, the first and second parts 100 and 200 may be set to the fixed mode.

Referring to FIG. 5, the slider 470 is provided with a through hole 471 through which the screw 480 is fastened. The slider 470 is fixed to the mode setting member 410 at a predetermined interval by the screw 480. In this case, between the mode setting member 410 and the slider 470, the elastic member 430 and the latch 450 are disposed.

The first supporting portion 320 is provided with a guide hole 323 through which the screw 480 fastening the mode setting member 410 and the slider 470 may be moved. Thus, when the mode setting member 410 is moved to the first position (see FIGS. 6 and 7) for setting the fixed mode or the second position (see FIGS. 8 and 9) for setting the rotation mode, the slider 470 is also moved to the first position or the second position together with the mode setting member 410.

Referring to FIGS. 6 and 7, the slider 470 is formed with the first and second inclined surfaces 473 and 475 which are inclined in the same direction on the side surface facing the latch 450. The first inclined surface 473 is positioned closer to one surface 340*a* of the second supporting portion 340 than the second inclined surface 475.

When the mode setting member 410 moves to the first position (the fixed mode), the slider 470 slides along the one surface 340*a* of the second supporting portion 340 so that the first inclined surface 473 comes to a position corresponding to the contact surface 453 of the latch 450. In this case, the latch 450 is completely disengaged from the space 327 (see FIG. 5), and then is inserted into any one of the plurality of fixing grooves 345. Accordingly, the first and second supporting portions 320 and 340 are locked to each other, and the first and second parts 100 and 200 are not rotatable about the rotation shafts 360.

Referring to FIGS. 8 and 9, the mode setting member 410 moves to the second position (the rotation mode), the slider 470 slides along the one surface 340*a* of the second supporting portion 340 so that the second inclined surface 475 comes to a position corresponding to the contact surface 453 of the latch 450. In this case, the latch 450 is inserted into the retraction space 327 (see FIG. 5). As a result, the first and second supporting portions 320 and 340 are released from the locked state, so that the first and second parts 100 and 200 are rotatable with respect to each other.

When the first and second parts 100 and 200 are rotated about the rotation shafts 360 by a certain angle in this state and the mode setting member 410 is moved to the first position, the latch 450 is inserted into any one of the plurality of fixing grooves 345 and the first and second supporting portions 320 and 340 are locked with each other. Therefore, the first and second parts 100 and 200 are not rotatable about the rotation shafts 360.

However, cleaning may be performed even when the mode setting member 410 is moved to the second position. In this case, the first part 100 is maintained in a state in which the first part 100 is continuously rotatable with respect to the second part 200 at an arbitrary angle about the rotation shafts 360.

Hereinafter, a structure in which the first and second parts 100 and 200 are connected to each other through a flexible tube 500 to be able to communicate therewith will be described again with reference to FIGS. 3 and 4.

The flexible tube 500 is formed of a flexible material so that it may be easily bent. The flexible tube 500 has one end 510 connected to the rear end of the first part 100 and the other end 530 connected to the front end of the second part 200. Therefore, the first and second parts 100 and 200 are connected to each other by the flexible tube 500 so as to be able to communicate with each other.

The flexible tube 40 corresponding to the section between the first and second parts 100 and 200 of a suction flow path (see FIG. 10) may be naturally bent and maintain the suction flow path when the first and second parts 100 and 200 mutually rotate about the rotation shafts 360.

In this case, in order to prevent air from leaking at the connecting portion between the one end 510 of the flexible tube 500 and the first part 100 and the connecting portion between the other end 530 of the flexible tube 500 and the second part 200, the flexible tube 500 needs a structure that the flexible tube 500 is firmly connected to the first and second parts 100 and 200.

To this end, the flexible tube 500 may be formed with a helical protrusion approximately on the outer circumferential surface thereof. The helical protrusion may be formed on the entire outer circumferential surface of the flexible tube 500 or may be formed only on the one end and the other end of the flexible tube 500. The first part 100 may be provided with a first coupling member 130 (see FIG. 3) to which the one end 510 of the flexible tube 500 is screwed on the rear end thereof, and the second part 200 may be provided with a second coupling member 230 (see FIG. 4) to which the other end 530 of the flexible tube 500 is screwed on the front end thereof. Each of the first and second coupling members 130 and 230 is provided with a threaded portion on the inner circumferential surface thereof.

The one end 510 of the flexible tube 500 is screwed to the first coupling member 130, and the other end 530 of the flexible tube 500 is screwed to the second coupling member 230. Accordingly, even when the first and second parts 100 and 200 rotate repeatedly about the rotation shafts 360, the one end 510 and the other end 530 of the flexible tube 500 are not separated from the first and second coupling members 130 and 230 and maintain a firm connection with the first and second coupling members 130 and 230 (see FIG. 10).

On the other hand, the flexible tube 500 is bent when the first and second parts 100 and 200 are rotated with respect to each other. At this time, when the inside of the bent portion of the flexible tube 500 is excessively narrowed, the suction efficiency may be lowered. Therefore, in order to prevent the suction efficiency from lowering, a shape retaining member (not illustrated) may be coupled to the inside of the flexible tube 500. The shape retaining member may be formed in a helical coil spring shape to be coupled along a helical groove formed in the inner surface of the flexible tube 500. Here, the helical groove corresponds to the inner side of the helical protrusion formed on the outer circumferential surface of the flexible tube 500.

Also, the flexible tube 500 may not be provided with the shape retaining member. In this case, the flexible tube 500 may be made of a material capable of maintaining a predetermined strength, or may be formed in a bellows shape that is easy to expand and contract and to bend.

In the fixed mode, the cyclone S1, the flexible tube 500, and the suction motor 250 may be arranged in a line. In this case, the center axis X1 (see FIG. 10) of the cyclone S1 and the center axis X2 (see FIG. 10) of the suction motor 250 may be arranged parallel to each other or concentrically. In addition, in the rotation mode, the center axis X1 of the cyclone S1 and the center axis X2 of the suction motor 250 may be arranged at an obtuse angle.

Hereinafter, the structures of the first part 100 and the second part 200 of the handy-stick type vacuum cleaner 10 will be described in detail with reference to FIGS. 10 to 14.

Figure 10:
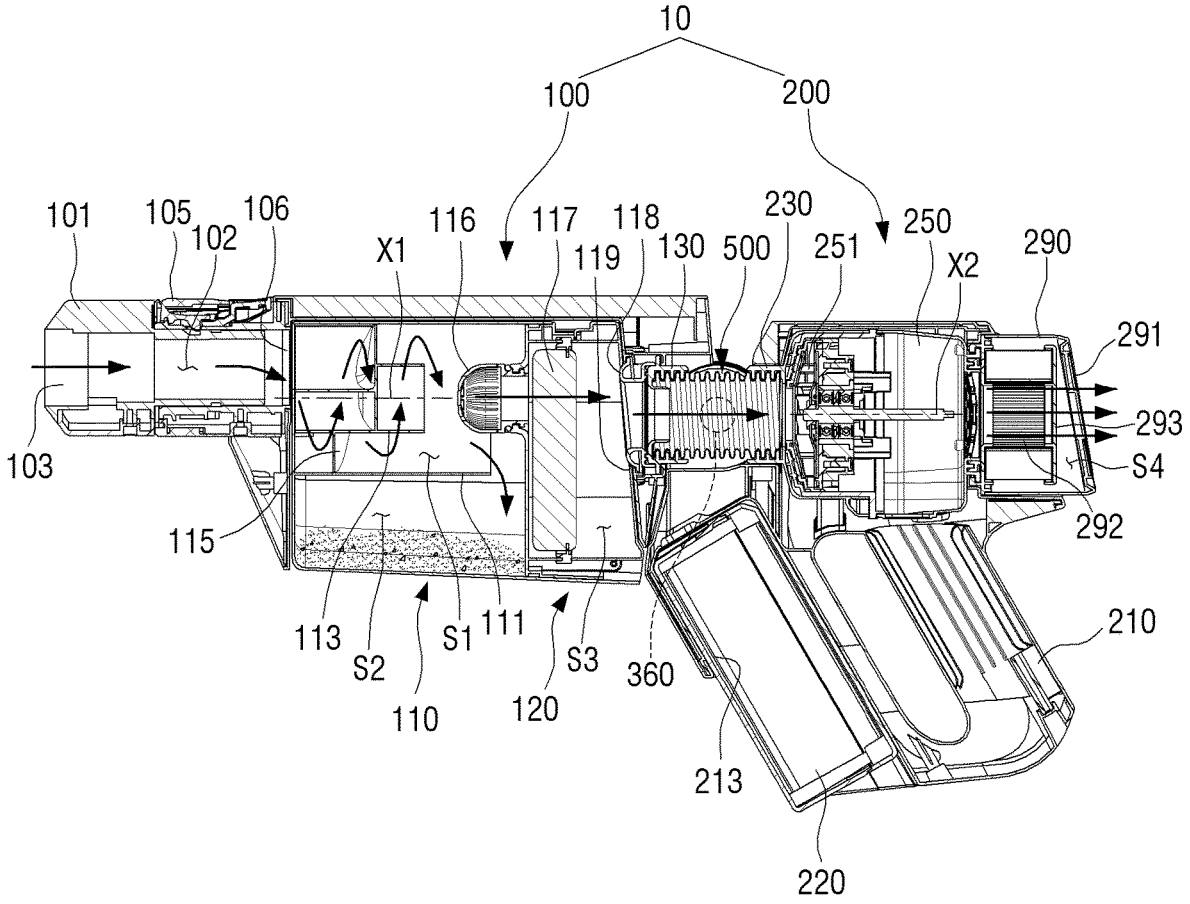
FIG. 10 is a cross-sectional view illustrating a handy-stick type vacuum cleaner according to an embodiment of the present disclosure.
Figure 11A:
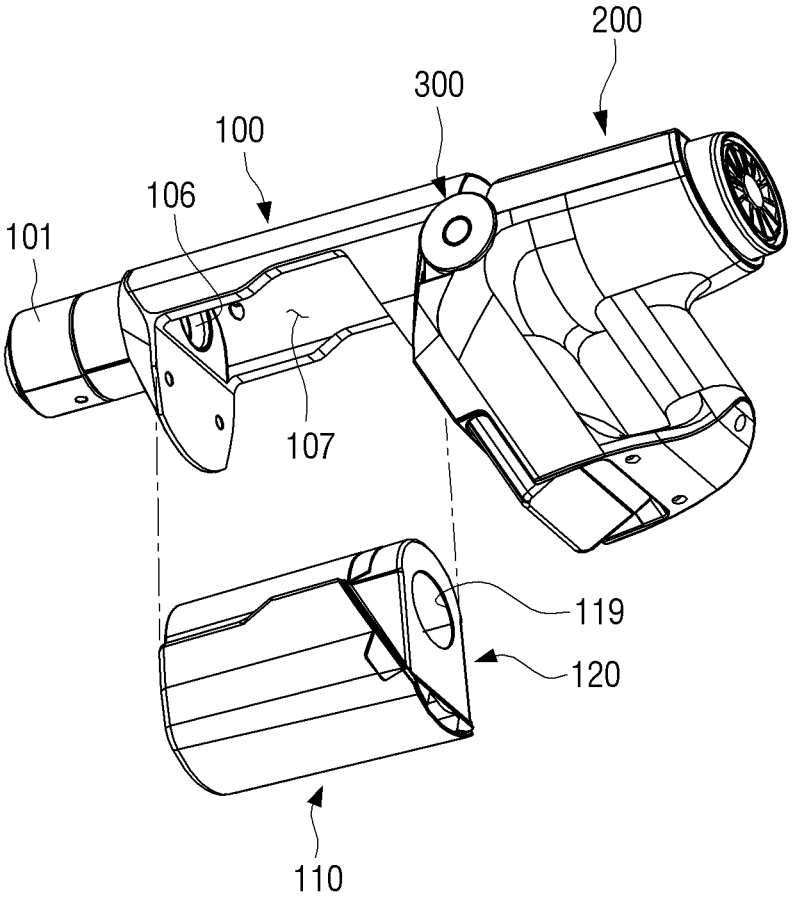
FIG. 11*a* is an exploded perspective view illustrating a state in which a dust collecting member and a filter member are separated from a mounting space of a first part.
Figure 15:
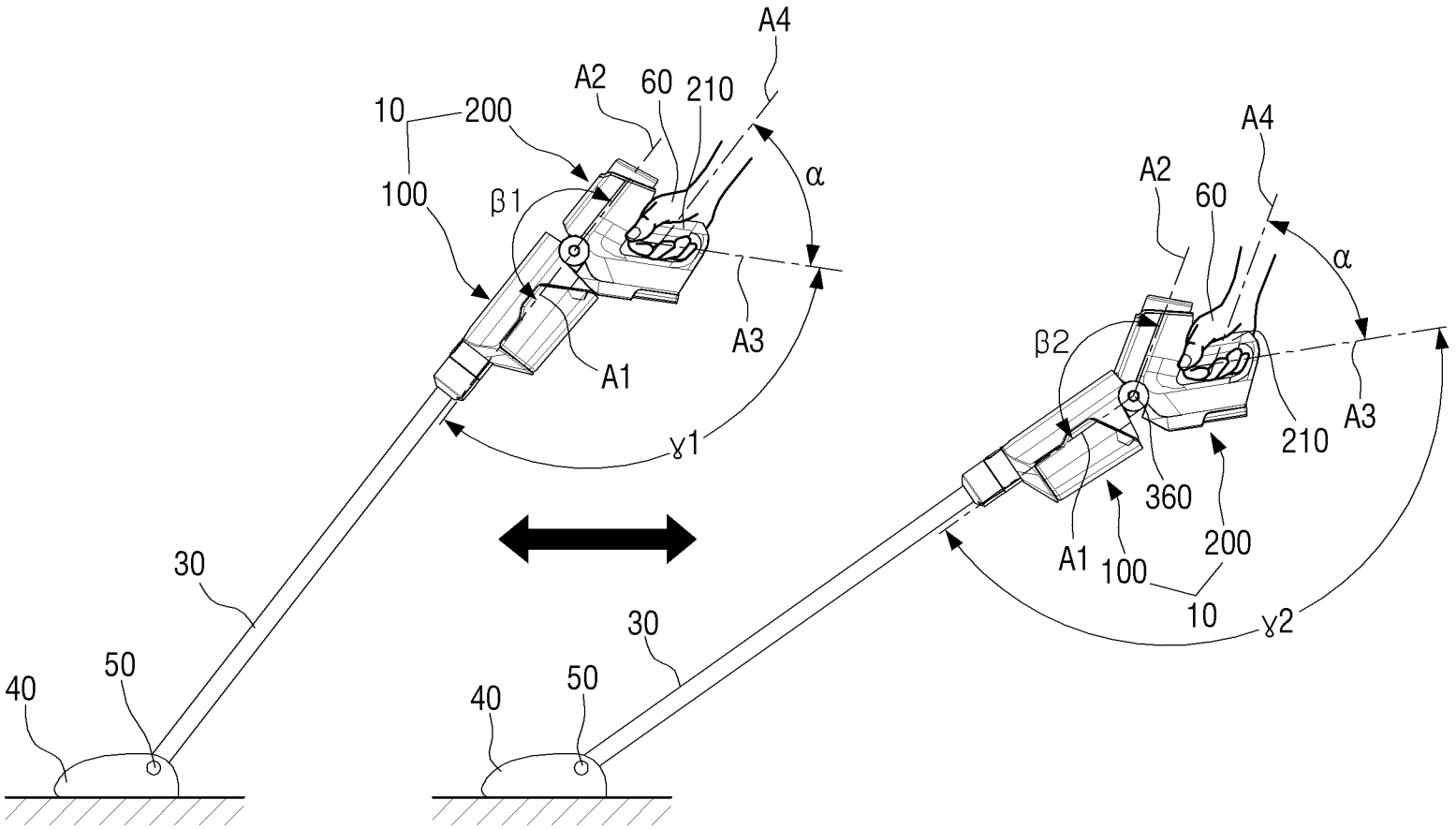
FIG. 15 is a view illustrating a case of cleaning with a handy-stick type vacuum cleaner according to an embodiment of the present disclosure to which an extension pipe connected with a suction nozzle is coupled.

Referring to FIGS. 10 and 11*a*, the first part 100 is provided with a suction hole 103 through which air including dust is introduced on one end of the front end 101 thereof. When an extension pipe 30 is used for cleaning as illustrated in FIG. 15, one end of the extension pipe 30 may be inserted into the suction hole 103 and mounted to an inner passage 102 of the front end 101. The suction hole 103 is provided at one end of the inner passage 102, and a discharge hole 106 is provided at the other end of the inner passage 102. A locking button 105 for locking or unlocking the one end of the extension pipe 30 may be disposed at the outer surface of the front end 101.

Although not illustrated, the front end 101 of the first part 100 may be formed to have a diameter smaller than the diameter of the one end of the extension pipe 30, and the front end 101 of the first part 100 may be inserted into the one end of the extension pipe 30 in a detachable manner. In this case, the locking button 105 may be provided at one end of the extension pipe 30.

The first part 100 is provided with a mounting space 107 in which the dust collecting member 110 and the filter member 120 are detachably mounted. The mounting space 107 is in fluid communication with the inner passage 102 of the front end 101 through the discharge hole 106 formed in the one side surface thereof. In addition, the mounting space 107 is provided with a grill filter 116 for filtering dust on the opposite side of the discharge hole 106.

Figure 12:
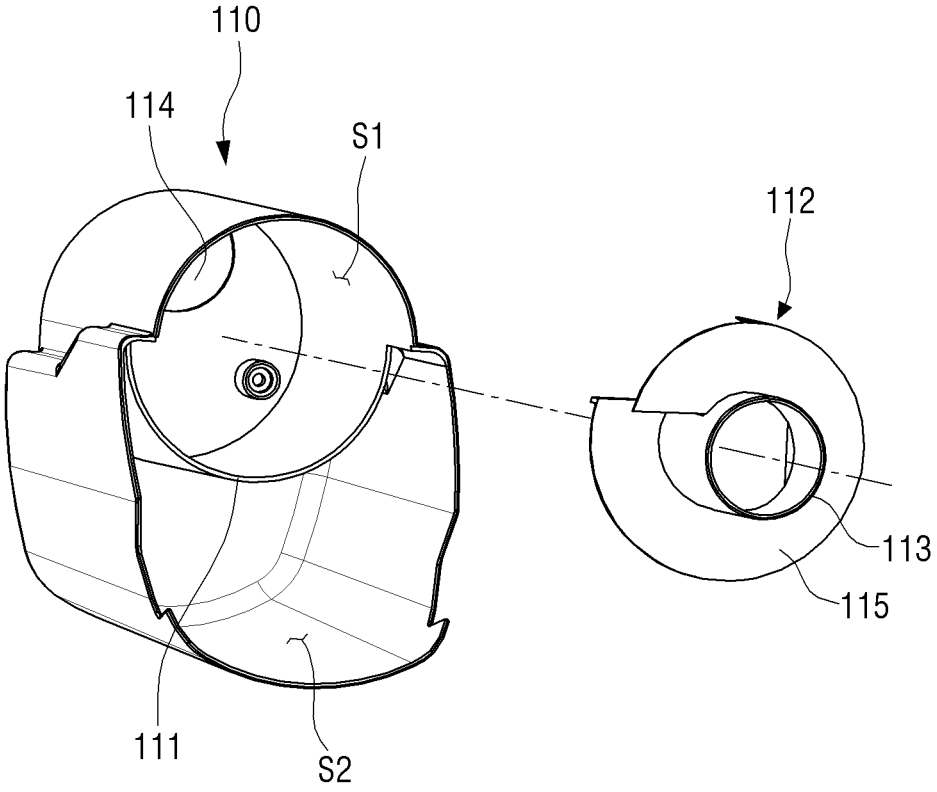
FIG. 12 is an exploded perspective view illustrating a state in which a swirl guide member is separated from a dust collecting member.

Referring to FIG. 12, the inside of the dust collecting member 110 is partitioned into the cyclone S1 and a dust collection chamber S2 by a partition wall 111.

The cyclone S1 may be formed in a cylindrical shape to form a swirl flow with a swirl guide member 112. Further, the cyclone S1 is in fluid communication with an inflow hole 114 formed in one side of the dust collecting member 110. The inflow hole 114 is arranged to correspond to the discharge hole 106 so that the inner passage 102 of the front end 101 is in fluid communication with the cyclone S1.

The swirl guide member 112 for swirling air introduced into the cyclone S1 through the inflow hole 114 is disposed in the cyclone S1. The swirl guide member 112 includes a cylindrical part 113 and a helical blade 115 formed in a helical direction along the outer circumferential surface of the cylindrical part 113. The helical blade 115 forms a helical passage with the inner wall of the cyclone S1.

The dust collection chamber S2 is in fluid communication with the cyclone S1 through a passage through which the dust separated from air by the centrifugal force is discharged from the cyclone S1.

Referring again to FIG. 10, the filter member 120 may include the grill filter 116 disposed to be partially inserted into the cyclone S1 and a filter chamber S3 provided behind the grill filter 116 and in which an additional filter 117 is disposed. A ring-shaped packing 118 coupled to the first coupling member 130 is disposed on one side surface of the filter chamber S3. In this case, the first coupling member 130 may be rotatably coupled to the packing 118, wherein the first coupling member 130 and the packing 118 are tightly contacted to each other to maintain airtightness. The packing 118 maintains the airtightness between the filter chamber S3 and the first coupling member 130. The packing 118 is in fluid communication with a through hole 119 formed in the rear wall of the filter member 120 so that air may move from the filter chamber S3 to the flexible tube 500.

Figure 11B:
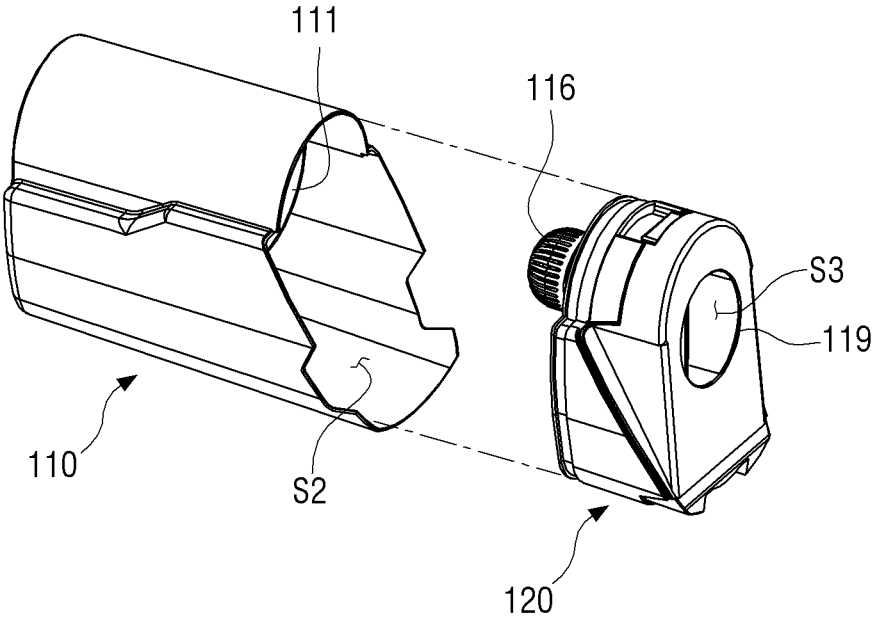
FIG. 11*b* is an exploded perspective view illustrating a state in which a filter member is separated from a dust collecting member.

Referring to FIG. 11*a*, the filter member 120 may be detachably mounted to the mounting space 107 of the first part 100 together with the dust collecting member 110. Further, the filter member 120 separated from the mounting space 107 may be separated from the dust collecting member 110 as illustrated in FIG. 11*b*.

Figure 13:
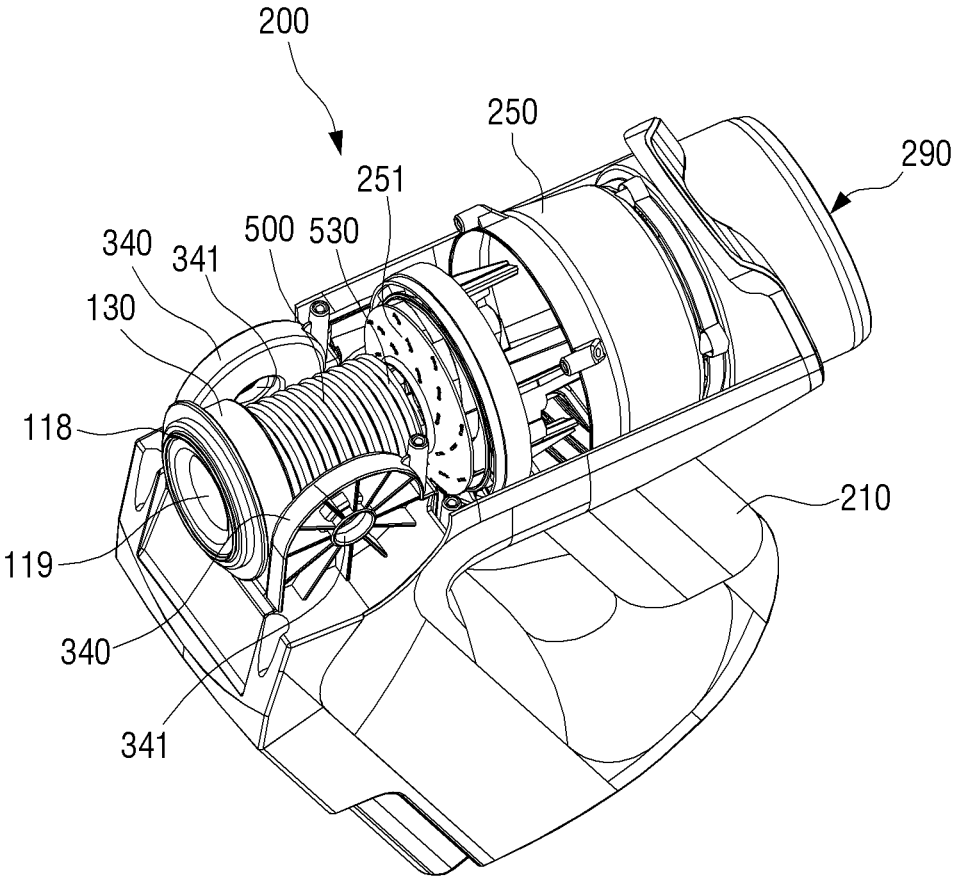
FIG. 13 is a schematic perspective view illustrating an arrangement relationship between a flexible tube and an impeller of a suction motor disposed in a second part.

Referring to FIG. 13, the suction motor 250 is disposed inside the second part 200. The inlet of the suction motor 250 is disposed to communicate with the other end 530 of the flexible tube 500. The suction motor 250 discharges the air introduced into the inlet of the suction motor 250 through the impeller 251 to the rear side of the second part 200.

Because the through hole 119 and the one end 510 of the flexible tube 500 are connected to each other at the rear end of the first part 100 and the other end 530 of the flexible tube 500 is connected to the inlet of the suction motor 250 at the front end of the second part 200, the air filtered in the first part 100 is sucked into the second part 200 through the flexible tube 500, and then discharged to the outside through an exhaust chamber S4.

Figure 14:
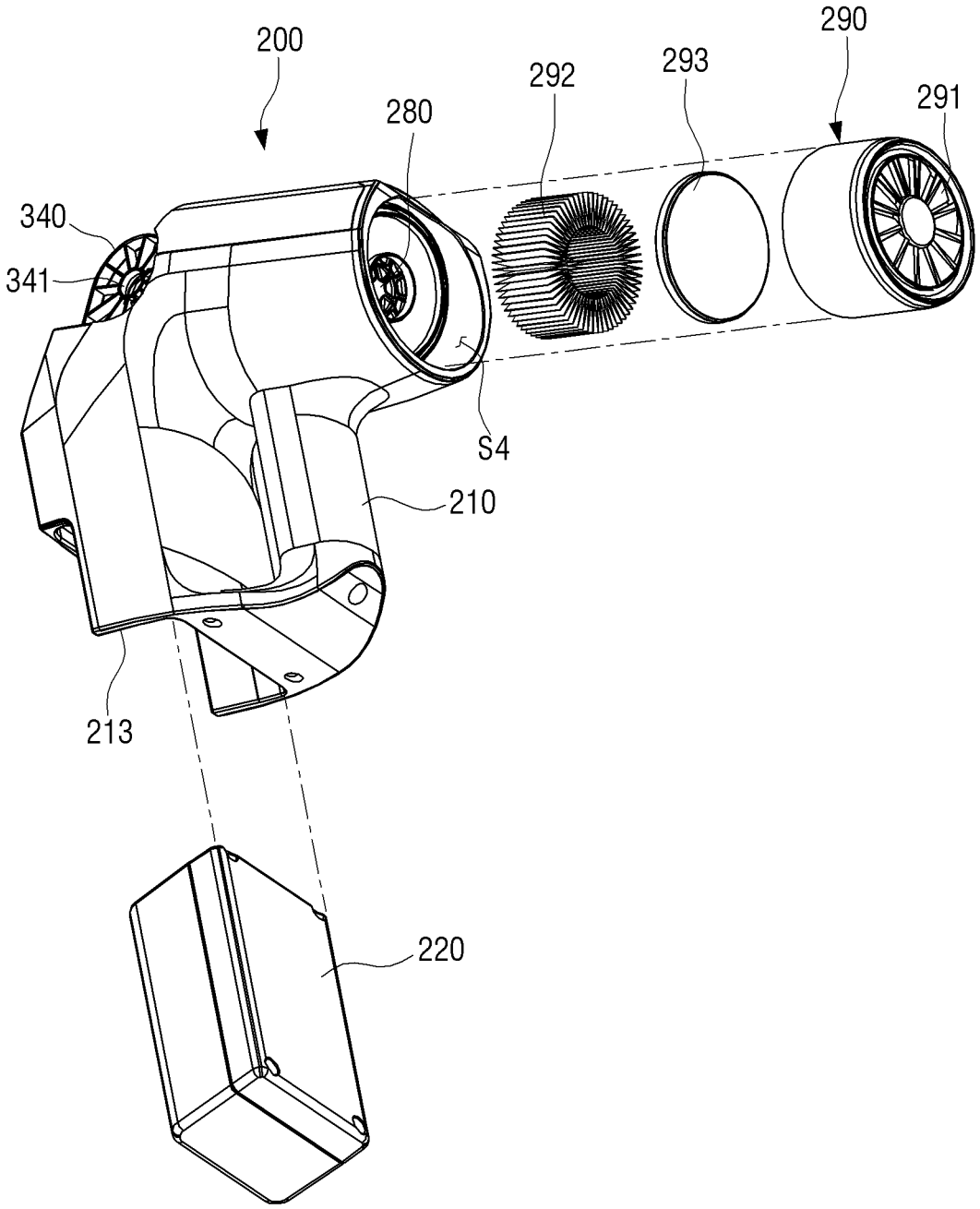
FIG. 14 is an exploded perspective view illustrating a state in which an exhaust filter and a battery are separated from a second part.

Referring to FIG. 14, the exhaust chamber S4 is formed at the rear side of the second part 200. A through hole 280 is formed in one side surface of the exhaust chamber S4 so that the air discharged from the suction motor 250 flows into the exhaust chamber S4. Further, the exhaust chamber S4 may be provided with an exhaust filter 292 for filtering the fine dust introduced into the exhaust chamber S4. The exhaust filter 292 may be a HEPA filter capable of filtering fine dust or ultrafine dust.

The exhaust filter 292 may be formed in a substantially ring shape, and a shutoff cap 293 may be coupled to the rear surface of the exhaust filter 292. The shutoff cap 293 blocks the rear surface of the exhaust filter 292 and guides the air to be discharged through the side surface of the exhaust filter 292.

An exhaust cover 290 is disposed at the rear side of the second part 200 to enclose the exhaust filter 292. A plurality of ribs 291 are arranged in the circumferential direction on the rear surface of the exhaust cover 290. Each of the ribs 291 may be inclined at a predetermined angle so as to form an air venting gap between two adjacent ribs. Accordingly, the air discharged to the outside of the second part 200 through the exhaust cover 290 is discharged while being dispersed in the circumferential direction.

On the other hand, the second part 200 may be provided with the handle 210 extended from the portion where the suction motor 250 is provided. Also, the second part 200 may be provided with a battery mounting groove 213 in which a rechargeable battery 220 is mounted in front of the handle 210.

Hereinafter, the operation of the handy-stick type vacuum cleaner according to an embodiment of the present disclosure will be described.

FIG. 15 is a view illustrating a case of cleaning with a handy-stick type vacuum cleaner according to an embodiment of the present disclosure to which an extension pipe connected with a suction nozzle is coupled.

Referring to FIG. 15, a user may connect the extension pipe 30 to the front end 101 of the handy-stick type vacuum cleaner 10 and then move the handy-stick type vacuum cleaner 10 forward and backward repeatedly while holding the handle 210 with the hand 60 to clean the floor. The suction nozzle 40 may be hingedly connected to the lower end of the extension pipe 30 by a rotary shaft 50.

When cleaning is performed while the handy-stick type vacuum cleaner 10 is repeatedly moved forward and backward, the first part 100 is rotated clockwise and counterclockwise with respect to the second part 200 about the rotation shafts 360. At this time, the angle between the first axis A1 and the second axis A2 may be continuously varied between the first angle $\beta 1$ and the second angle $\beta 2$.

However, while the handy-stick type vacuum cleaner 10 is repeatedly moved forward and backward for the cleaning, the angle $\alpha$ between the third axis A3 along the longitudinal direction of the handle 210 and the fourth axis A4 extending from the user's hand 60 to the bottom arm may be kept constant or may be changed by a fine degree.

Because the angle between the third axis A3 and the fourth axis A4 is maintained substantially constant, the user may smoothly perform the cleaning while holding the handle 210 without bending or twisting the wrist during cleaning.

At this time, as illustrated in FIG. 15, the angle $\gamma 2$ between the first axis A1 and the third axis A3 may also be varied by the predetermined angle $\theta$ as described above with reference to FIG. 2. In other words, the angle $\gamma 2$ in the rotation mode is larger than the angle $\gamma 1$ in the fixed mode.

Further, the angle between the third axis A3 and the center axis X1 (see FIG. 10) of the cyclone S1 may also be varied, and the angle in the rotation mode is larger than the angle in the fixed mode.

As described above, in the handy-stick type vacuum cleaner 10 according to an embodiment of the present disclosure, because the second part 200 provided with the handle 210 is rotatably connected to the first part 100, the user does not need to take the action of bending or twisting the wrist of the hand holding the handle 210 during cleaning. Therefore, the load applied to the wrist during cleaning is greatly reduced, so that the cleaning may be performed comfortably.

On the other hand, the handy-stick type vacuum cleaner 10 according to an embodiment of the present disclosure may be provided with a dust collecting member 600 having a structure capable of effectively discharging thin and flexible filth such as human hair or hair of pets from the dust collecting member instead of the above-described dust collecting member 110. Hereinafter, the dust collecting member 600 provided in the handy-stick type vacuum cleaner 10 according to an embodiment of the present disclosure will be described in detail with reference to FIGS. 16 and 26.

Figure 16:
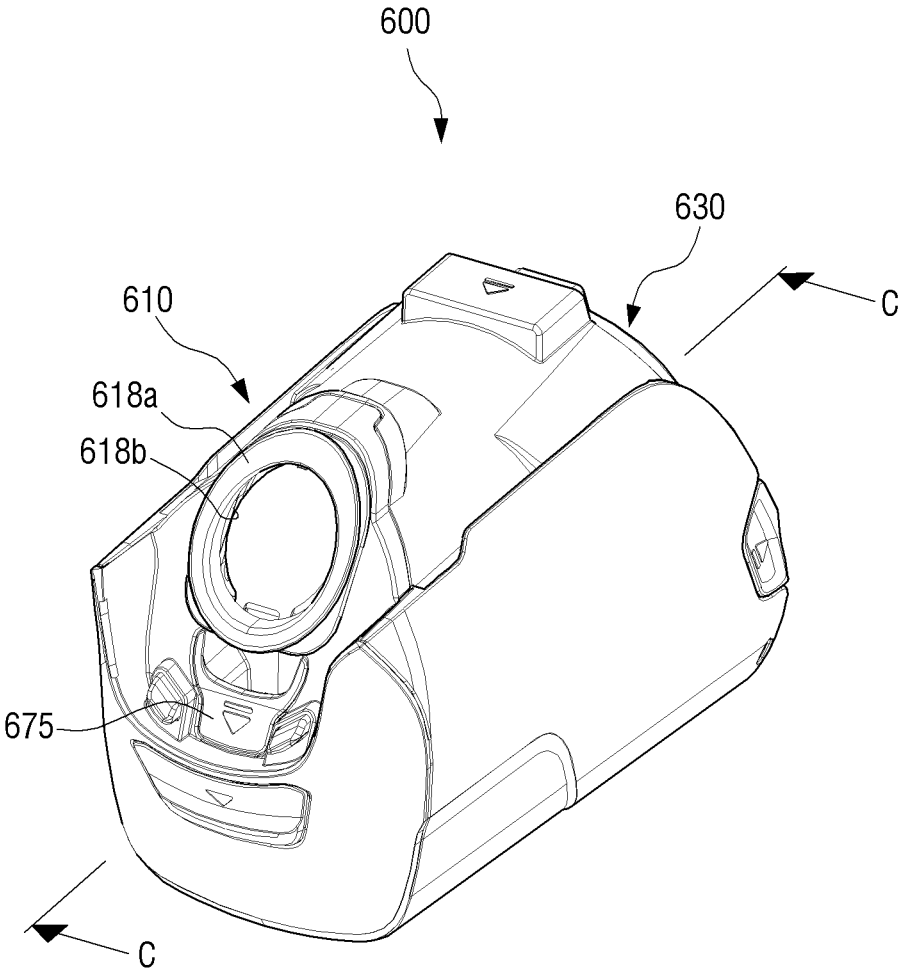
FIGS. 16 and 17 are an assembled perspective view and an exploded perspective view illustrating a dust collecting member according to another example.

Referring to FIG. 16, the dust collecting member 600 may include a container 610 configured to collect dust by separating the dust introduced together with air from air though a centrifugal force and a cover 630 configured to open and close the rear side of the container 610.

The front surface of the container 610 is provided with an air inlet hole 618 through which air containing dust is sucked from the discharge hole 106 (see FIG. 10) of the first part 100. A first sealing member 618*a* is coupled along the inner circumference of the air inlet hole 618. Thus, air is prevented from leaking between the discharge hole 106 of the first part 100 and the air inlet hole 618. The first sealing member 618*a* is formed with a hole 618*b* through which the discharge hole 106 of the first part 100 and the air inlet hole 618 communicate with each other.

A handle 675 of a grill filter member 670, which will be described later, is disposed in a state of being exposed around the air inlet hole 618 of the container 610. Accordingly, the user may easily access the handle 675 when the grill filter member 670 is to be operated. The grill filter member 670 is disposed to be linearly movable inside the container 610 so as to easily separate the hair wound on the outside of a grill portion 671. The configuration and operation of the grill filter member 670 will be described later.

Figure 17:
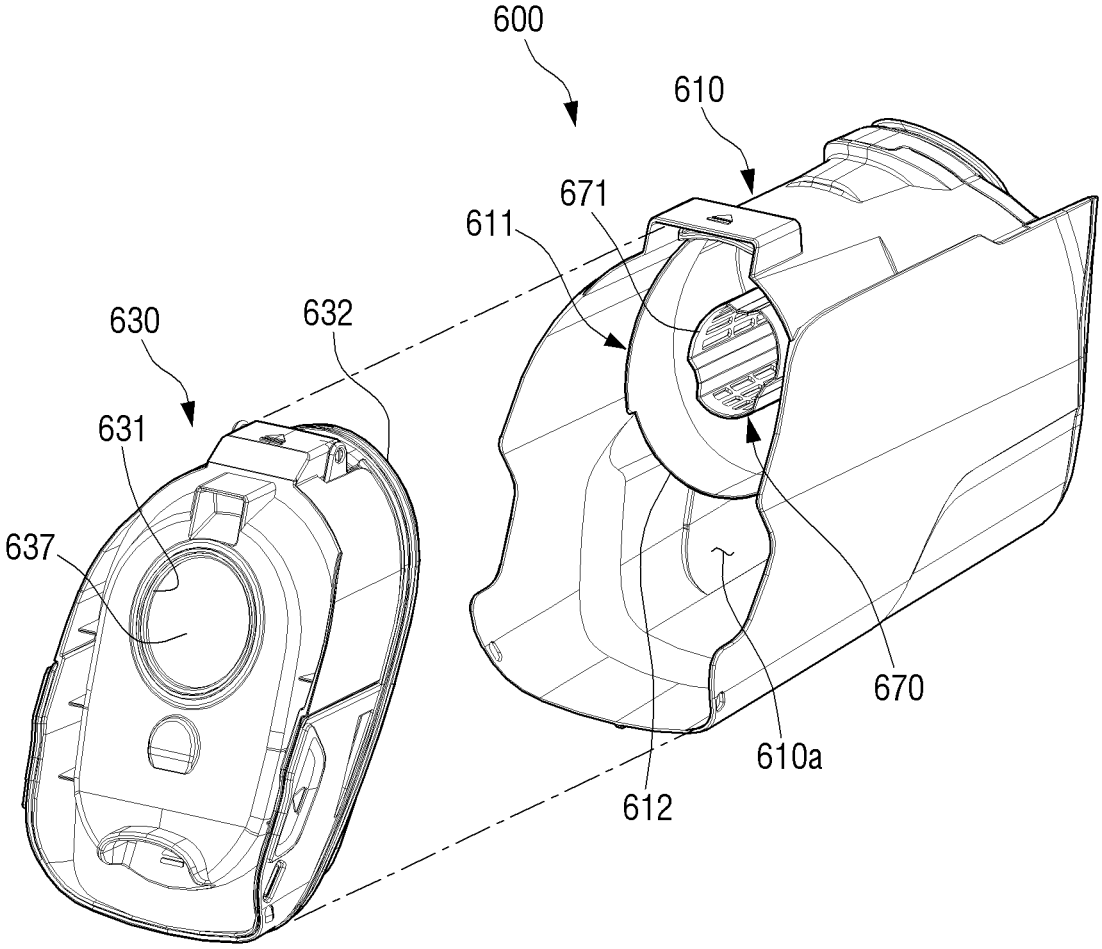

Referring to FIG. 17, the cover 630 is detachably coupled to the rear side of the container 610 which is open. The container 610 and the cover 630 are mounted to the mounting space 107 (see FIG. 11) of the first part 100 of the handy-stick type vacuum cleaner 10 while being coupled to each other. In this case, a sealing member 632 is coupled along the outer periphery of the side surface of the cover 630 coupled with the container 610. The sealing member 632 prevents air from leaking between the container 610 and the cover 630 in a state where the cover 630 is coupled to the rear side of the container 610, thereby preventing a pressure loss. On the other hand, when the dust collected in the container 610 is discharged, the cover 630 is detached from the container 610 to open the rear side of the container 610.

A cyclone 611 is disposed inside the container 610, and a dust collecting chamber 610*a* in which dust discharged from the cyclone 611 is collected is provided outside the cyclone 611.

Figure 19:
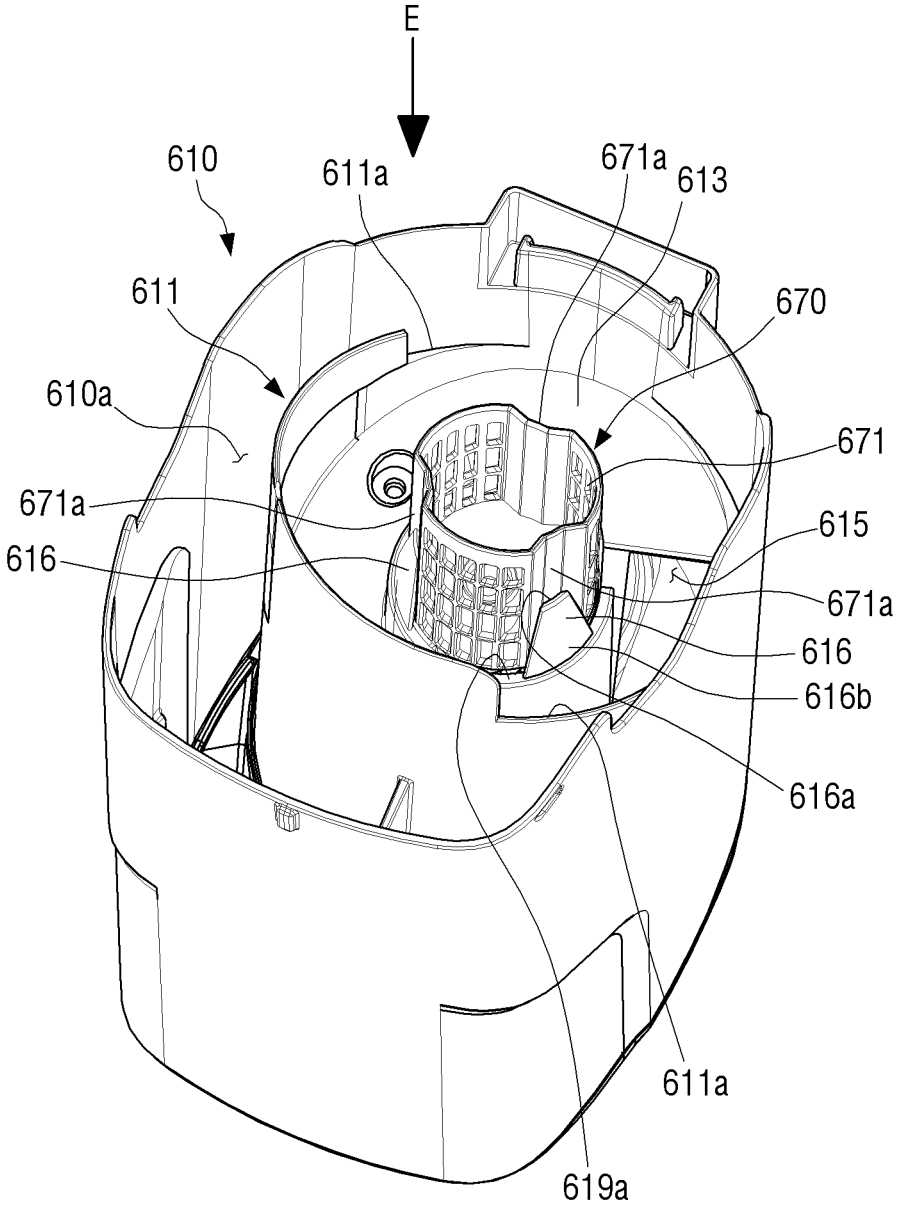
FIG. 19 is a perspective view illustrating a case in which a grill filter member mounted to a container of a dust collecting member is disposed at a basic position.

A plurality of dust discharging portions 611*a* are formed by cutting portions of the upper end of the cyclone 611 so that the dust centrifugally separated in the inside of the cyclone 611 may be discharged to the dust collecting chamber 610*a* (see FIG. 19). In this case, the dust discharging portion 611*a* may be formed in a single, not in a plurality. The dust discharging portions 611*a* are a passage for communicating the inside of the cyclone 611 and the dust collecting chamber 610*a*.

Figure 18:
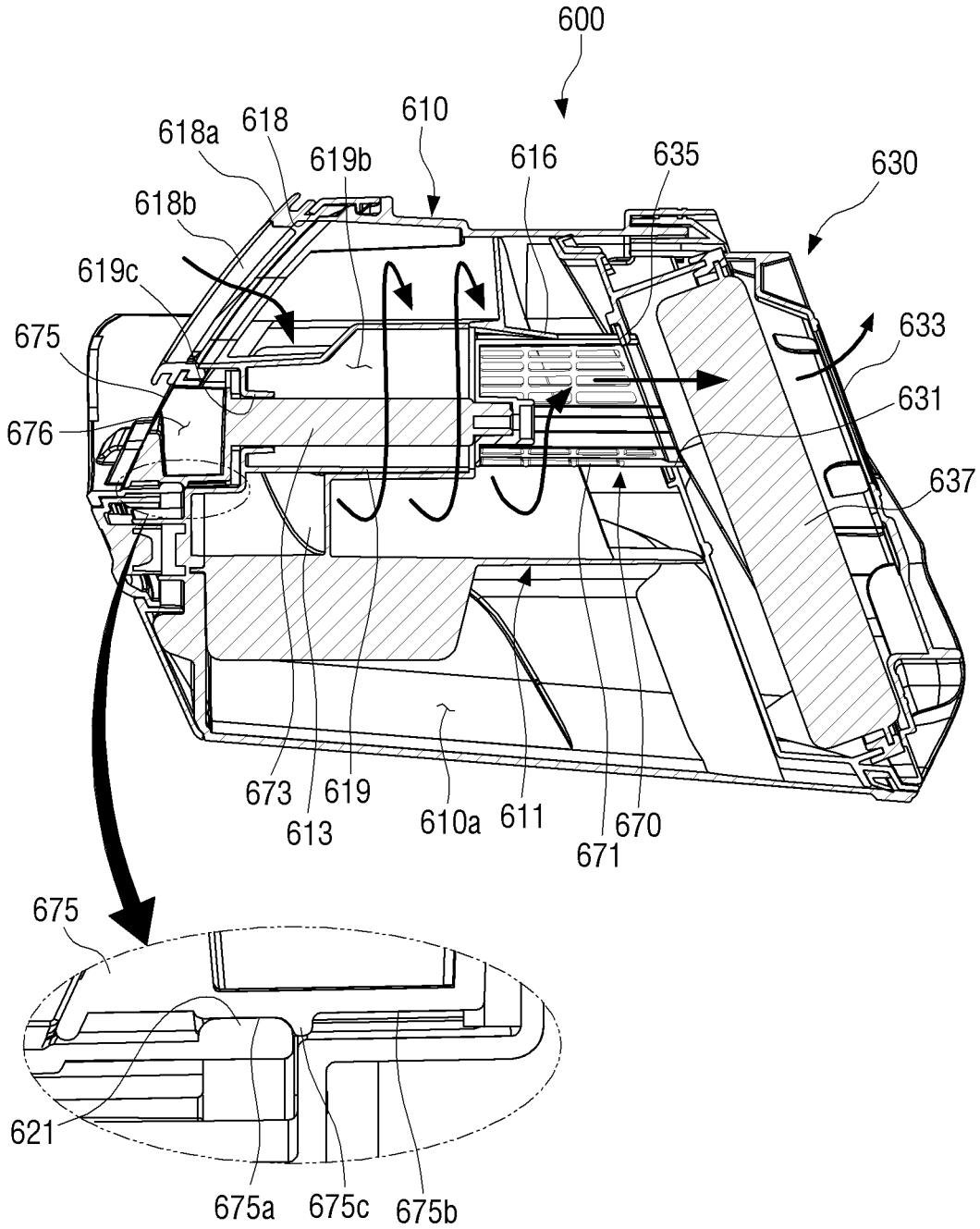
FIG. 18 is a cross-sectional view illustrating the dust collecting member taken along line C-C illustrated in FIG. 17.

Referring to FIG. 18, the grill filter member 670 is arranged inside the cyclone 611 to be able to move forward and backward along the axial direction of the cyclone 611. A cylindrical guide pipe 619 is formed along the axial direction at an inner center of the cyclone 611 and a helical guide 613 is formed between the outer circumferential surface of the guide pipe 619 and the inner circumferential surface of the cyclone 611 in the helical direction.

The helical guide 613 guides the dust and air introduced into the cyclone 611 through the air inlet hole 618 in the helical direction. The dust and air pass through an entrance hole 615, which is the entrance of the helical guide 613, and then move along the helical guide 613 toward the dust discharging portions 611*a*. At this time, the dust is introduced into the dust collecting chamber 610*a* through the dust discharging portions 611*a* by the centrifugal force.

Figure 20:
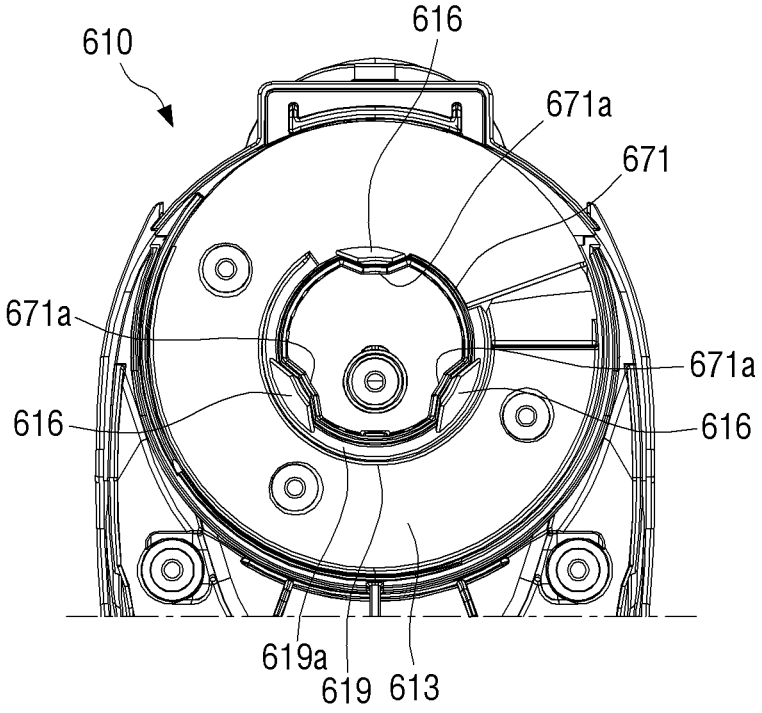
FIG. 20 is a view illustrating the container of the dust collecting member in the direction of arrow E in FIG. 19.
Figure 21:
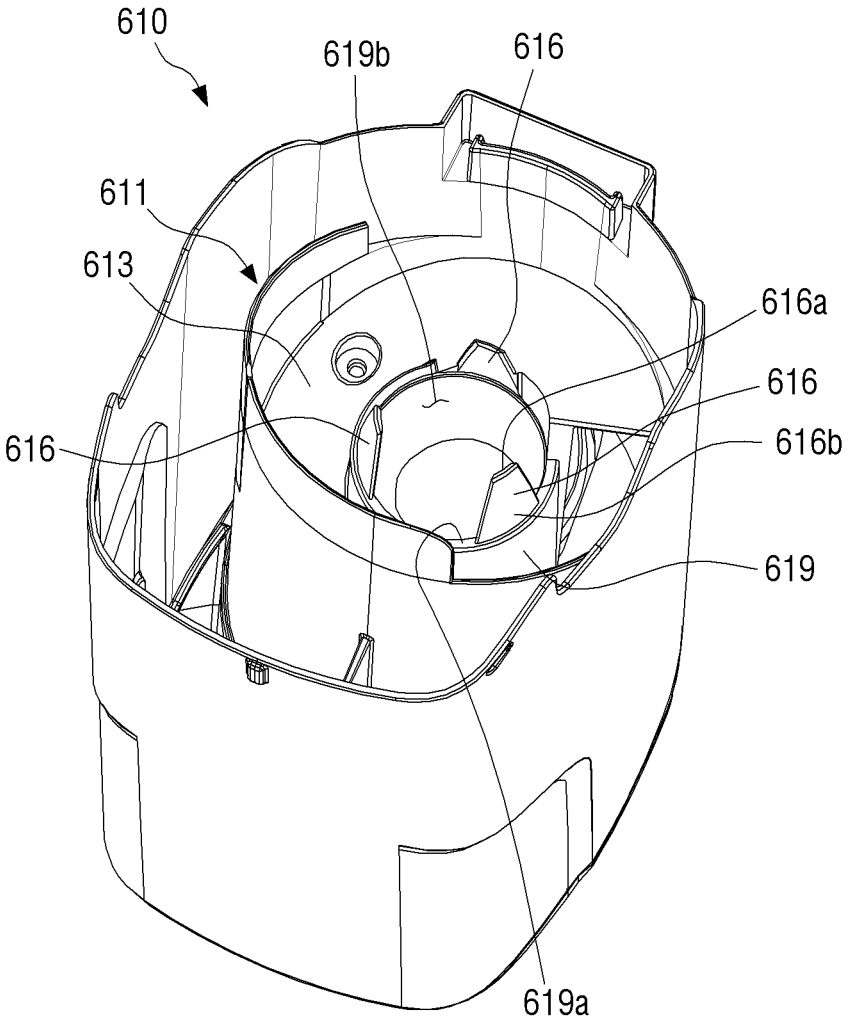
FIG. 21 is a perspective view illustrating a plurality of locking protrusions positioned inside the container of the dust collecting member when the grill filter member shown in FIG. 19 is removed.

Referring to FIGS. 19 to 21, the guide pipe 619 is provided with a plurality of catching protrusions 616 protruding from the tip 619*a* of the guide pipe 619, and the plurality of catching protrusions 616 are spaced apart from each other at a predetermined interval.

The plurality of catching protrusions 616 are formed in a shape that may easily detach hairs wound on the outer surface of the grill portion 671 of the grill filter member 670 from the outer surface of the grill filter member 670 when the grill filter member 670 is retracted. In other words, the plurality of catching protrusions 616 are inclined at a predetermined angle toward the center of the guide pipe 619, so that the catching protrusions 616 are positioned further inward from the outer surface of the grill portion 671 of the grill filter member 670 toward the tip end 616*a* from the lower end 616*b* of the catching protrusions 616. The grill portion 671 of the grill filter member 670 are formed with a plurality of grooves 671*a* along the longitudinal direction of the grill filter member 670 to correspond to the shape of the plurality of catching protrusions 616.

Further, the plurality of catching protrusions 616 may have a shape gradually widening from the tip end 616*a* to the lower end 616*b*, for example, a rhombic shape or a triangular shape.

When the grill filter member 670 is moved in the backward direction (see the arrow F direction in FIG. 26), the hair 700 (see FIG. 27) wound on the outer surface of the grill portion 671 of the grill filter member 670 is retracted together with the grill portion 671 and is separated from the grill portion 671 while being caught by the outer surfaces of the plurality of catching protrusions 616.

Referring to FIG. 18, the guide pipe 619 is provided therein with a receiving space 619*b* in which the grill portion 671 is accommodated when the grill filter member 670 is retracted. In addition, the guide pipe 619 is formed with a through hole 619*c* through which a connecting rod 673 of the grill filter member 670 passes. With this structure, the guide pipe 619 may guide the grill filter member 670 to move in a linear direction when the grill filter member 670 is moved forward and backward.

Figure 22:
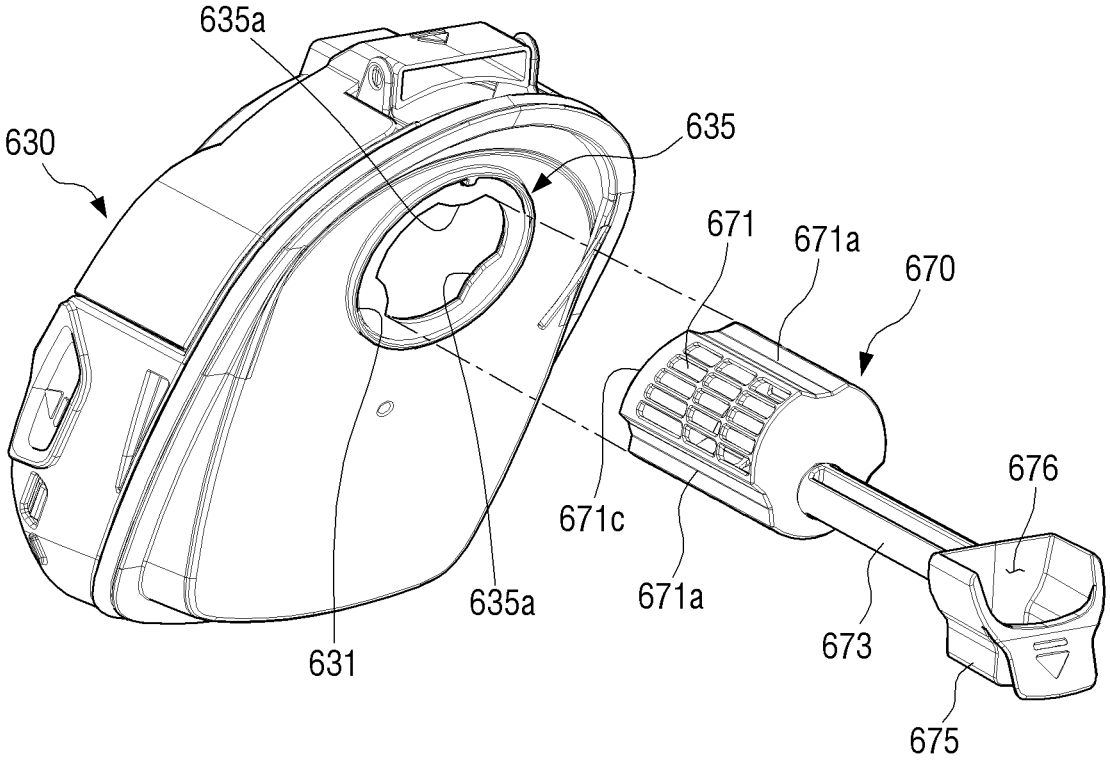
FIG. 22 is a perspective view illustrating a state in which a grill filter member is separated form a cover of a dust collecting member.

Referring to FIG. 22, an inflow hole 631 through which the air that has passed through the grill portion 671 flows into the inside of the cover 630 is formed in the front surface of the cover 630. A ring-shaped gasket 635 for keeping the airtightness between the inflow hole 631 and the grill portion 671 is coupled to the inflow hole 631. The gasket 635 prevents dust and air from flowing into the cover 630 directly through the inflow hole 631 without passing through the grill portion 671.

The gasket 635 is engaged with the grill portion 671 in a pressed state when the tip end 671*c* of the grill portion 671 is inserted. In this case, the gasket 635 is provided with a plurality of sealing protrusions 635*a* corresponding to the plurality of grooves 671*a* along the inner surface so as to prevent air from leaking through the plurality of grooves 671*a* of the grill portion 671.

Referring to FIG. 18, a filter 637 for filtering dust (fine dust) contained in air introduced into the cover 630 through the inflow hole 631 is disposed inside the cover 630.

Referring to FIG. 17, a discharge hole 633 is formed in the rear surface of the cover 630 to discharge air from which fine dust is filtered through the filter 637 to the outside of the cover 630. The discharge hole 633 of the cover 630 may be connected to one end 510 of the flexible tube 500 (see FIG. 4) so as to communicate with the flexible tube 500. In this case, the discharge hole 633 and the one end 510 of the flexible tube 500 may be connected to each other through a medium such as the first coupling member 130 as described above (see FIG. 3).

The dust collecting member 600 may be detachably mounted in the mounting space 107 of the first part 100. In this case, the discharge hole 106 of the first part 100 is connected to the air inlet hole 618 of the dust collecting member 600, and the discharge hole 633 of the dust collecting member 600 is connected to the flexible tube 500, thereby forming a flow path. The flexible tube 500 may be disposed inside the third part.

In the fixed mode, the cyclone 611, the flexible tube 500 (see FIG. 10), and the suction motor 250 (see FIG. 10) may be arranged in a line. In this case, the center axis (not illustrated) of the cyclone 611 and the center axis X2 (see FIG. 10) of the suction motor 250 may be arranged parallel to or concentrically with each other. Also, in the rotation mode, the center axis of the cyclone 611 and the center axis X2 of the suction motor 250 may be arranged at an obtuse angle.

Figure 23:
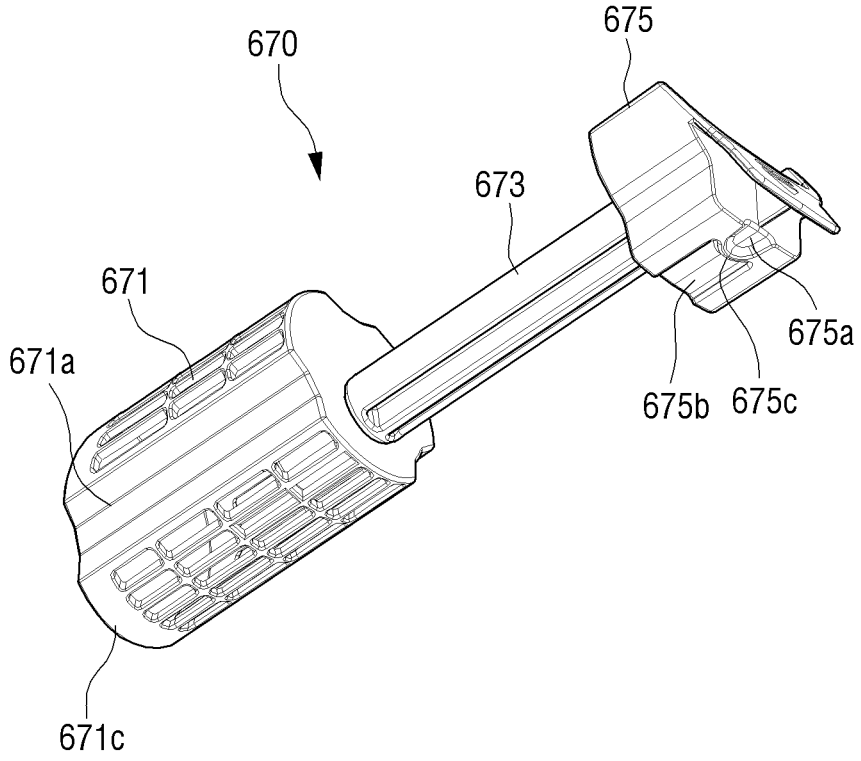
FIG. 23 is a perspective view illustrating a grill filter member.

Referring to FIG. 23, the grill filter member 670 may include the grill portion 671 for filtering dust, the handle 675 for moving the grill portion 671, and the connecting rod 673 for connecting the grill portion 671 and the handle 675.

The grill portion 671 may be formed in a cylindrical shape having a plurality of holes to filter dust, hair, and the like having a larger size than fine dust. The grill portion 671 has the front surface which is opened and the rear surface to which one end of the connecting rod 673 is connected and which is closed.

The front surface of the handle 675 is connected to the other end of the connecting rod 673, and the rear surface of the handle 675 is exposed to the rear side of the container 610 (see FIG. 16). A receiving groove 676 (see FIG. 22) may be formed on the rear surface of the handle 675 so as to be able to be hooked and pulled by a finger or the like.

Figure 24:
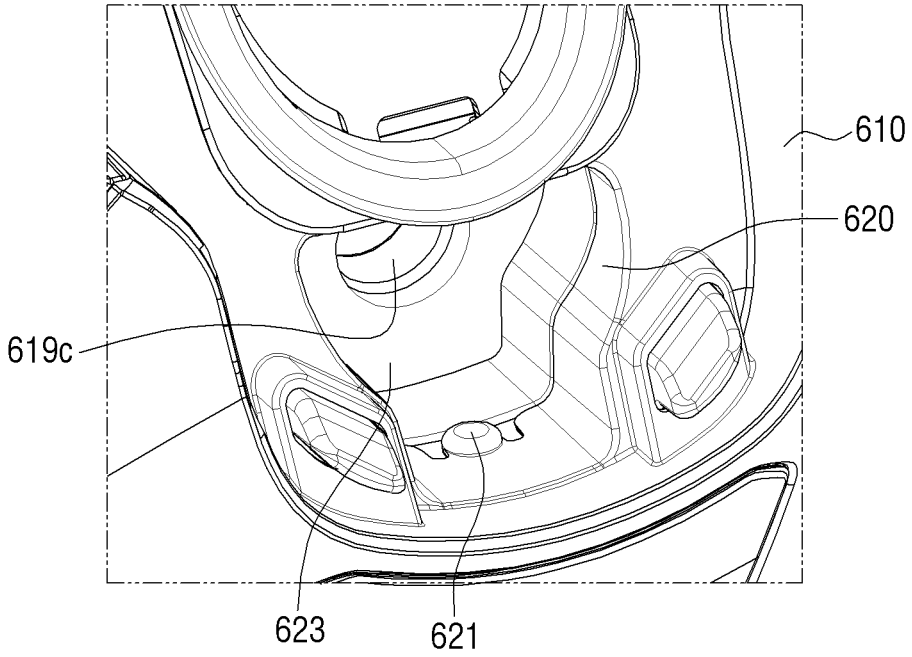
FIG. 24 is a partially enlarged perspective view illustrating an engaging protrusion of a container snap-engaged with a part of a grill filter member.
Figure 25:
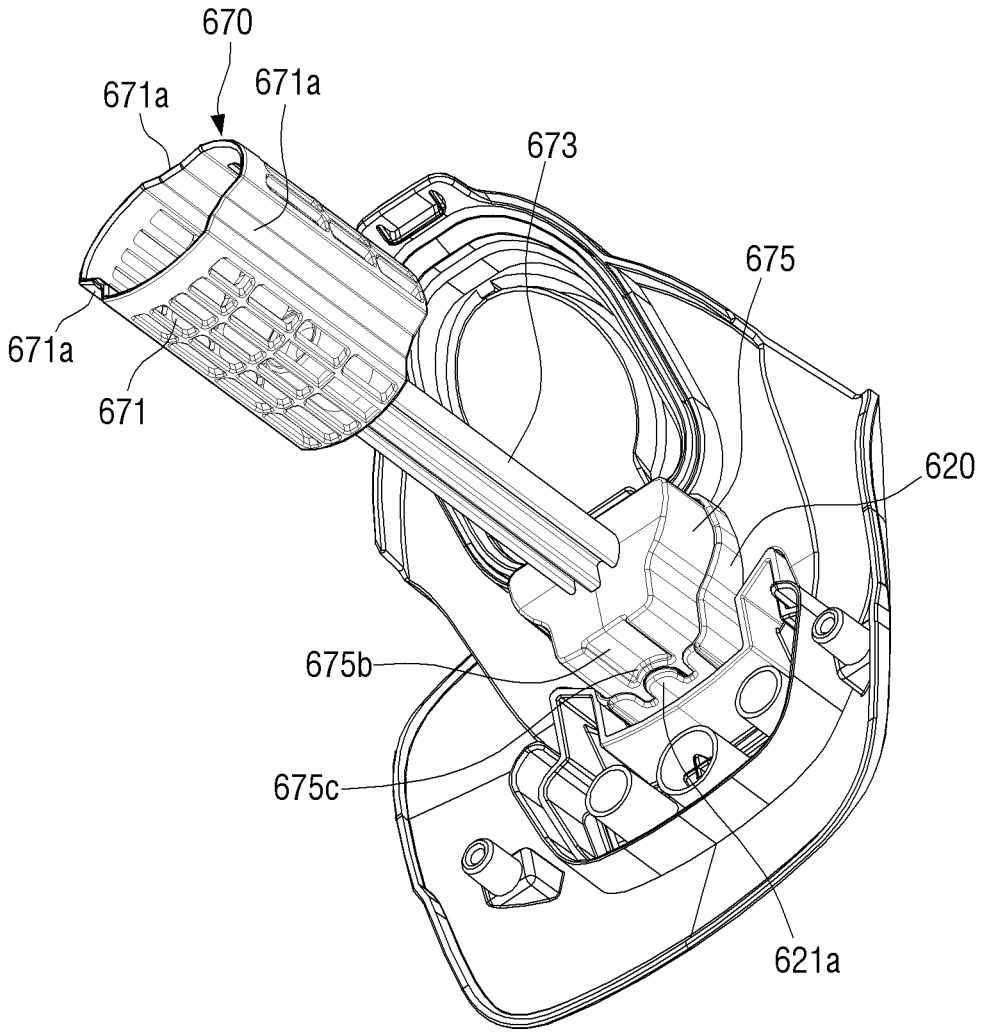
FIG. 25 is a perspective view illustrating a state in which a portion of a grill filter member and an engaging protrusion of a container are snap-engaged with each other.
Figure 26:
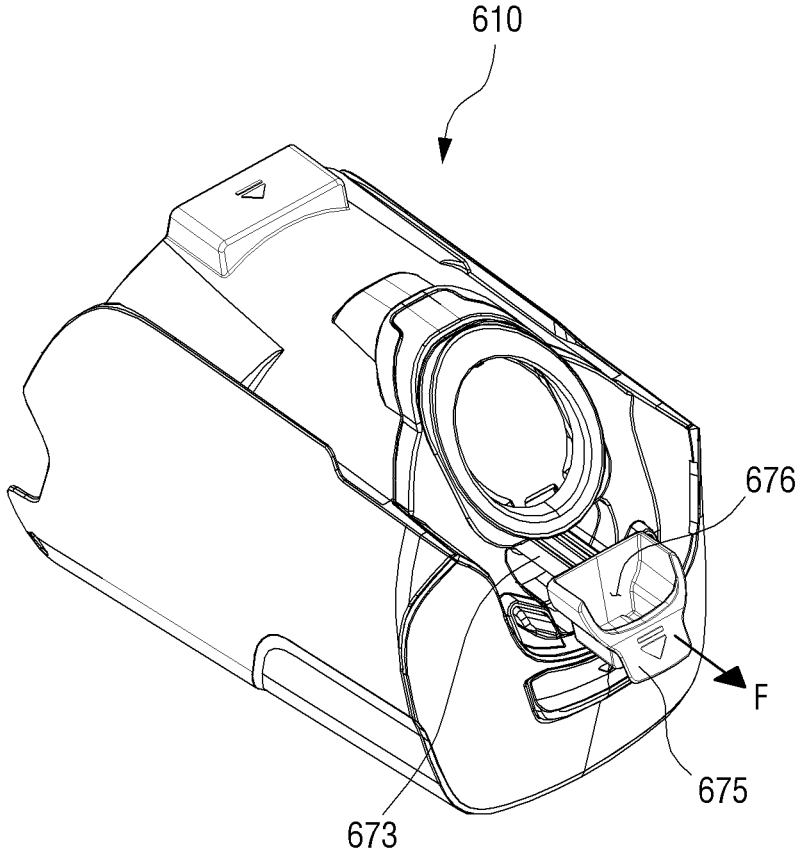
FIG. 26 is a perspective view illustrating a state in which a grill filter member is pulled in a direction of arrow F.

An engaging groove 675*a* and a latching jaw 675*c* for holding the position (hereinafter, the filtering position) where the grill portion 671 of the grill filter member 670 is pressed against and coupled to the gasket 635 are formed on the bottom surface of the handle 675. In the filtering position, an engaging protrusion 621 provided in the container 610 as illustrated in FIG. 24 may be snap-engaged with the engaging groove 675*a*. The engaging protrusion 621 is formed on the bottom surface of the guide member 620 in which the handle 675 is received. The engaging protrusion 621 may be formed on a projecting part 621*a* having a cantilever shape as illustrated in FIG. 26 so as to be snap-engaged with the engaging groove 675*a*.

The latching jaw 675*c* prevents the grill filter member 670 from backing itself when the user does not pull the handle 675 at the filtering position.

A guide groove 675*b* is formed in the bottom surface of the handle 675 and is partitioned from the engaging groove 675*a* by the latching jaw 675*c*. The guide groove 675*b* is formed along the moving direction of the grill filter member 670 so that when the snap engagement between the engaging groove 675*a* and the engaging protrusion 621 is released by pulling the handle 675 in the direction of arrow F as illustrated in FIG. 26, the bottom surface of the handle 675 does not interfere with the engaging protrusion 621. The width and depth of the guide groove 675*b* may be larger than the width and height of the engaging protrusion 621, respectively.

The grill filter member 670 may have a length so that the tip end 671*c* of the grill portion 671 is pressed and engaged with the gasket 635 when the engaging groove 675*a* of the handle 675 is snap-engaged with the engaging protrusion 621. The length of the grill filter member 670 may be the length from the front surface of the grill portion 671 to the engaging groove 675*a* of the handle 675.

One end of the connecting rod 673 is connected to the rear surface of the grill portion 671, and the other end of the connecting rod 673 is connected to the front surface of the handle 675. The connecting rod 673 always remains in a state of passing through the through hole 619*c* (see FIG. 18) of the container 610.

Hereinafter, a process of separating the hair wound on the outer surface of the grill portion 671 from the grill portion 671 and discharging the hair from the container 610 will be described with reference to FIGS. 27 to 29.

Figure 27:
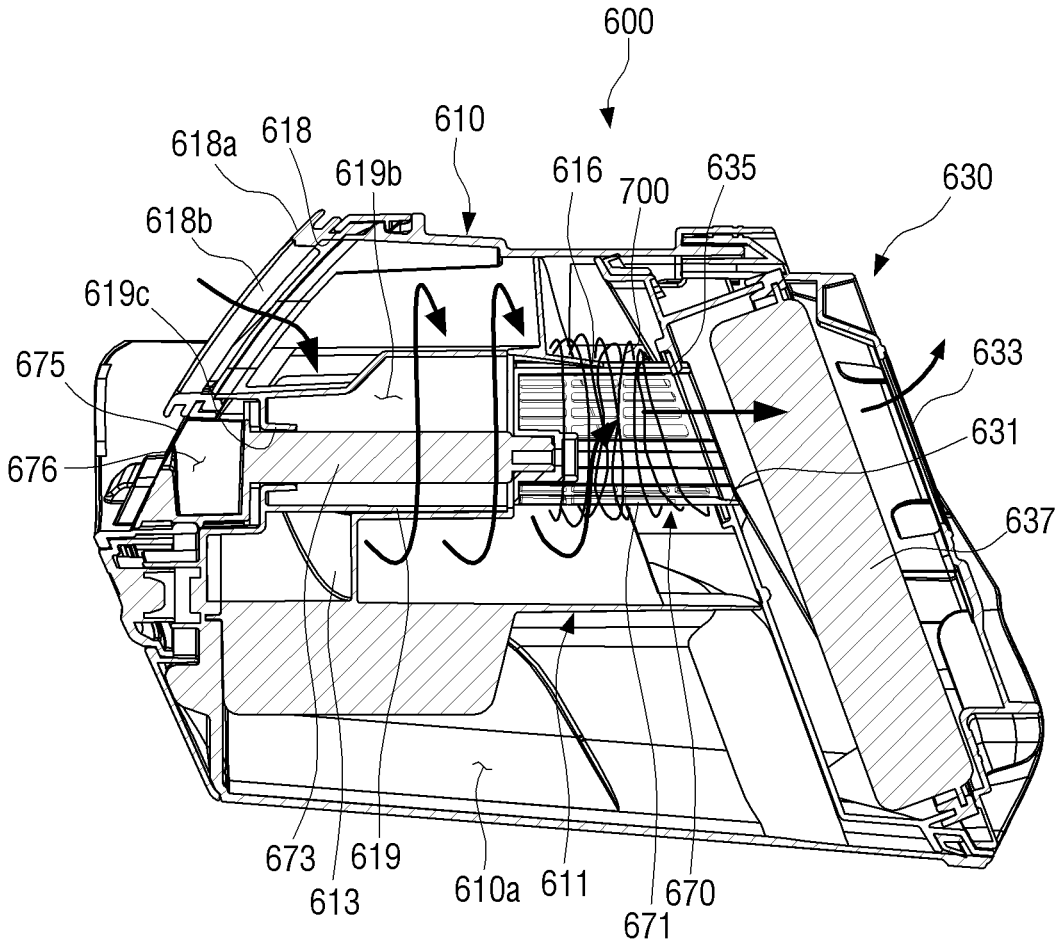
FIG. 27 is a cross-sectional view illustrating a state in which hairs are wound on the outer surface of a grill portion of a grill filter member.

Referring to FIG. 27, when dust on the surface to be cleaned is sucked by the handy-stick type vacuum cleaner 10, air containing various filth such as dust, hair, and the like flows into the inside of the container 610 through the air inlet hole 618. Subsequently, the filth and air pass through the entrance hole 615, which is the entrance of the helical guide 613, and then move along the helical guide 613 toward the grill portion 671.

The relatively heavy filth among the filth is introduced into the dust collecting chamber 610*a* through the dust discharging portions 611*a* (see FIG. 19) by the centrifugal force. At this time, the relatively light filth (e.g., hair, fine dust, etc.) among the filth is sucked into the grill portion 671 together with the air.

In this case, the air and the fine dust are sucked into the cover 630 through the inside of the grill portion 671, and the fine dust is filtered by the filter 637 disposed inside the cover 630. Most of thin and long filth such as hair does not pass through many holes of the grill portion 671 and is wound on the outer surface of the grill portion 671 by the swirling air flow formed inside the cyclone 611.

When the surface to be cleaned is cleaned using the handy-stick type vacuum cleaner 10 as described above and the filth collected in the container 610 is discarded, the dust collecting member 600 is separated from the mounting space 107 (see FIG. 11) of the first part 100 and then the cover 630 is detached from the container 610.

Figure 28:
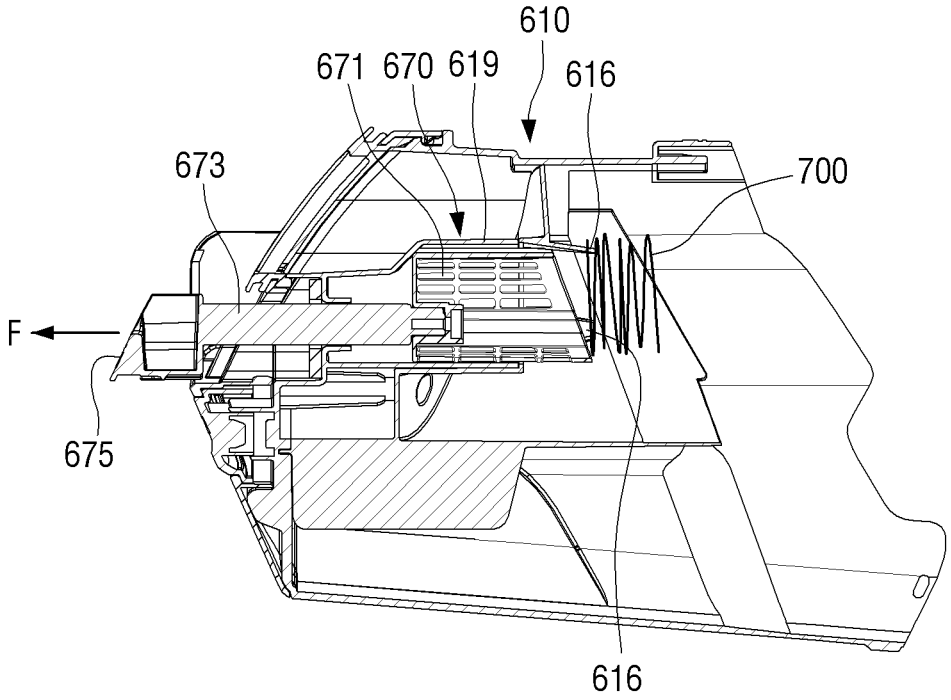
FIG. 28 is a cross-sectional view illustrating a state in which a grill filter member is moved backward and hairs wound on the outer surface of a grill portion is peeled off.

Then, as illustrated in FIG. 28, when the handle 675 of the grill filter member 670 is pulled in the direction of the arrow F, the grill portion 671 is retracted and inserted into the receiving space 619*b* of the guide pipe 619. At this time, the hair 700 wounded on the outer surface of the grill portion 671 is moved together with the grill portion 671 and is separated from the outer surface of the grill portion 671 by the plurality of catching protrusions 616. At this time, the hair 700 surrounds the outer surfaces of the plurality of catching protrusions 616, thereby being completely separated from the grill portion 671.

Figure 29:
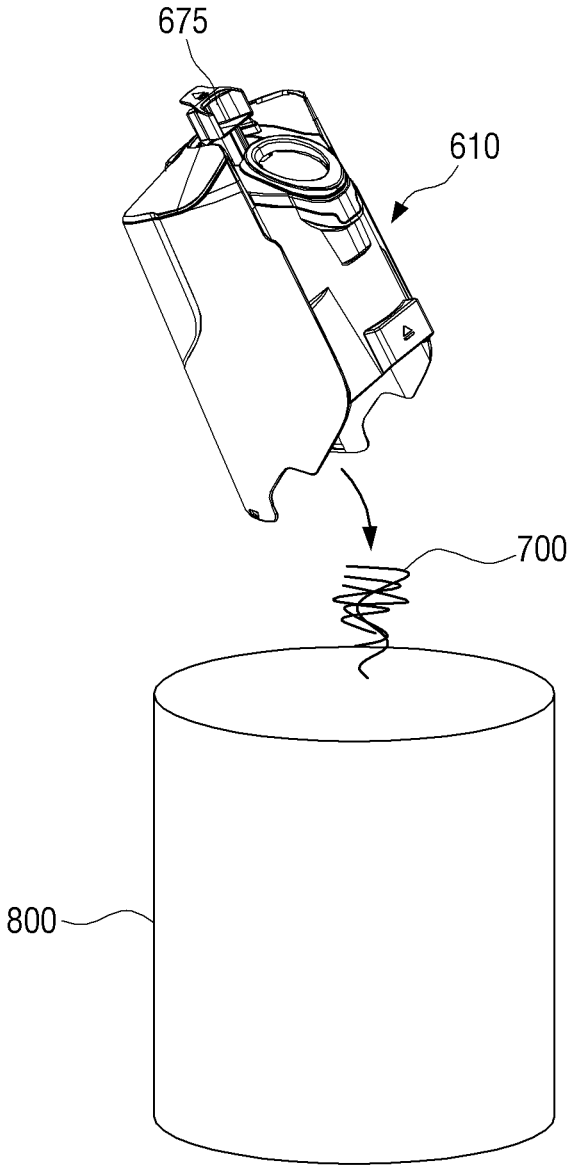
FIG. 29 is a view illustrating a state in which collected dust and hairs are discharged from a container.

In this state, when the container 610 is tilted as illustrated in FIG. 29, the hair 700 inside the cyclone 611 and the dust 701 collected in the dust collecting chamber 610*a* may be emptied. In FIG. 29, reference numeral 800 denotes a trash can.

Because the grill portion 671 of the grill filter member 670 has a size larger than the diameter of the through hole 619*b*, when the snap engagement between the engaging protrusion 621 and the engaging groove 675*a* is released and the grill filter member 670 is retracted, the grill filter member 670 is not separated from the container 610.

Figure 30:
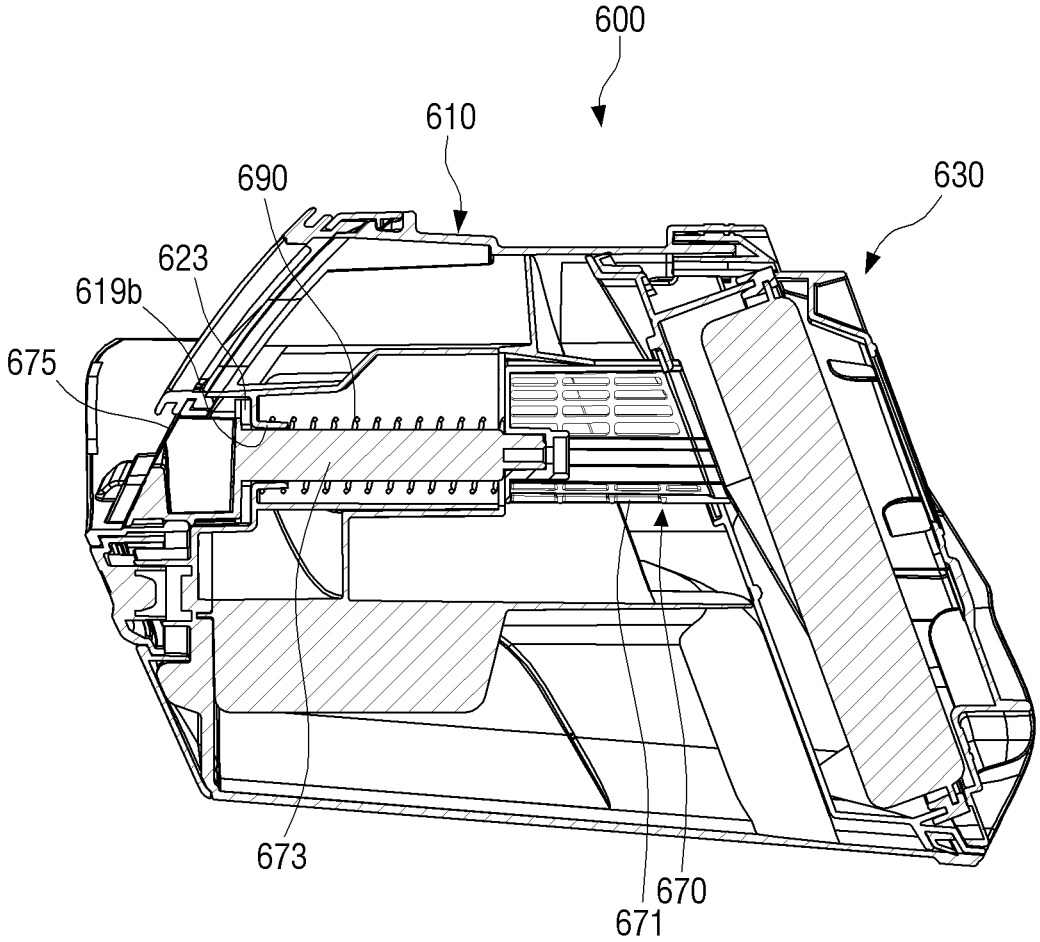
FIG. 30 is a cross-sectional view illustrating an example in which a separate elastic member is coupled to a grill filter member.

As described above, when the grill filter member 670 is retracted, the hairs 700 wounded around the outer surface of the grill portion 671 are mostly separated from the grill portion 671 by the plurality of catching protrusions 616, but some hairs may be caught in the plurality of holes of the grill portion 671 or the like. In order to effectively separate the some hairs from the grill portion 671, the grill filter member 670 may be elastically disposed in the container 610 by coupling an elastic member 690 to the connecting rod 673 as illustrated in FIG. 30.

In this case, in order to remove the hairs stuck in the plurality of holes of the grill portion 671, when the handle of the grill filter member 670 is pulled in the direction of arrow F and then is released, the grill filter member 670 is advanced by the elastic force of the elastic member 690. At this time, as the front surface of the handle 675 collides with the partition wall 623, the vibration caused by the collision is transmitted to the grill portion 671 through the connecting rod 673.

When the grill portion 671 vibrates, the hairs stuck in the plurality of holes of the grill portion 671 may be easily separated. In addition, when the grill filter member 670 is retracted and then the handle 675 is released repeatedly, the hairs attached to the grill portion 671 may be more effectively separated.

The handy-stick type vacuum cleaner 10 according to an embodiment of the present disclosure has a structure in that the first part 100 including the dust collecting member 110 and the second part 200 including the suction motor 250 and the handle 210 rotate about the rotation shafts 360 of the third part 300 provided between the first part 100 and the second part 200 and the dust collecting member 110 of the first part 100 and the suction motor 250 of the second part 200 are in fluid communication with each other by the flexible tube 500 disposed inside the third part 300. However, the structure of the handy-stick type vacuum cleaner according to an embodiment of the present disclosure is not limited thereto.

In other words, in a handy-stick type vacuum cleaner according to another embodiment of the present disclosure, a dust collecting member, a suction motor, a rechargeable battery, and a handle may be arranged variously in the first part, the second part, and the third part.

Hereinafter, various arrangement of a dust collecting member, a suction motor, a rechargeable battery, and a handle of a handy-stick type vacuum cleaner according to an embodiment of the present disclosure will be described in detail with reference to FIGS. 31 to 46. The handy-stick type vacuum cleaners described below are different from the handy-stick type vacuum cleaner 10 according to the above-described embodiment in that the flexible tube is not used for connecting the dust collecting member and the suction motor.

Figure 34:
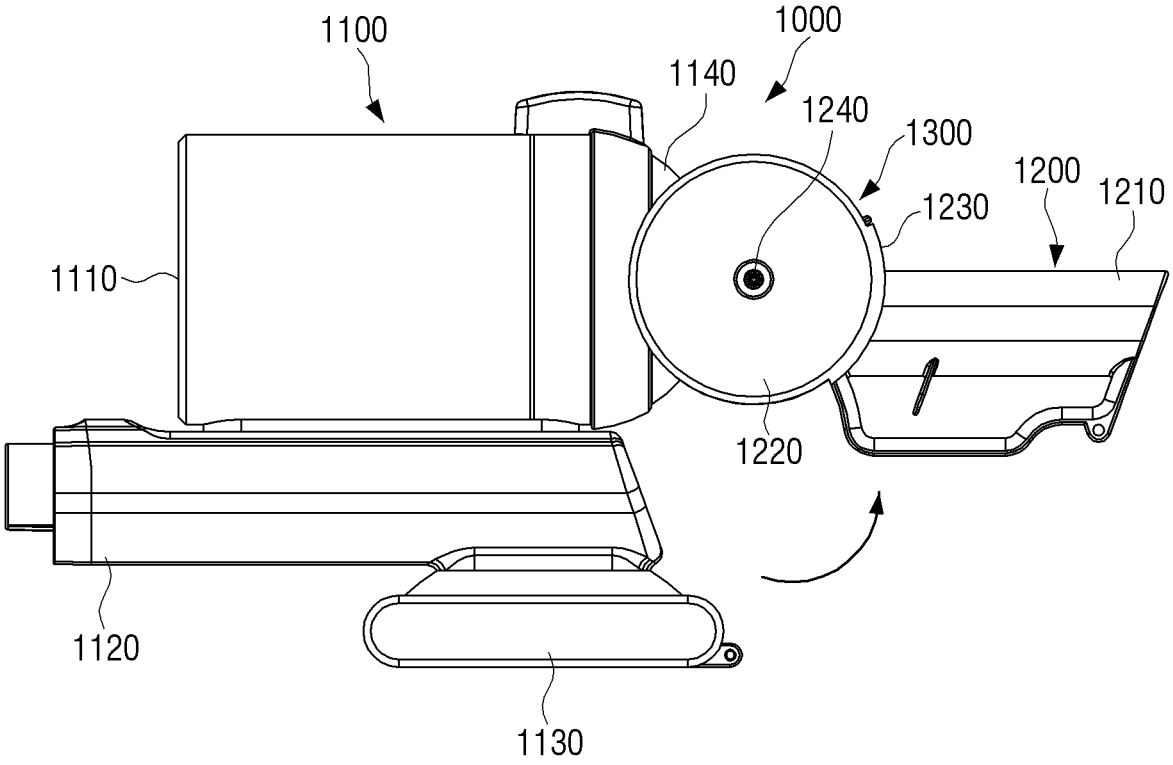
FIG. 34 is a view illustrating a state in which a handle of the handy-stick type vacuum cleaner of FIG. 31 is turned at a certain angle.

First, a handy-stick type vacuum cleaner 1000 according to an embodiment of the present disclosure will be described with reference to FIGS. 31 and 34.

Figure 31:
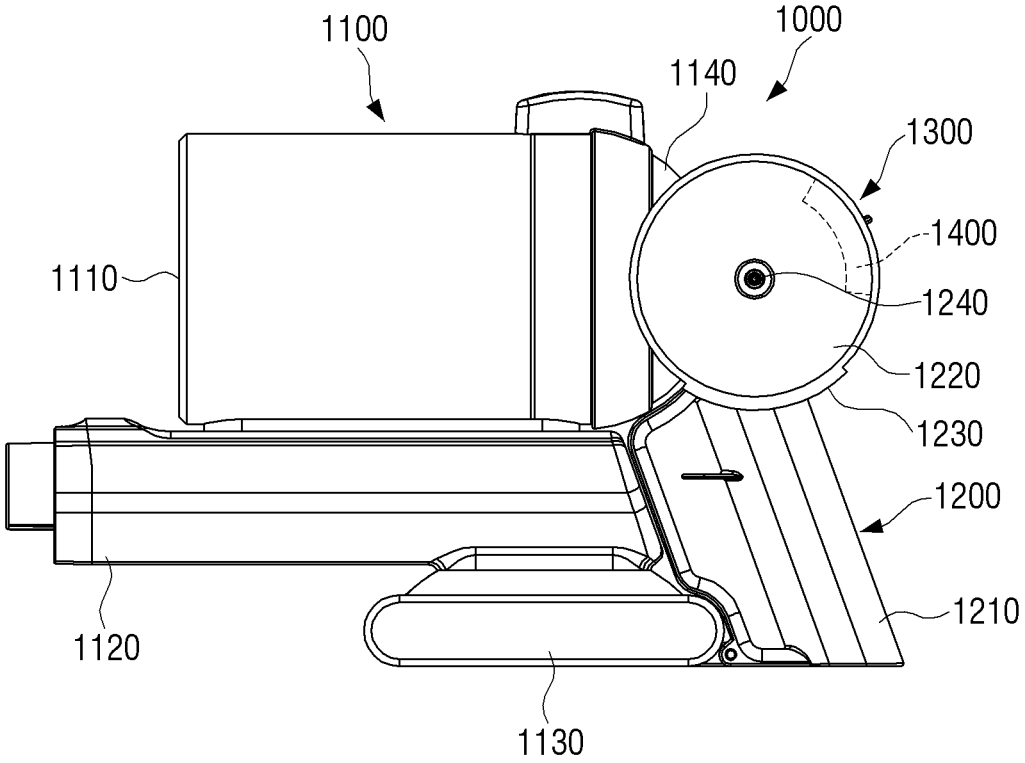
FIG. 31 is a view illustrating a handy-stick type vacuum cleaner according to another embodiment of the present disclosure.
Figure 32:
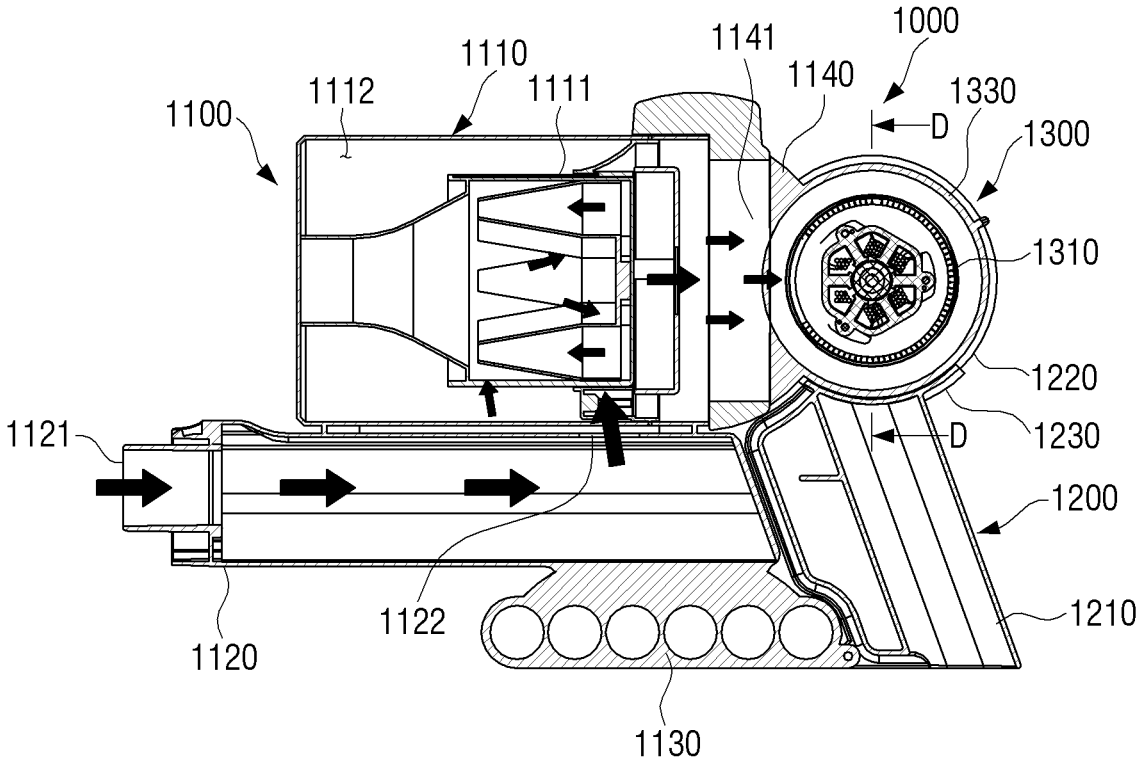
FIG. 32 is a cross-sectional view of the handy-stick type vacuum cleaner of FIG. 31.
Figure 33:
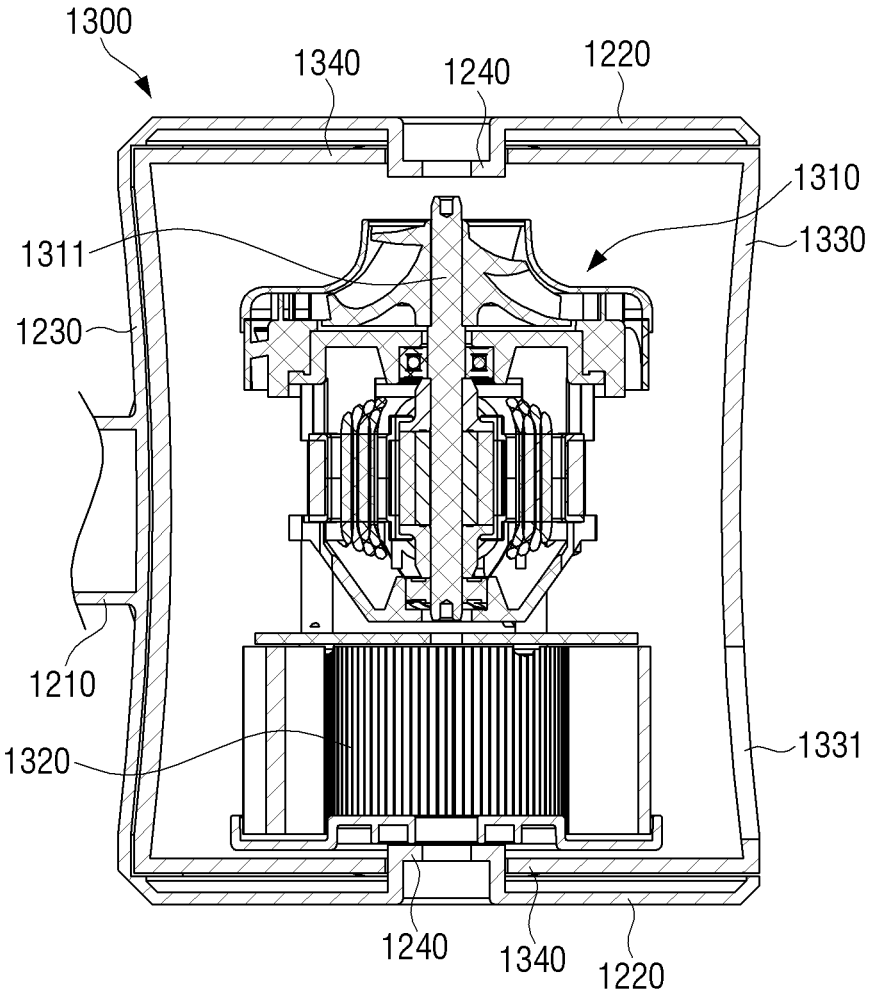
FIG. 33 is a cross-sectional view of the handy-stick type vacuum cleaner taken along line D-D illustrated in FIG. 32.

FIG. 31 is a view illustrating a handy-stick type vacuum cleaner according to another embodiment of the present disclosure. FIG. 32 is a cross-sectional view of the handy-stick type vacuum cleaner of FIG. 31. FIG. 33 is a cross-sectional view of the handy-stick type vacuum cleaner taken along line D-D illustrated in FIG. 32. FIG. 34 is a view illustrating a state in which a handle of the handy-stick type vacuum cleaner of FIG. 31 is turned at a certain angle.

Referring to FIGS. 31 to 34, a handy-stick type vacuum cleaner 1000 according to an embodiment of the present disclosure may include a first part 1100 provided with a dust collecting member 1110, a second part 1200 provided with a handle 1210, and a third part 1300 provided with a suction motor 1310.

In detail, the first part 1100 is provided with the dust collecting member 1110, a connecting pipe 1120, and a rechargeable battery 1130. The dust collecting member 1110, the connecting pipe 1120, and the rechargeable battery 1130 may be arranged side by side as illustrated in FIGS. 31 and 32.

The dust collecting member 1110 may include a cyclone 1111 for separating dust from an intake air by swirling the intake air and a dust collecting chamber 1112 for collecting dust separated by the cyclone 1111. The first part 1100 is provided with a mounting portion 1140 in which the dust collecting member 1110 is disposed. The mounting portion 1140 is provided with a discharge passage 1141 configured to guide the air discharged from the dust collecting member 1110 to the suction motor 1310. The dust collecting chamber 1112 may be detachably disposed.

The connecting pipe 1120 is disposed at one side of the dust collecting member 1110, and has an inlet 1121 through which outside air is introduced at one end thereof and an outlet 1122 communicated with an inflow port of the dust collecting member 1110 at the other end thereof. An extension pipe 30 as illustrated in FIG. 15 may be detachably connected to the inlet 1121 of the connecting pipe 1120. Therefore, the outside air is introduced into the cyclone 1111 of the dust collecting member 1110 through the connecting pipe 1120.

The rechargeable battery 1130 is disposed at one side of the connecting pipe 1120. In detail, the rechargeable battery 1130 is disposed to face the dust collecting member 1110 with the connecting pipe 1120 interposed therebetween. Therefore, the connecting pipe 1120 and the rechargeable battery 1130 are integrally fixed to the mounting portion 1140 at one side of the dust collecting member 1110. The rechargeable battery 1130 supplies power to the suction motor 1310.

In the third part 1300, the suction motor 1310 and a filter 1320 are disposed. The third part 1300 is integrally formed with the first part 1100 and includes a motor housing 1330 in which the suction motor 1310 and a filter 1320 are embedded. The motor housing 1330 is provided with an inlet for communicating with the discharging passage 1141 of the first part 1100 and a plurality of discharging slots 1331 for discharging the air having passed through the suction motor 1310 and the filter 1320 to the outside of the motor housing 1330. A HEPA filter may be used as the filter 1320. Therefore, the air introduced into the inlet of the housing 1330 of the third part 1300 passes through the suction motor 1310 and the filter 1320 and then is discharged to the outside of the third part 1300 through the discharging slots 1331.

At both ends of the motor housing 1330 of the third part 1300, a pair of first supporting portions 1340 for supporting the rotation of the second part 1200 may be provided.

The second part 1200 is provided with a handle 1210. The second part 1200 is formed in a rotatable structure with respect to the third part 1300. For example, the second part 1200 may include a pair of second supporting portions 1220 corresponding to the pair of first supporting portions 1340 of the third part 1300 and the handle 1210 connected to the pair of the second supporting portions 1220. The pair of second supporting portions 1220 and the handle 1210 are connected to each other through a connecting part 1210. The pair of first supporting portions 1340 and the pair of second supporting portions 1220 are rotatably connected to each other by a pair of rotation shafts 1240. At this time, the pair of rotation shafts 1240 may be arranged coaxially with the rotation shafts 1311 of the suction motor 1310 provided in the motor housing 1330 of the third part 1300.

Accordingly, the handle 1210 of the second part 1200 may be rotated by a predetermined angle with respect to the first part 1100 about the pair of rotation shafts 1240. For example, the handle 1210 may be made substantially in line with the dust collecting member 1110 as illustrated in FIG. 34 by rotating the handle 1210 in contact with the first part 1100 as illustrated in FIG. 31 in the counter-clockwise direction around the pair of rotation shafts 1240 by the predetermined angle.

In addition, the third part 1300 is provided with a mode setting member 1400 configured to set the first part 1100 and the second part 1200 to a rotation mode in which the first part 1100 and the second part 1200 are rotatable about each other or a fixed mode in which the first part 1100 and the second part 1200 are fixed to each other.

The first part 1100 and the second part 1200 may be fixed to each other or may be rotatable with respect to each other by operating the mode setting member 1400. Further, when the mode setting member 1400 is set to the rotation mode, the first part 1100 and the second part 1200 are arranged at a desired angle. After that, when the mode setting member 1400 is set to the fixed mode, the first part 1100 and the second part 1200 may maintain the arranged angle. Because the structure and operation of the mode setting member 1400 are the same as or similar to those of the mode setting member 410 of the above-described embodiment, detailed description thereof is omitted.

Hereinafter, the operation of the handy-stick type vacuum cleaner according to an embodiment of the present disclosure will be described with reference to FIG. 32.

When the suction motor 1310 is operated by the power supplied from the rechargeable battery 1130, a suction force is generated, and the outside air is sucked into the inlet 1121 of the connecting pipe 1120. The sucked outside air moves along the connecting pipe 1120 and enters the cyclone 1111 of the dust collecting member 1110.

Dust and filth contained in the outside air are separated from the air and collected in the dust collecting chamber 1112 while the outside air passes through the cyclone 1111. The cleaned air flows into the suction motor 1310 disposed in the motor housing 1330 through the discharge passage 1141 provided in the mounting portion 1140.

The air introduced into the suction motor 1310 passes through the filter 1320 disposed below the suction motor 1310, and then is discharged to the outside of the motor housing 1330 through the plurality of discharge slots 1331.

As described above, when performing cleaning using the handy-stick type vacuum cleaner 1000 according to an embodiment of the present disclosure, the second part 1200 provided with the handle 1210 may be rotated by a certain angle with respect to the first part 1100 about the rotation shafts 1240. Therefore, the operation of bending or twisting the wrist of the hand holding the handle 1210 of the second part 1200 may be minimized so that the load applied to the wrist is greatly reduced.

Next, a handy-stick type vacuum cleaner 2000 according to an embodiment of the present disclosure will be described with reference to FIGS. 35 and 39.

Figure 35:
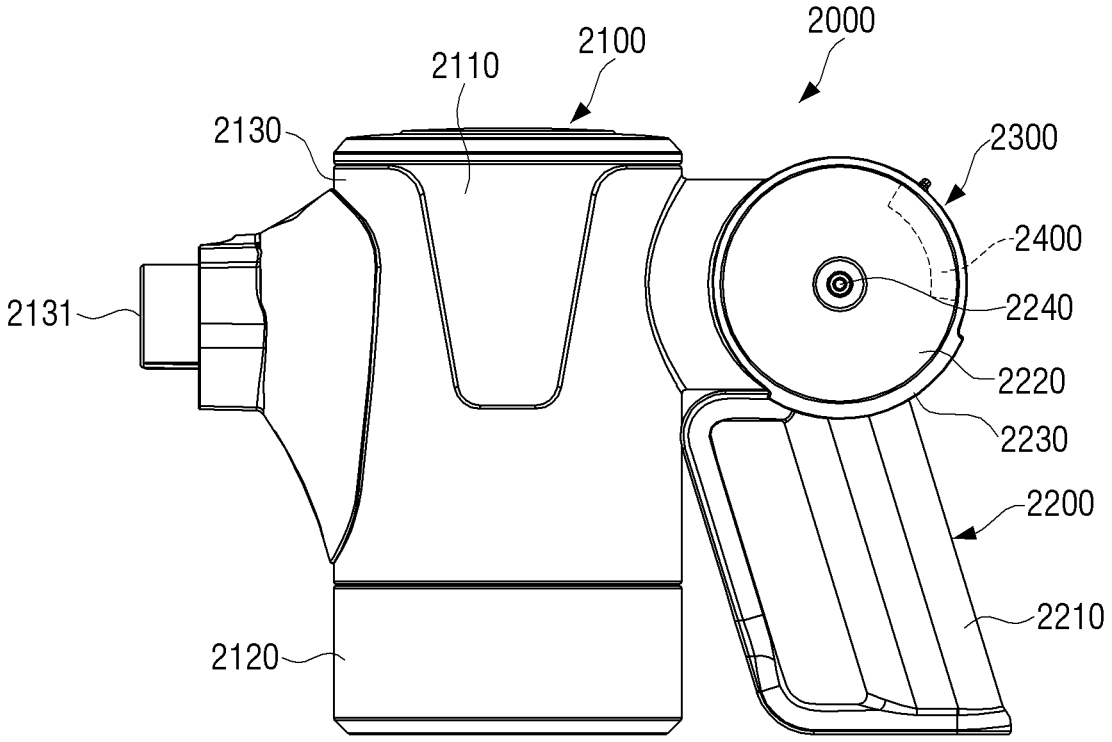
FIG. 35 is a view illustrating a handy-stick type vacuum cleaner according to another embodiment of the present disclosure.
Figure 36:
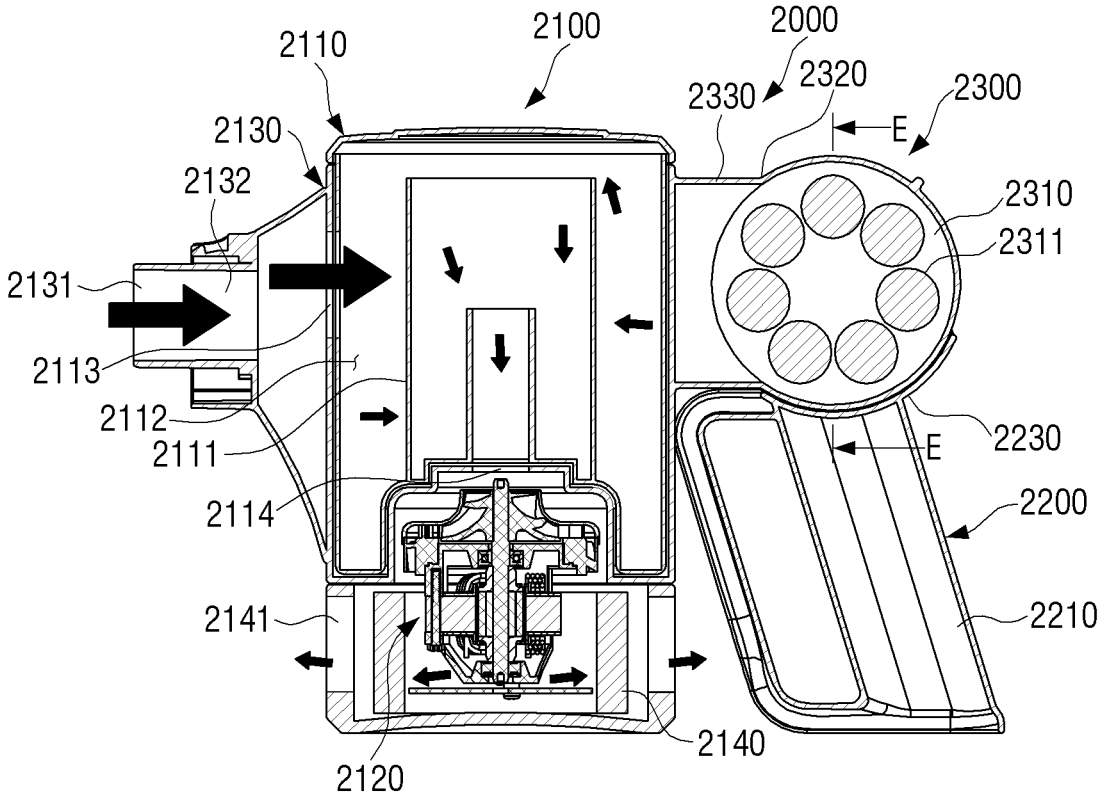
FIG. 36 is a cross-sectional view of the handy-stick type vacuum cleaner of FIG. 35.
Figure 37:
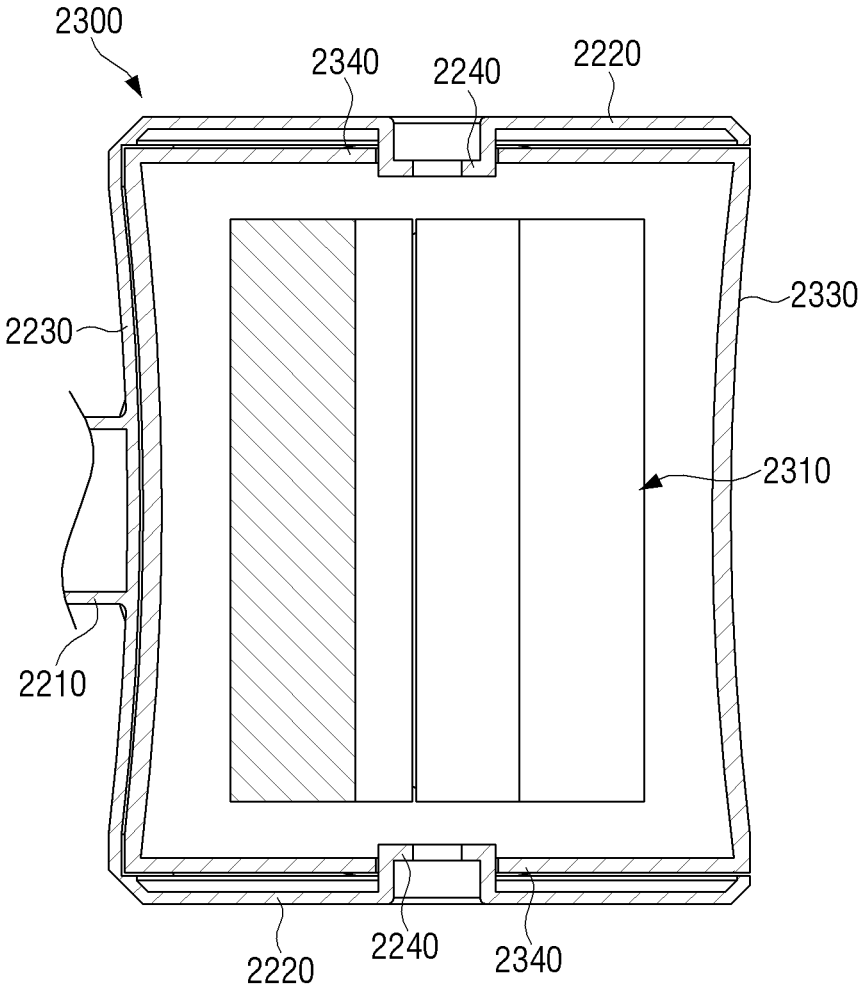
FIG. 37 is a cross-sectional view of the handy-stick type vacuum cleaner taken along line E-E illustrated in FIG. 36.
Figure 38:
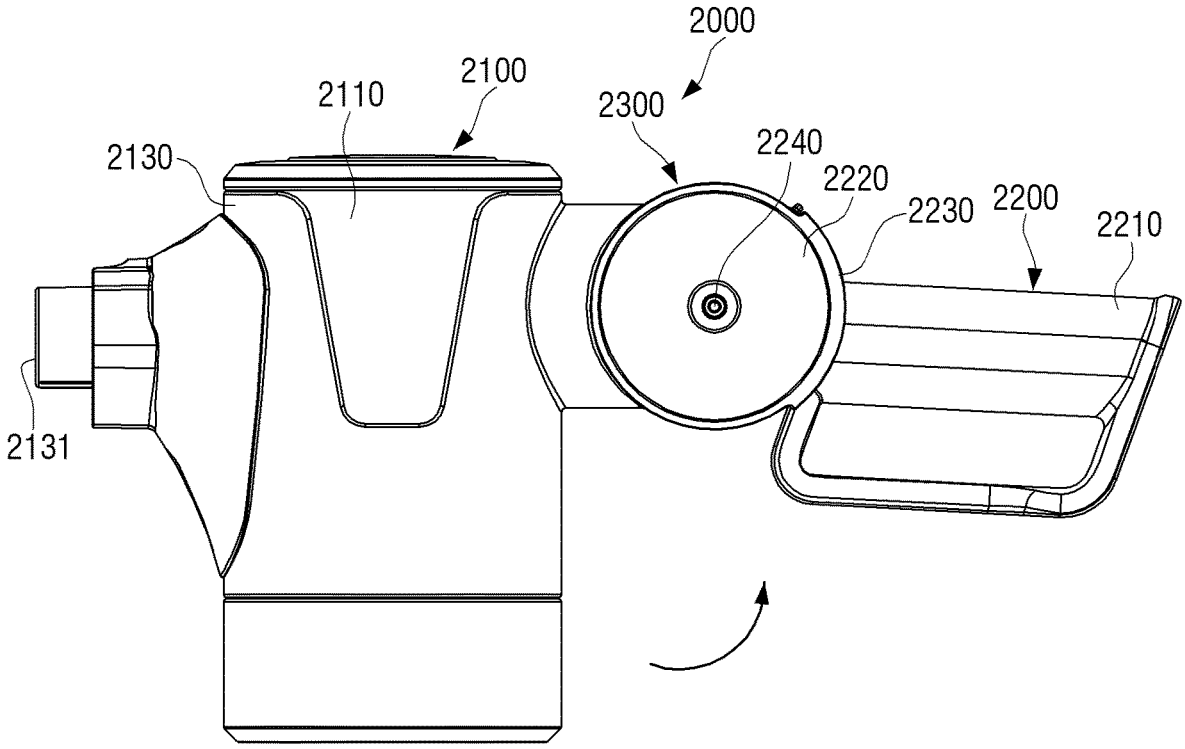
FIG. 38 is a view illustrating a state in which a handle of the handy-stick type vacuum cleaner of FIG. 35 is turned at a certain angle.

FIG. 35 is a view illustrating a handy-stick type vacuum cleaner according to another embodiment of the present disclosure. FIG. 36 is a cross-sectional view of the handy-stick type vacuum cleaner of FIG. 35. FIG. 37 is a cross-sectional view of the handy-stick type vacuum cleaner taken along line E-E illustrated in FIG. 36. FIG. 38 is a view illustrating a state in which a handle of the handy-stick type vacuum cleaner of FIG. 35 is turned at a certain angle. FIG. 39 is a cross-sectional view illustrating a modified example of the handy-stick type vacuum cleaner of FIG. 35.

Referring to FIGS. 35 to 38, a handy-stick type vacuum cleaner 2000 according to an embodiment of the present disclosure may include a first part 2100 provided with a dust collecting member 2110 and a suction motor 2120, a second part 200 provided with a handle 2210, and a third part 2300 provided with a rechargeable battery 2310.

In detail, the dust collecting member 2110 and the suction motor 2120 are disposed in the first part 2100. The dust collecting member 2110 and the suction motor 2120 may be arranged in a straight line as illustrated in FIG. 36.

The first part 2100 may include a housing 2130 in which the dust collecting member 2110 and the suction motor 2120 are disposed. The suction motor 2120 is disposed at the inner lower portion of the housing 2130, and the dust collecting member 2110 is disposed at the inner upper portion of the housing 2130, that is, above the suction motor 2120.

An inlet 2131 through which outside air containing dust is drawn is provided at one side of the housing 2130. An internal passage 2132 for guiding the outside air to an inflow port 2113 of the dust collecting member 2110 is provided between the inlet 2131 and the dust collecting member 2110. The extension pipe 30 as illustrated in FIG. 15 may be detachably connected to the inlet 2131 of the housing 2130. Therefore, the outside air is introduced into the dust collecting member 2110 through the inlet 2131 and the internal passage 2132 of the housing 2130.

The dust collecting member 2110 may include a cyclone 2111 for separating dust from an intake air by swirling the intake air and a dust collecting chamber 2112 for collecting dust separated by the cyclone 2111. The dust collecting chamber 2112 may be detachably disposed in the housing 2130.

A discharge port 2114 of the dust collecting member 2110 is in fluid communication with the inlet of the suction motor 2120. A filter 2140 for filtering air is disposed at an outlet of the suction motor 2120. A plurality of discharge slots 2141 through which the air having passed through the filter 2140 is discharged are provided in the lower portion of the housing 2130. A HEPA filter may be used as the filter 2140.

A battery mounting portion 2320 is provided on the other side of the housing 2130, that is, a portion of the housing 2130 facing the portion of the housing 2130 at which the inlet 2131 is provided.

The rechargeable battery 2310 is disposed in the third part 2300. The third part 2300 is integrally formed with the first part 2100 and includes the battery mounting portion 2320 in which the rechargeable battery 2310 is embedded. The battery mounting portion 2320 is formed in a substantially hollow cylindrical shape and is fixed to the housing 2130 through a fixing portion 2330. The cylindrical rechargeable battery 2310 having a plurality of battery cells 2311 arranged in a circular shape may be disposed in the battery mounting portion 2320.

A pair of first supporting portions 2340 for supporting the rotation of the second part 2200 may be provided at both ends of the battery mounting portion 2320 of the third part 2300.

A handle 2210 is provided in the second part 2200. The second part 2200 is formed to be rotatable with respect to the third part 2300. For example, the second part 2200 may include a pair of second supporting portions 2220 corresponding to the pair of first supporting portions 2340 of the third part 2300 and the handle 2210 connected to the pair of second supporting portions 2220. The pair of second supporting portions 2220 and the handle 2210 are connected to each other through a connecting portion 2230. The pair of first supporting portions 2340 and the pair of second supporting portions 2220 are rotatably connected by a pair of rotation shafts 2240.

Accordingly, the handle 2210 of the second part 2200 may be rotated at a certain angle with respect to the first part 2100 about the pair of rotation shafts 2240. For example, the handle 2210 in contact with the housing 2130 of the first part 2100 as illustrated in FIG. 35 is rotated counter-clockwise around the pair of rotation shafts 2240 by a certain angle, so that the handle 2210 may be positioned approximately perpendicular to the housing 2130 as illustrated in FIG. 38.

Further, the third part 2300 may be provided with a mode setting member 2400 for setting the first part 2100 and the second part 2200 to one of a rotation mode in which the first part 2100 and the second part 2200 are mutually rotatable and a fixed mode in which the first part 2100 and the second part 2200 are fixed to each other.

The first part 2100 and the second part 2200 may be maintained in the fixed state or in the rotatable state with respect to each other by operating the mode setting member 2400. Further, when the mode setting member 2400 is set to the rotation mode, the first part 2100 and the second part 2200 are arranged at a desired angle. After that, when the mode setting member 2400 is set to the fixed mode, the first part 2100 and the second part 2200 may maintain the arranged angle. The structure and operation of the mode setting member 2400 are the same as or similar to those of the mode setting member 410 according to the above-described embodiment, and thus a detailed description thereof is omitted.

Hereinafter, the operation of the handy-stick type vacuum cleaner according to an embodiment of the present disclosure will be described with reference to FIG. 36.

When the suction motor 2120 is operated by the power supplied from the rechargeable battery 2310, a suction force is generated, and the outside air is sucked into the inlet 2131 of the housing 2130. The sucked outside air is introduced into the cyclone 2111 of the dust collecting member 2110 through the inner passage 2132 of the housing 2130.

Dust and filth contained in the outside air are separated from the air and collected in the dust collecting chamber 2112 while the outside air passes through the cyclone 2111. The cleaned air flows into the suction motor 2120 through the discharge port 2114 of the dust collecting member 2110.

The air introduced into the suction motor 2120 passes through the filter 2140 disposed under the suction motor 2120, and then is discharged to the outside of the housing 2130 through the plurality of discharge slots 2141.

When performing cleaning using the handy-stick type vacuum cleaner 2000 according to the present embodiment having such a structure, the second part 2200 provided with the handle 2210 may be rotated by a certain angle with respect to the first part 2100 about the rotation shafts 2240. Therefore, the operation of bending or twisting the wrist of the hand holding the handle 2210 of the second part 2200 may be minimized so that the load applied to the wrist may be greatly reduced.

In the above description, the handy-stick type vacuum cleaner 2000 having the structure in which the air discharged from the suction motor 2120 is directly discharged to the outside through the plurality of discharge slots 2141 of the housing 2130 has been described. However, as another example, the handy-stick type vacuum cleaner may be configured so that the discharged air cools the rechargeable battery 2310 of the third part 2300.

Figure 39:
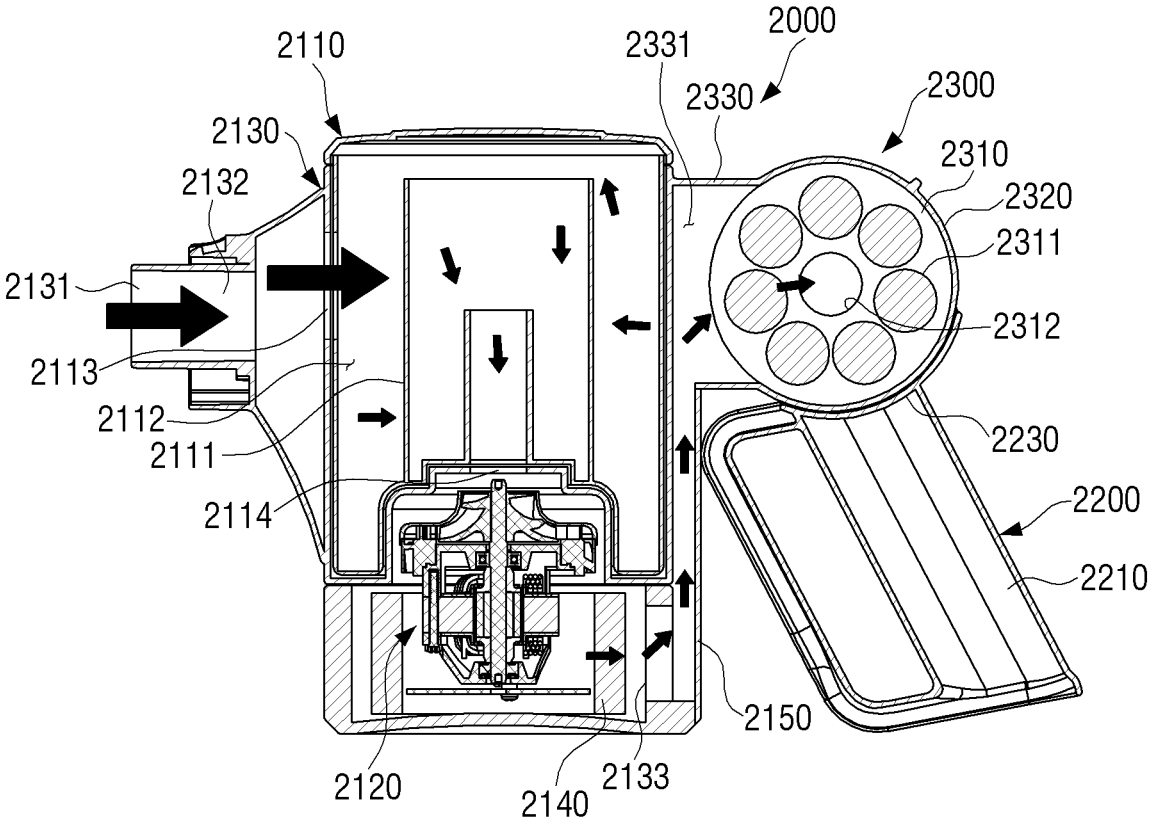
FIG. 39 is a cross-sectional view illustrating a modified example of the handy-stick type vacuum cleaner of FIG. 35.

FIG. 39 shows a handy-stick type vacuum cleaner 2000 having a structure in which the discharged air cools the rechargeable battery 2310 disposed in the third part 2300.

Referring to FIG. 39, a discharge duct 2150 is provided at one side of the housing 2130 to communicate the air outlet 2133 of the lower portion of the housing 2130 with the battery mounting portion 2320. The fixing portion 2330 of the battery mounting portion 2320 is provided with an air passage 2331 communicating with the discharge duct 2150. Accordingly, the discharge duct 2150 of the housing 2130 and the air passage 2331 of the fixing portion 2330 forms a discharging passage for guiding air discharged from the suction motor 2120 disposed in the housing 2130 to the rechargeable battery 2310.

In addition, the rechargeable battery 2310 is formed in a cylindrical shape, and a through hole 2312 through which air may pass is provided at the center thereof. Further, a plurality of discharge slots (not illustrated) through which air may be discharged are provided at one end of the battery mounting portion 2320. Therefore, the air introduced into the battery mounting portion 2320 through the discharging passage passes through the through hole 2312 of the rechargeable battery 2310, and then is discharged to the outside of the battery mounting portion 2320 through the discharge slots.

When the rechargeable battery 2310 is cooled by using the air discharged from the suction motor 2310, the rechargeable battery 2310 may be efficiently cooled.

The handy-stick type vacuum cleaner 2000 illustrated in FIG. 39 is the same as the handy-stick type vacuum cleaner 2000 illustrated in FIGS. 35 to 38 except for the above-described discharge passage, and thus the detailed description thereof is omitted.

Next, a handy-stick type vacuum cleaner 3000 according to an embodiment of the present disclosure will be described with reference to FIGS. 40 to 44.

Figure 40:
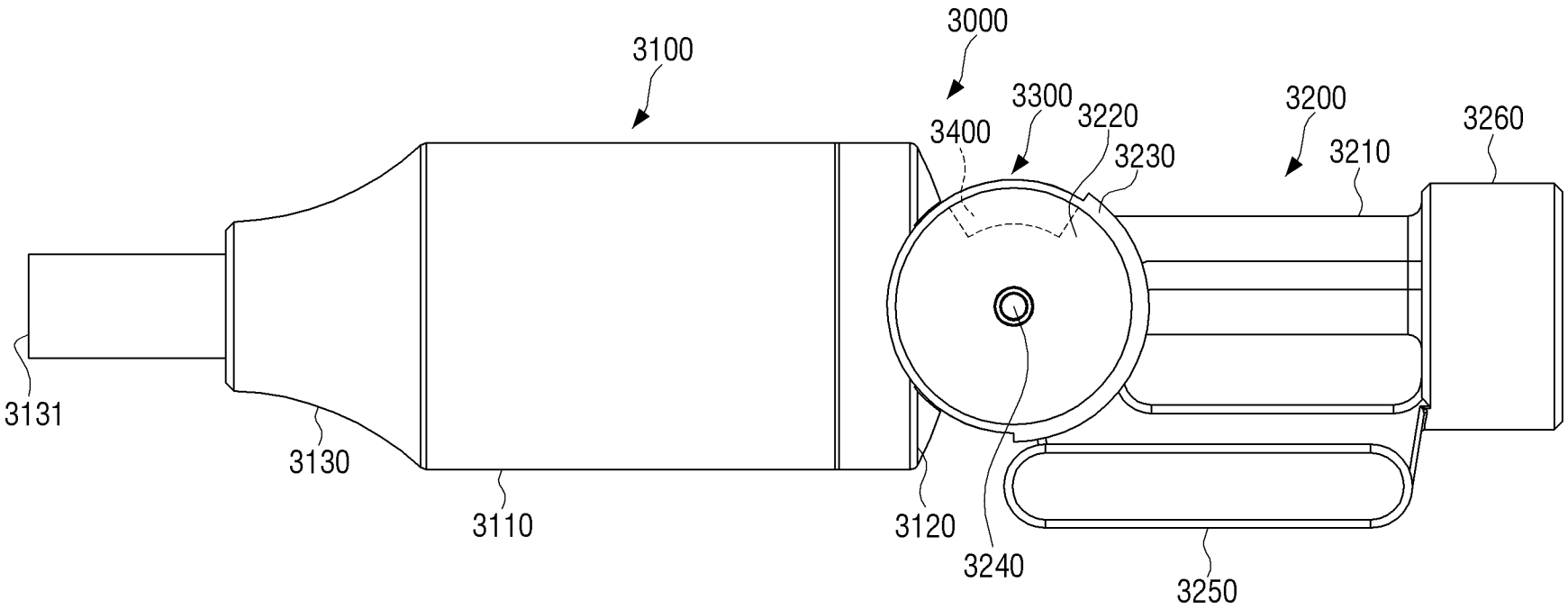
FIG. 40 is a view illustrating a handy-stick type vacuum cleaner according to another embodiment of the present disclosure.
Figure 41:
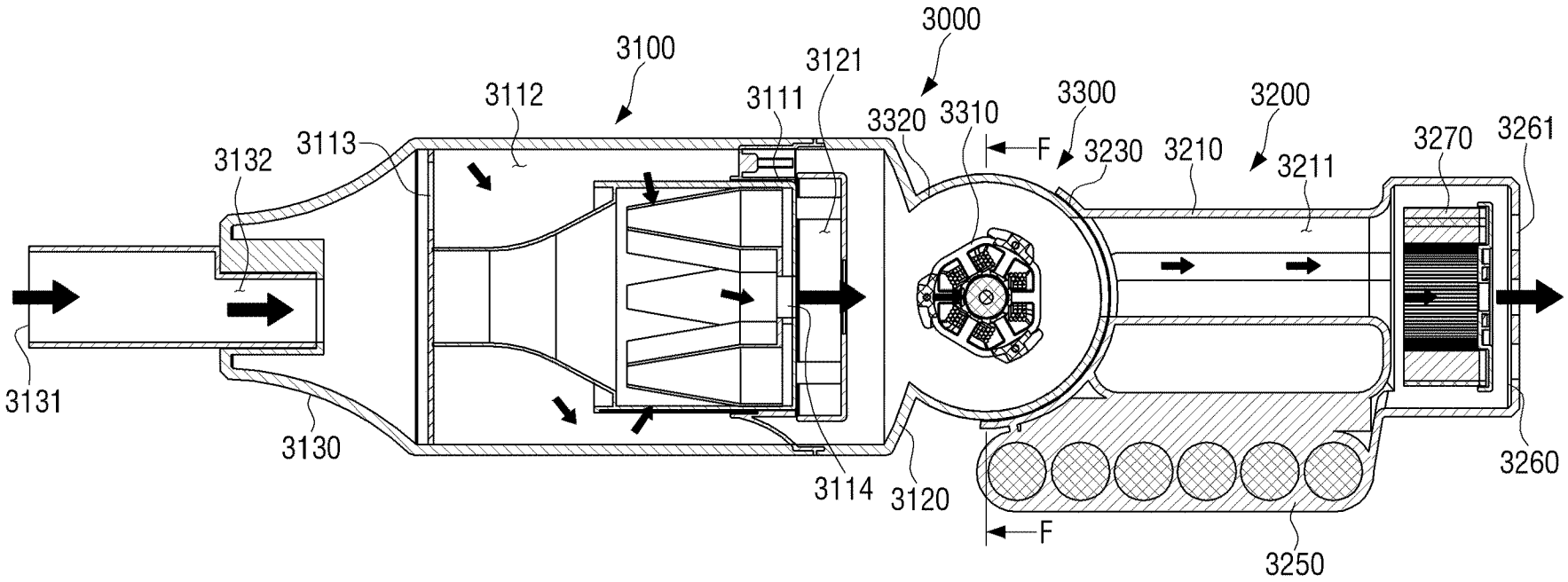
FIG. 41 is a cross-sectional view of the handy-stick type vacuum cleaner of FIG. 39.
Figure 42:
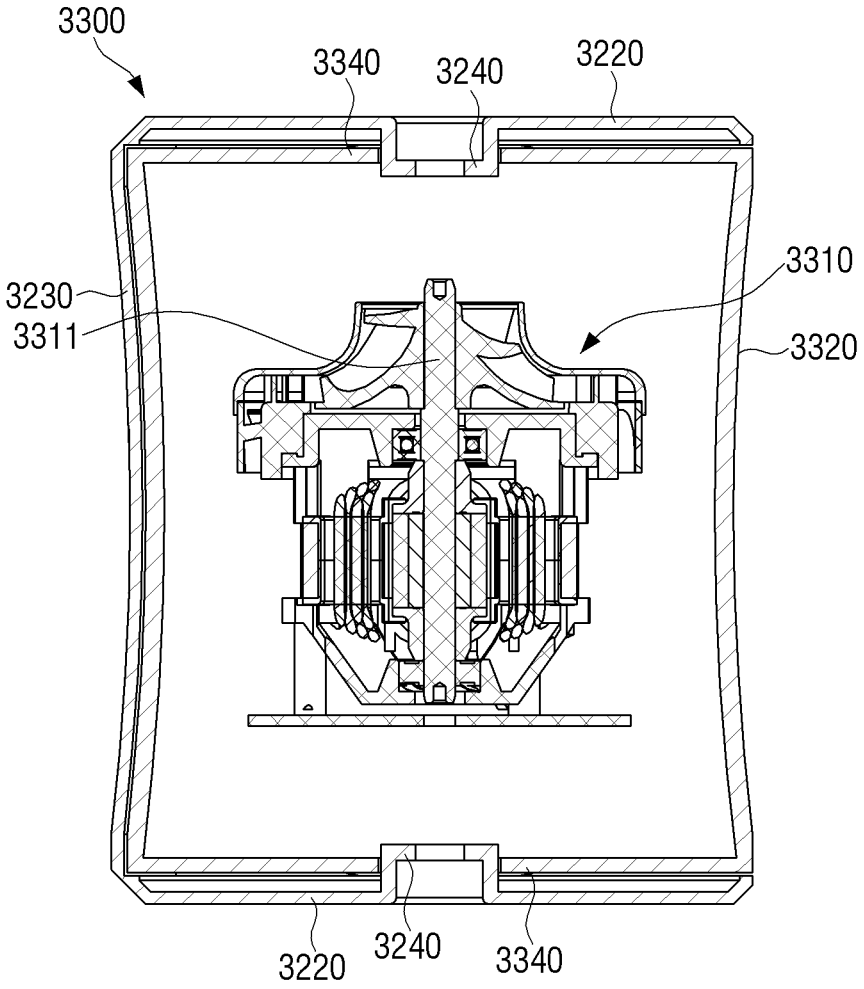
FIG. 42 is a cross-sectional view of the handy-stick type vacuum cleaner taken along line F-F illustrated in FIG. 41.
Figure 43:
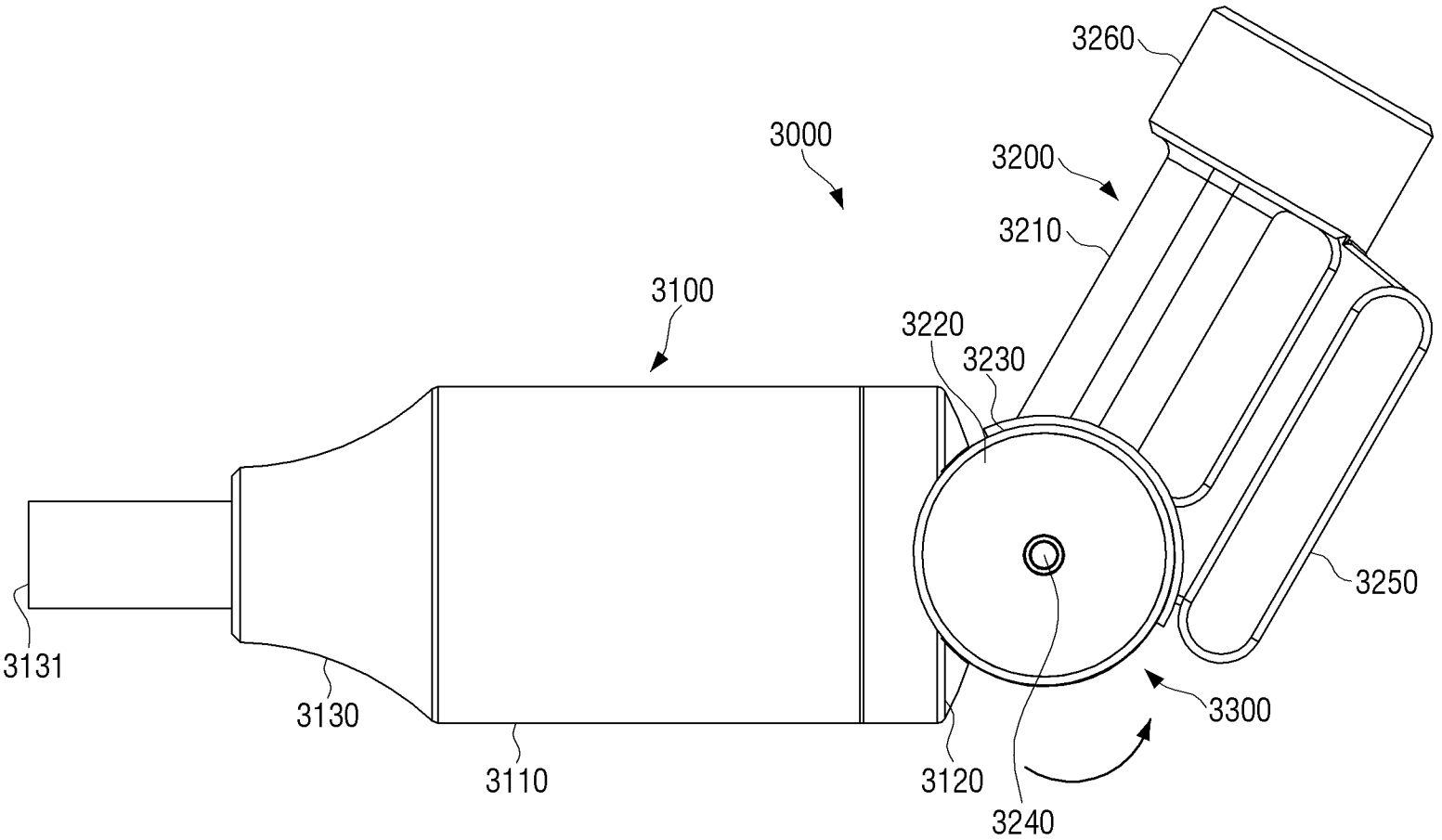
FIG. 43 is a view illustrating a state in which a handle of the handy-stick type vacuum cleaner of FIG. 40 is turned at a certain angle.
Figure 44:
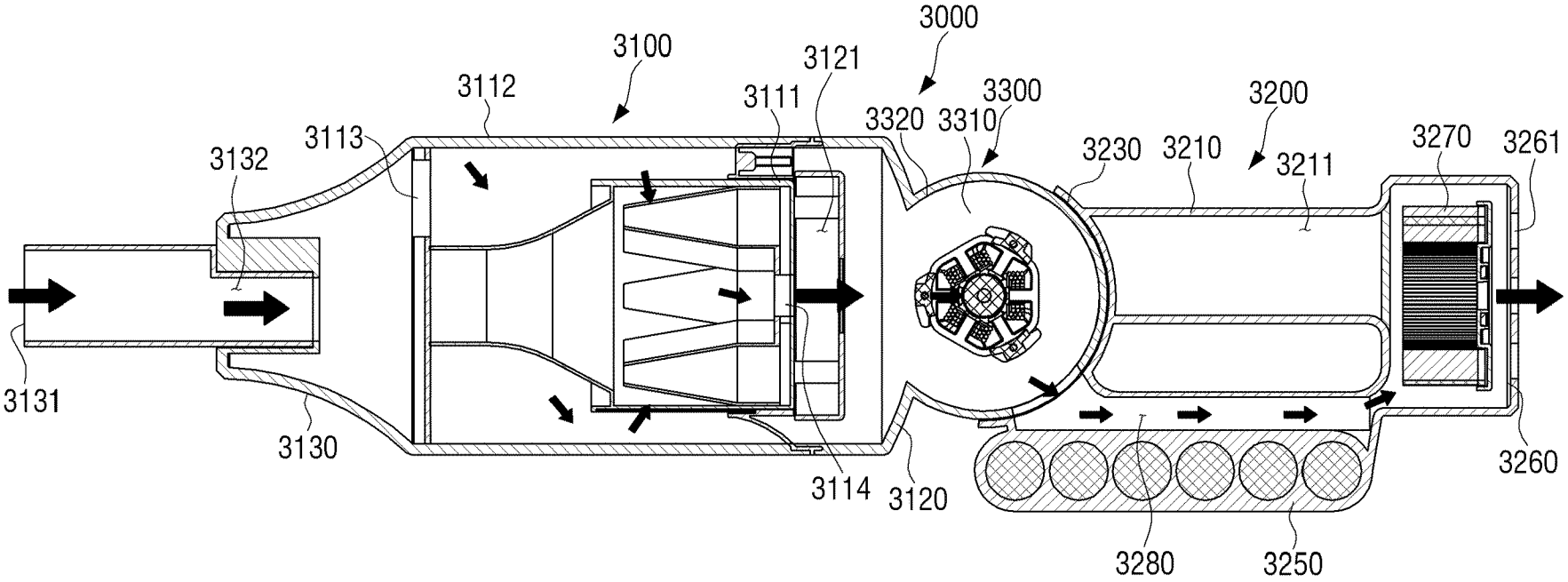
FIG. 44 is a cross-sectional view illustrating a modified example of the handy-stick type vacuum cleaner of FIG. 40.

FIG. 40 is a view illustrating a handy-stick type vacuum cleaner according to another embodiment of the present disclosure. FIG. 41 is a cross-sectional view of the handy-stick type vacuum cleaner of FIG. 39. FIG. 42 is a cross-sectional view of the handy-stick type vacuum cleaner taken along line F-F illustrated in FIG. 41. FIG. 43 is a view illustrating a state in which a handle of the handy-stick type vacuum cleaner of FIG. 40 is turned at a certain angle. FIG. 44 is a cross-sectional view illustrating a modified example of the handy-stick type vacuum cleaner of FIG. 40.

Referring to FIGS. 40 to 42, a handy-stick type vacuum cleaner 3000 according to an embodiment of the present disclosure may include a first part 3100 provided with a dust collecting member 3110, a second part 3200 provided with a handle 3210 and a rechargeable battery 3250, and a third part 3300 provided with a suction motor 3310.

In detail, the dust collecting member 3110 is disposed in the first part 3100. The first part 3100 may include a mounting portion 3120 where the dust collecting member 3110 is disposed. At one side of the dust collecting member 3110, an air inlet portion 3130 through which outside air including dust is drawn is provided. The air inlet portion 3130 may be formed integrally with the mounting portion 3120. The dust collecting member 3110 may be disposed between the mounting portion 3120 and the air inlet portion 3130.

The air inlet portion 3130 is provided with an inlet 3131 through which outside air is introduced and an internal passage 3132 through which the introduced outside air is guided to an inflow hole 3113 of the dust collecting member 3110. An extension pipe 30 as illustrated in FIG. 15 may be detachably connected to the inlet 3131 of the air inlet portion 3130. Therefore, the outside air is introduced into the dust collecting member 3110 through the inlet 3131 and the internal passage 3132 of the air inlet portion 3130.

The dust collecting member 3110 may include a cyclone 3111 for separating dust from an intake air by swirling the intake air and a dust collecting chamber 3112 for collecting dust and filth separated by the cyclone 3111.

The dust collecting member 3110 is disposed in the mounting portion 3120 such that the cyclone 3111 is substantially parallel to the internal passage 3132 of the air inlet portion 3130. For example, as illustrated in FIG. 41, the dust collecting member 3110 may be disposed in the mounting portion 3120 such that the direction of the air discharged from the discharge port 3114 of the cyclone 3111 is substantially parallel to the direction of the intake air drawn into the internal passage 3132. Accordingly, when the extension pipe 30 of FIG. 15 is disposed at the inlet 3131 of the air inlet portion 3130, the dust collecting member 3110 is substantially in line with the extension pipe 30.

Further, the mounting portion 3120 is provided with a discharge passage 3121 for guiding the air discharged from the dust collecting member 3110 to the suction motor.

The suction motor 3310 is disposed in the third part 3300. The third part 3300 is integrally with the first part 3100 and includes a motor housing 3320 in which the suction motor 3310 is embedded. The motor housing 3320 may be provided with an inlet communicating with the discharge passage 3121 of the first part 3100 and a discharge hole for discharging the air having passed through the suction motor 3310 to the outside of the motor housing 3320. Therefore, the air drawn into the inlet of the motor housing 3320 of the third part 2300 passes through the suction motor 3310, and then is discharged through the discharge hole.

A pair of first supporting portions 3340 for supporting the rotation of the second part 3200 may be provided at both ends of the motor housing 3320 of the third part 3300.

The second part 3200 is provided with the handle 3210 and the rechargeable battery 3250. The second part 3200 is formed in a rotatable structure with respect to the third part 3300. For example, the second part 3200 may include a pair of second supporting portions 3220 corresponding to the pair of first supporting portions 3340 and the handle 3210 connected to the pair of second supporting portions 3220. The pair of second supporting portions 3220 and the handle 3210 are connected to each other through a connection portion 3230. The pair of first supporting portions 3340 and the pair of second supporting portions 3220 are rotatably connected by a pair of rotation shafts 3240. At this time, the pair of rotation shafts 3240 may be disposed coaxially with the rotation shaft of the suction motor 3310 disposed in the motor housing 3320 of the third part 3300.

Thus, the handle 3210 of the second part 3200 may rotate at a certain angle with respect to the first part 3100 about the pair of rotation shafts 3240. For example, the handle 3210, which is disposed on a substantially straight line with the dust collecting member 3110 as illustrated in FIG. 40, is rotated counter-clockwise around the pair of rotation shafts 3240 by a certain angle, so that the dust collecting member 3110 and the handle 3210 may be made to be an obtuse angle as illustrated in FIG. 43.

The handle 3210 may be formed in a hollow shape. In other words, an air passage 3211 may be provided inside the handle 3210. The air passage 3211 inside the handle 3210 forms an exhaust passage through which the air discharged from the discharge hole of the motor housing 3320 passes. At this time, the connecting portion 3230 provided with the handle 3210 may be provided with a guide flow passage for guiding the air discharged from the discharge hole of the motor housing 3320 to the air passage 3211 of the handle 3210.

At one end of the handle 3210, a filter housing 3260 is provided. The filter housing 3260 is provided with a filter 3270 for filtering air discharged from the suction motor 3310. A plurality of discharge slots 3261 through which the air is discharged may be provided on the outer circumferential surface of the filter housing 3260. Therefore, the air that has passed through the handle 3210 is filtered by the filter 3270 provided in the filter housing 3260, and then is discharged to the outside through the plurality of discharge slots 3261. A HEPA filter may be used as the filter 3270.

The rechargeable battery 3250 is disposed at one side of the handle 3210. In detail, the rechargeable battery 3250 is disposed in the connecting portion 3230 at one side of the handle 3210 and is spaced apart from the handle 3210 by a predetermined distance. At this time, the handle 3210 and the rechargeable battery 3250 are spaced apart from each other such that the user's hand can be inserted. One end of the rechargeable battery 3250 is connected to the filter housing 3260. Therefore, the rechargeable battery 3250 is stably fixed to the handle 3210 because both ends of the rechargeable battery 3250 are supported by the connecting portion 3230 and the filter housing 3260. The rechargeable battery 3250 supplies electric power to the suction motor 3310.

Further, the third part 3300 may be provided with a mode setting member 3400 configured to set the first part 3100 and the second part 3200 to one of a rotation mode in which the first part 3100 and the second part 3200 are rotatable with respect to each other and a fixed mode in which the first part 3100 and the second part 3200 are fixed with respect to each other.

Accordingly, when the mode setting member 3400 is operated, the first part 3100 and the second part 3200 may be fixed or rotatable with respect to each other. Further, when the mode setting member 3400 is set to the rotation mode, the first part 3100 and the second part 3200 are arranged at a desired angle. After that, when the mode setting member 3400 is set to the fixed mode, the first part 3100 and the second part 3200 may maintain the arranged angle. The structure and operation of the mode setting member 3400 are the same as or similar to those of the mode setting member 410 according to the above-described embodiment; therefore, the detailed description thereof is omitted.

Hereinafter, the operation of the handy-stick type vacuum cleaner according to an embodiment of the present disclosure will be described with reference to FIG. 41.

When the suction motor 3310 is operated by the power supplied from the rechargeable battery 3250, a suction force is generated and the outside air is sucked into the inlet 3131 of the air inlet portion 3130. The sucked outside air moves along the inner passage 3132 and enters the cyclone 3111 of the dust collecting member 3110.

The dust and filth contained in the outside air are separated from the air and collected in the dust collecting member 3112 while the outside air passes through the cyclone 3111. The cleaned air is introduced into the suction motor 3310 provided in the motor housing 3320 through the discharge passage 3121 provided in the mounting portion 3120.

The air that has flowed into the suction motor 3310 is discharged through the discharge hole of the suction motor 3310. The air discharged from the suction motor 3310 is introduced into the filter housing 3260 through the air passage 3211 inside the handle 3210. The air introduced into the filter housing 3260 passes through the filter 3270, and then is discharged to the outside through the plurality of discharge slits 3261.

As described above, when performing cleaning using the handy-stick type vacuum cleaner 3000 according to the present embodiment, the second part 3200 provided with the handle 3210 may be rotated by a certain angle with respect to the first part 3100 about the rotation shafts 3240. Therefore, the operation of bending or twisting the wrist of the hand holding the handle 3210 of the second part 3200 may be minimized so that the load applied to the wrist may be greatly reduced.

In the above description, the handy-stick type vacuum cleaner 3000 has a structure in which the air discharged from the suction motor 3310 is discharged to the outside through the handle 3210. However, as another example, the handy-stick type vacuum cleaner 3000 may be configured so that the discharged air cools the rechargeable battery 3250.

FIG. 44 shows a handy-stick type vacuum cleaner 3000 having a structure in that the discharged air cools the rechargeable battery 3250 disposed in the second part 3200.

Referring to FIG. 44, an exhaust duct 3280 is provided above the rechargeable battery 3250. One end of the exhaust duct 3280 is connected to the connecting portion 3230 to communicate with the discharge hole of the motor housing 3320 and the other end of the exhaust duct 3280 is connected to the filter housing 3260. The connecting portion 3230 in which the exhaust duct 3280 is disposed may be provided with a guide flow passage for guiding the air discharged from the discharge hole of the housing 3320 to the exhaust duct 3280. At this time, the air passage through which the air passes is not provided inside the handle 3210.

Therefore, the air discharged from the motor housing 3320 is discharged to the outside through the exhaust duct 3280 and the filter housing 3260 without passing through the handle 3210. At this time, because the exhaust duct 3280 is provided on the upper side of the rechargeable battery 3250, the air discharged from the motor housing 3320 directly contacts the rechargeable battery 3250, thereby cooling the rechargeable battery 3250.

When the rechargeable battery 3250 is cooled using the air discharged from the suction motor 3310, the rechargeable battery 3250 may be efficiently cooled.

The handy-stick type vacuum cleaner 3000 shown in FIG. 44 is the same as the handy-stick type vacuum cleaner 3000 shown in FIGS. 40 to 43 except for the arrangement of the exhaust duct 3280; therefore, a detailed description thereof is omitted.

Finally, an embodiment of a handy-stick type vacuum cleaner 4000 according to the present disclosure will be described with reference to FIGS. 45 to 49.

Figure 45:
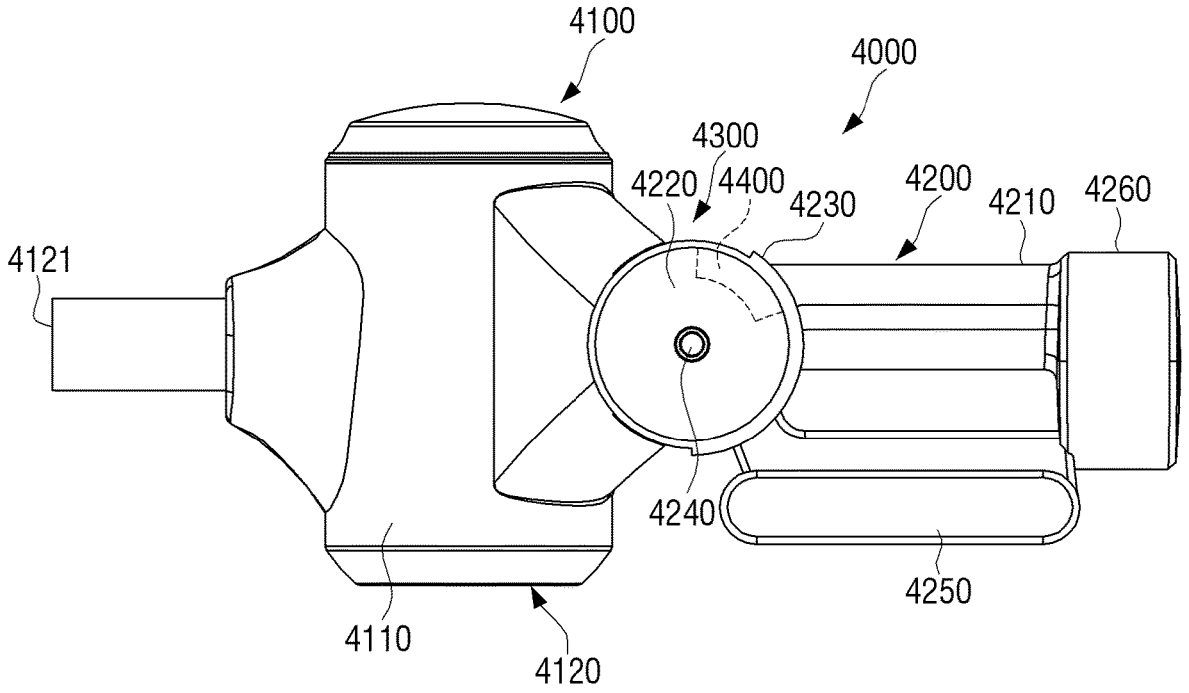
FIG. 45 is a view illustrating a handy-stick type vacuum cleaner according to another embodiment of the present disclosure.
Figure 46:
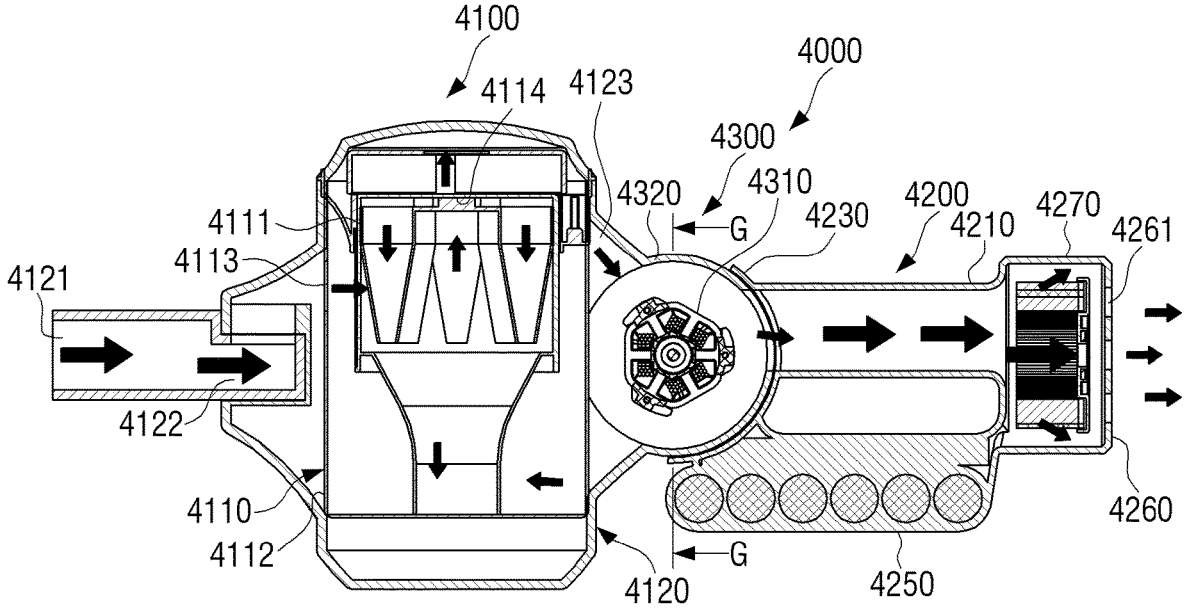
FIG. 46 is a cross-sectional view of the handy-stick type vacuum cleaner of FIG. 45.
Figure 47:
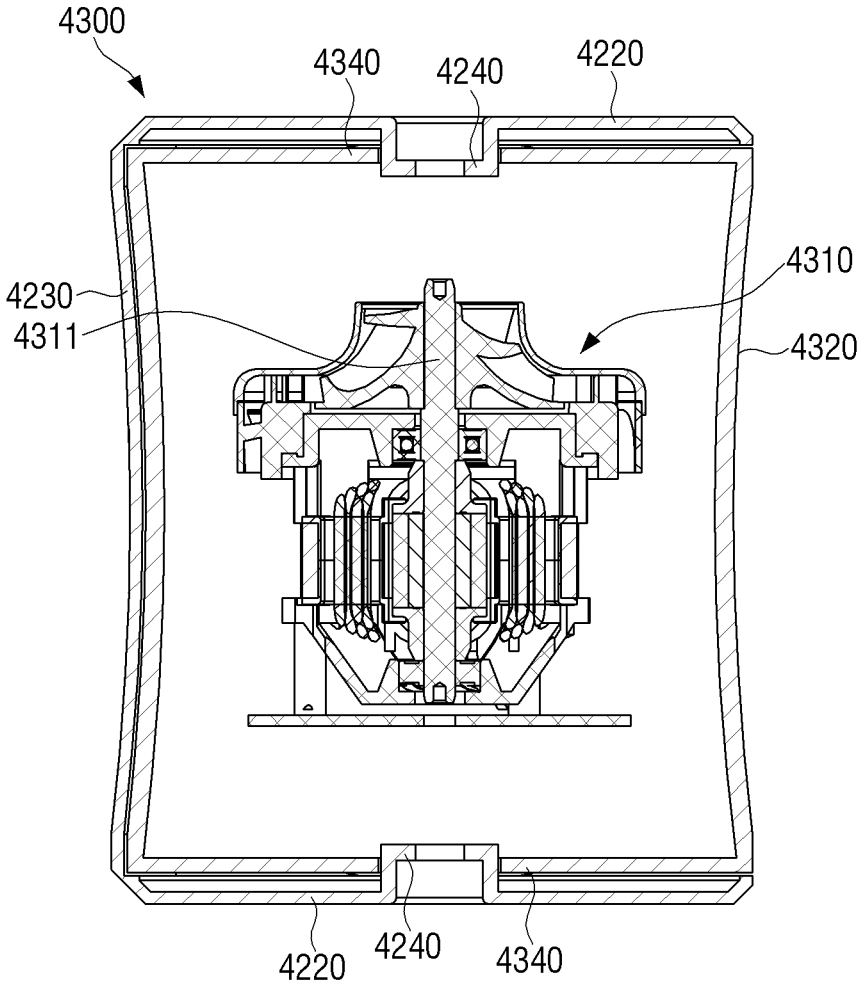
FIG. 47 is a cross-sectional view of the handy-stick type vacuum cleaner taken along line G-G illustrated in FIG. 46.
Figure 48:
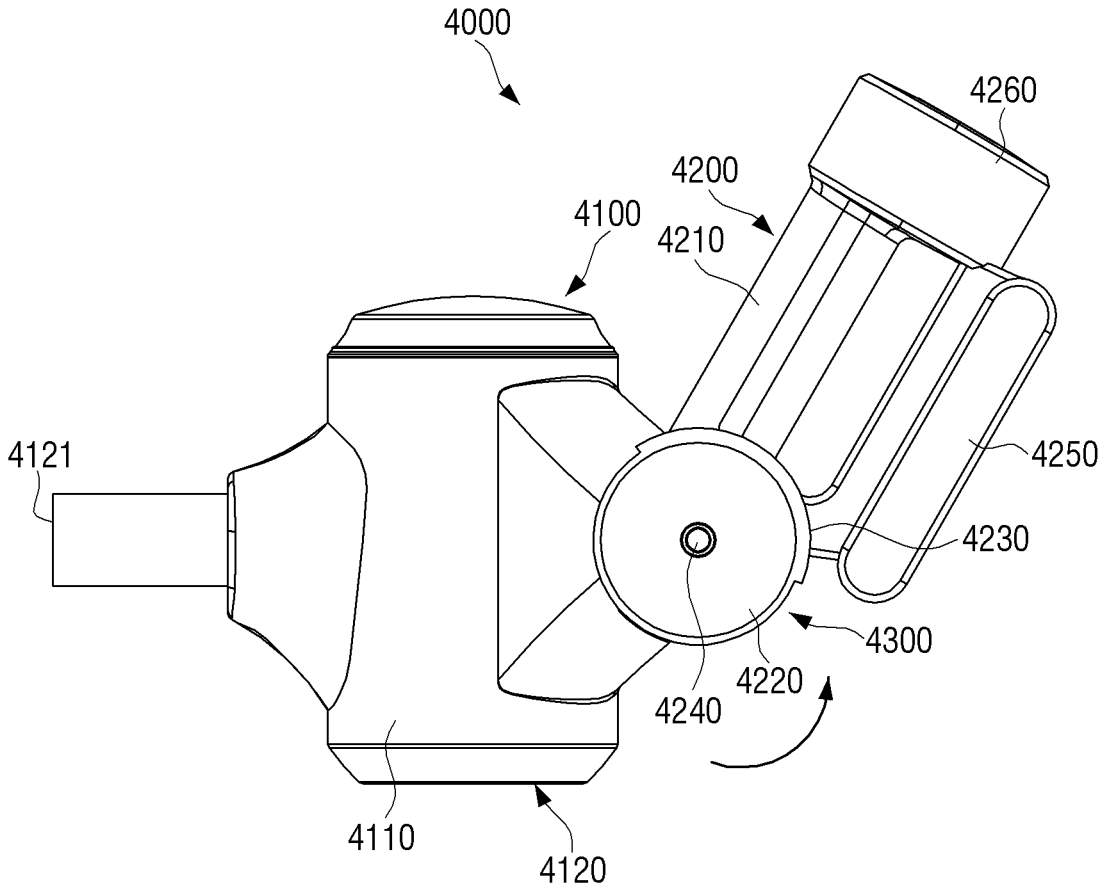
FIG. 48 is a view illustrating a state in which a handle of the handy-stick type vacuum cleaner of FIG. 45 is turned at a certain angle.
Figure 49:
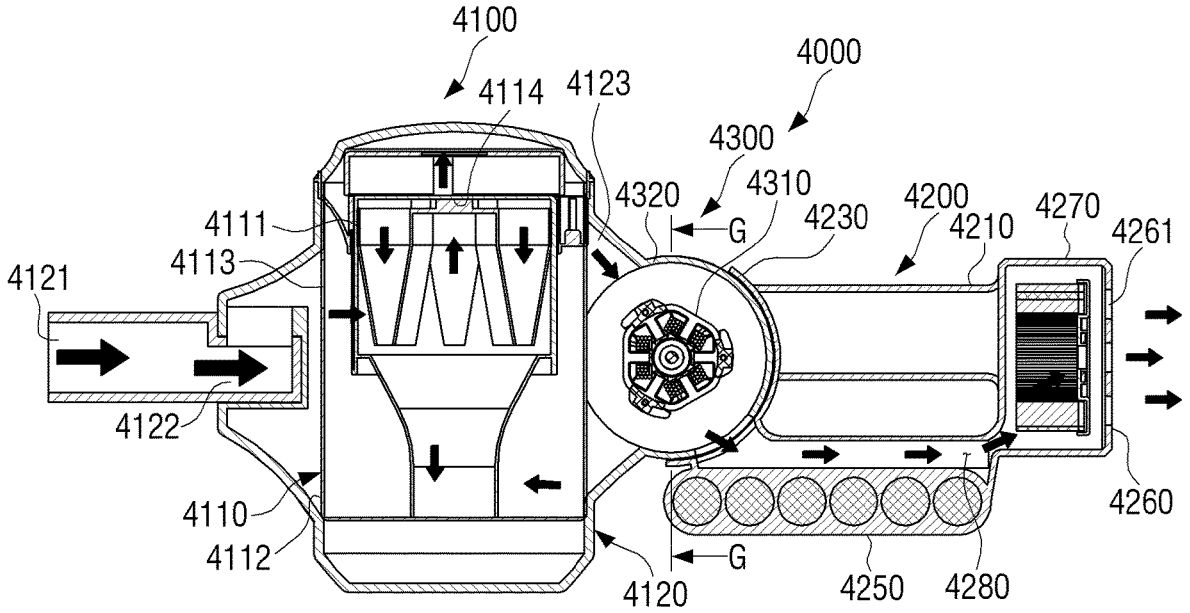
FIG. 49 is a cross-sectional view illustrating a modified example of the handy-stick type vacuum cleaner of FIG. 45.

FIG. 45 is a view illustrating a handy-stick type vacuum cleaner according to another embodiment of the present disclosure. FIG. 46 is a cross-sectional view of the handy-stick type vacuum cleaner of FIG. 45. FIG. 47 is a cross-sectional view of the handy-stick type vacuum cleaner taken along line G-G illustrated in FIG. 46. FIG. 48 is a view illustrating a state in which a handle of the handy-stick type vacuum cleaner of FIG. 45 is turned at a certain angle. FIG. 49 is a cross-sectional view illustrating a modified example of the handy-stick type vacuum cleaner of FIG. 45.

Referring to FIGS. 45 to 47, a handy-stick type vacuum cleaner 4000 according to an embodiment of the present disclosure may include a first part 4100 provided with a dust collecting member 4110, a second part 4200 provided with a handle 4210 and a rechargeable battery 4250, and a third part 4300 provided with a suction motor 4310.

In detail, the first part 4100 includes a mounting portion 4120 and a dust collecting member 4110 disposed in the mounting portion 4120. An inlet 4121 through which outside air containing dust is drawn is provided at one side of the mounting portion 4120. An internal passage 4122 for guiding the outside air to an inflow port 4113 of the dust collecting member 4110 is provided between the inlet 4121 and the dust collecting member 4110. An extension pipe 30 as illustrated in FIG. 15 may be detachably connected to the inlet 4121 of the mounting portion 4120. Therefore, the outside air is introduced into the dust collecting member 4110 through the inlet 4121 and the internal passage 4122 of the mounting portion 4120.

The dust collecting member 4110 may include a cyclone 4111 for separating dust from the suctioned air by swirling the suctioned air and a dust collecting chamber 4112 for collecting the dust separated by the cyclone 4111. The dust collecting chamber 4112 may be detachably provided to the mounting portion 4120.

The dust collecting member 4110 is disposed in the mounting portion 4120 such that the cyclone 4111 is substantially perpendicular to the direction of the air drawn into the inlet 4121 of the mounting portion 4120. For example, as illustrated in FIG. 46, the dust collecting member 4110 is disposed in the mounting portion 4120 so that the direction of the air discharged from a discharge port 4114 of the cyclone 4111 is substantially perpendicular to the direction of the suctioned air drawn into the internal passage 4122. Thus, when the extension pipe 30 of FIG. 15 is disposed in the inlet 4121 of the mounting portion 4120, the cyclone 4111 of the dust collecting member 4110 is substantially perpendicular to the extension pipe 30.

In addition, a discharge passage 4123 for guiding the air discharged from the dust collecting member 4110 to the suction motor 4310 is provided at the other side of the mounting portion 4120, that is, the opposite side of the mounting portion 4120 with the dust collecting member 4110 interposed therebetween. The discharge passage 4123 is provided in the mounting portion 4120 to guide the air discharged from the discharge port 4114 of the dust collecting member 4110 substantially perpendicularly to the direction in which the suctioned air is drawn into the dust collecting member 4110 to the inlet of the suction motor 4310.

The suction motor 4310 is disposed in the third part 4300. The third part 4300 is integrally formed with the first part 4100 and includes a motor housing 4320 in which the suction motor 4310 is embedded. The motor housing 4320 may be provided with the inlet for communicating with the discharge passage 4123 of the first part 4100 and a discharge hole for discharging the air having passed through suction motor 4310 to the outside of the motor housing 4320. Thus, the air drawn into the inlet of the motor housing 4320 of the third part 4300 passes through the suction motor 4310, and is discharged through the discharge hole.

A pair of first supporting portions 4340 for supporting the rotation of the second part 4200 may be provided at both ends of the motor housing 4320 of the third part 4300.

The second part 4200 is provided with the handle 4210 and the rechargeable battery 4250. The second part 4200 is formed to be rotatable with respect to the third part 4300. For example, the second part 4200 may include a pair of second supporting portions 4220 corresponding to the pair of first supporting portions 4340 of the third part 4300 and the handle 4210 connected to the pair of second supporting portions 4220. The pair of the second supporting portions 4220 and the handle 4210 are connected to each other through a connecting portion 4230. The pair of first supporting portions 4340 and the pair of second supporting portions 4220 are rotatably connected to each other by a pair of rotation shafts 4240. At this time, the pair of rotation shafts 4240 may be arranged coaxially with the rotation shaft of the suction motor 4310 disposed in the motor housing 4320 of the third part 4300.

Accordingly, the handle 4210 of the second part 4200 may rotate at a certain angle with respect to the first part 4100 about the pair of rotation shafts 4240. For example, the handle 4210, which is disposed substantially perpendicular to the mounting portion 4120 as illustrated in FIG. 45, is rotated counter-clockwise around the pair of rotation shafts 4240 by a certain angle, so that the mounting portion 4120 and the handle 4210 may be made to be an acute angle as illustrated in FIG. 48.

The handle 4210, the rechargeable battery 4250, and the filter housing 4260 provided in the second part 4200 are the same as the handle 3210, the rechargeable battery 3250, and the filter housing 3260 of the handy-stick type vacuum cleaner 3000 as illustrated in FIGS. 40 to 43; therefore, detailed descriptions thereof are omitted.

Further, the third part 4300 may be provided with a mode setting member 4400 configured to set the first part 4100 and the second part 4200 to one of a rotation mode in which the first part 4100 and the second part 4200 are rotatable with respect to each other and a fixed mode in which the first part 4100 and the second part 4200 are fixed with respect to each other.

The first part 4100 and the second part 4200 may be fixed or rotatable with respect to each other by operating the mode setting member 4400. Further, when the mode setting member 4400 is set to the rotation mode, the first part 4100 and the second part 4200 are arranged at a desired angle. After that, when the mode setting member 4400 is set to the fixed mode, the first part 4100 and the second part 4200 may maintain the arranged angle. The structure and operation of the mode setting member 4400 are the same as or similar to those of the mode setting member 410 according to the above-described embodiment; therefore, the detailed description thereof is omitted.

Hereinafter, the operation of the handy-stick type vacuum cleaner 4000 according to an embodiment of the present disclosure will be described with reference to FIG. 46.

When the suction motor 4310 is operated by the power supplied from the rechargeable battery 4250, a suction force is generated and the outside air is sucked into the inlet 4121 of the mounting portion 4120. The sucked outside air moves along the inner passage 4122 and enters the cyclone 4111 of the dust collecting member 4110.

The dust and filth contained in the outside air are separated from the air and collected in the dust collecting member 4112 while the outside air passes through the cyclone 4111. The cleaned air is introduced into the suction motor 4310 provided in the motor housing 4320 through the discharge passage 4123 provided in the mounting portion 4120.

The air flowed into the suction motor 4310 is discharged through the discharge hole of the suction motor 4310. The air discharged from the suction motor 4310 is introduced into the filter housing 4260 through the air passage 4211 inside the handle 4210. The air introduced into the filter housing 4260 passes through the filter 4270, and then is discharged to the outside through the plurality of discharge slits 4261.

As described above, when performing cleaning using the handy-stick type vacuum cleaner 4000 according to the present embodiment, the second part 4200 provided with the handle 4210 may be rotated by a certain angle with respect to the first part 4100 about the rotation shafts 4240. Therefore, the operation of bending or twisting the wrist of the hand holding the handle 4210 of the second part 4200 may be minimized so that the load applied to the wrist may be greatly reduced.

In the above description, the handy-stick type vacuum cleaner 4000 has a structure in which the air discharged from the suction motor 4310 is discharged to the outside through the handle 4210. However, as another example, the handy-stick type vacuum cleaner 4000 may be configured so that the discharged air cools the rechargeable battery 4250.

FIG. 49 shows a handy-stick type vacuum cleaner 4000 having a structure in that the discharged air cools the rechargeable battery 4250 disposed in the second part 4200.

Referring to FIG. 49, an exhaust duct 4280 is provided at the upper side of the rechargeable battery 4250. One end of the exhaust duct 4280 is connected to the connecting portion 4230 to communicate with the discharge hole of the motor housing 4320 and the other end of the exhaust duct 4280 is connected to the filter housing 4260. The connecting portion 4230 in which the exhaust duct 4280 is disposed may be provided with a guide flow passage for guiding the air discharged from the discharge hole of the motor housing 4320 to the exhaust duct 4280. At this time, the air passage through which the air passes is not provided inside the handle 4210.

Therefore, the air discharged from the motor housing 4310 is discharged to the outside through the exhaust duct 4280 and the filter housing 4260 without passing through the handle 4210. At this time, because the exhaust duct 4280 is provided at the upper side of the rechargeable battery 4250, the air discharged from the motor housing 4320 directly cools the rechargeable battery 4250.

When the rechargeable battery 4250 is cooled using the air discharged from the suction motor 4310, the rechargeable battery 4250 may be efficiently cooled.

Hereinabove, although the embodiments of the present disclosure have been shown and described, it should be understood that the present disclosure is not limited to the disclosed embodiments. It will be understood by those skilled in the art that various changes in form and details may be made therein without departing from the spirit and scope of the present disclosure as defined by the appended claims and their equivalents.

The invention claimed is:

1. A hand held vacuum cleaner comprising:

a first part including a dust collecting member, wherein the dust collecting member is configured to separate dust from an introduced air;

a second part including a suction motor and a handle configured to be held by a user; and a third part configured to rotatably connect the first part and the second part, the third part having a first support extending from the first part, a second support extending from the second part and a rotation axis coupled to the first support and the second support such that the first part is rotatable with respect to the second part only about the rotation axis of the third part and such that the second part, including the handle and the suction motor, are configured to be rotatable, with respect to the first part, only about the rotation axis of the third part, wherein the first part is configured to receive external air which passes through the dust collecting member and moves to the second part, the first part, the second part and the third part are configured to operate as a hand held vacuum cleaner, the first part is movable between a first position and a second position, and the first position is a position where a center axis of the first part and a center axis of the suction motor are parallel or concentric with each other, and the second position is a position where the center axis of the first part and the center axis of the suction motor form an obtuse angle.

2. The hand held vacuum cleaner of claim 1, wherein the first part and the second part are in communication with each other through a flexible tube connected to the first part and the second part.

3. The hand held vacuum cleaner of claim 2, wherein the flexible tube includes one end connected to an air discharge port of the first part and another end connected to an air inlet hole of the second part.

4. The hand held vacuum cleaner of claim 3, wherein the flexible tube is disposed inside the third part.

5. The hand held vacuum cleaner of claim 3, wherein the third part is disposed behind the air discharge port of the first part and in front of the air inlet hole of the second part.

6. The hand held vacuum cleaner of claim 3, wherein the flexible tube is provided with a helical protrusion formed on its outer circumferential surface, and wherein a first engaging member and a second engaging member screwed to both ends of the flexible tube are provided at the air discharge port of the first part and the air inlet hole of the second part.

7. The hand held vacuum cleaner of claim 2, wherein the dust collecting member is detachably disposed in a mounting space, and the dust collecting member is divided into a cyclone and a dust collecting chamber.

8. The hand held vacuum cleaner of claim 7, wherein the dust collecting member comprises:

a container including the cyclone and the dust collecting chamber; and a cover configured to open and close an open rear surface of the container and to guide air discharged from the cyclone to the second part.

9. The hand held vacuum cleaner of claim 8, wherein the cyclone comprises:

a grill filter member disposed inside the cyclone to reciprocate linearly along an axial direction of the cyclone; and a plurality of catching protrusions inclined to contact an outer surface of a grill portion of the grill filter member.

10. The hand held vacuum cleaner of claim 9, wherein the cyclone comprises:

a guide pipe configured to receive the grill portion when the grill filter member is retracted; and a helical guide disposed between the guide pipe and an inner circumferential surface of the cyclone and configured to guide dust and air flowing into the cyclone in a helical direction, and wherein the plurality of catching protrusions are disposed at a tip end of the guide pipe at intervals.

11. The hand held vacuum cleaner of claim 10, wherein the grill portion is provided with a plurality of grooves on the outer surface of the grill portion so that the plurality of catching protrusions are slidably inserted into the plurality of grooves along a longitudinal direction of the grill portion.

12. The hand held vacuum cleaner of claim 9, wherein the grill filter member is elastically supported by an elastic member so as to be retractable and elastically advanced with respect to the container.

13. The hand held vacuum cleaner of claim 2, wherein an inlet of the suction motor of the second part is in communication with the flexible tube.

14. The hand held vacuum cleaner of claim 1, wherein the third part includes a mode setting member configured to set the third part to a rotation mode in which the first part and the second part are rotatable with respect to each other, or a fixed mode in which the first part and the second part are fixed with respect to each other.

15. The hand held vacuum cleaner of claim 14, wherein in the fixed mode, the center axis of the first part and the center axis of the second part are parallel to each other, and wherein in the rotation mode, the center axis of the first part and the center axis of the second part form the obtuse angle.

16. The hand held vacuum cleaner of claim 14, wherein in the fixed mode, a center axis of a cyclone of the dust collecting member is arranged in parallel or concentrically with the center axis of the suction motor, and in the rotation mode, the center axis of the cyclone of the dust collecting member and the center axis of the suction motor form the obtuse angle.

17. The hand held vacuum cleaner of claim 14, wherein an angle formed between the center axis of the first part and the center axis of the handle is smaller in the rotation mode than in the fixed mode.

18. A hand held vacuum cleaner comprising:

a first part including a suction hole formed at a tip end thereof and a dust collecting member detachably disposed in a mounting space communicating with the suction hole;

a second part provided with a suction motor thereinside and a handle extended from one side thereof, the handle configured to be held by a user;

a third part configured to rotatably connect a rear end of the first part and a leading end of the second part, the third part having a first support extending from the first part, a second support extending from the second part and a rotation axis such that the first part is rotatable with respect to the second part only about the rotation axis of the third part, and such that the second part, including the handle and the suction motor, are configured to be rotatable, with respect to the first part, only about the rotation axis of the third part; and a flexible tube extending through the third part and configured to connect a cyclone formed in the dust collecting member and the suction motor to be in communication with each other, and wherein the first part is configured to receive external air which passes through the dust collecting member and moves to the second part, the first part, the second part and the third part are configured to operate as a hand held vacuum cleaner, the first part is movable between a first position and a second position, and the first position is a position where a center axis of the first part and a center axis of the suction motor are parallel or concentric with each other, and the second position is a position where the center axis of the first part and the center axis of the suction motor form an obtuse angle.

19. A hand held vacuum cleaner comprising:

a dust collector configured to separate dust from an introduced air;

a main body including a suction motor configured to generate a suction force, the main body having a handle configured to be held by a user; and a connector configured to rotatably connect the dust collector and the main body, the connector having a first support extending from the dust collector, a second support extending from the main body and a rotation axis coupled to the first support and the second support such that the main body and the dust collector are mutually rotatable, with respect to each other, only about the rotation axis of the connector and such that the handle and the suction motor are rotatable together, with respect to the dust collector, only about the rotation axis of the connector, and wherein the dust collector is configured to receive external air which moves to the main body, the dust collector and the main body, including the handle and the suction motor, are configured to operate as a hand held vacuum cleaner, the dust collector is configured to be selectively attachable to a wand having a head to clean a surface, the dust collector is movable between a first position and a second position, and the first position is a position where a center axis of the dust collector and a center axis of the suction motor are parallel or concentric with each other, and the second position is a position where the center axis of the dust collector and the center axis of the suction motor form an obtuse angle.

* * * * *